US009027668B2

(12) United States Patent
Zediker et al.

(10) Patent No.: US 9,027,668 B2
(45) Date of Patent: May 12, 2015

(54) CONTROL SYSTEM FOR HIGH POWER LASER DRILLING WORKOVER AND COMPLETION UNIT

(75) Inventors: Mark S. Zediker, Castle Rock, CO (US); Siamak Makki, Novato, CA (US); Brian O. Faircloth, Evergreen, CO (US); Ronald A. DeWitt, Katy, TX (US); Erik C. Allen, Minneapolis, MN (US); Lance D. Underwood, Morrison, CO (US)

(73) Assignee: Foro Energy, Inc., Littleton, CO (US)

( * ) Notice: Subject to any disclaimer, the term of this patent is extended or adjusted under 35 U.S.C. 154(b) by 381 days.

(21) Appl. No.: 13/403,692

(22) Filed: Feb. 23, 2012

(65) Prior Publication Data

US 2012/0248078 A1 Oct. 4, 2012

Related U.S. Application Data

(63) Continuation-in-part of application No. 13/210,581, filed on Aug. 16, 2011, now Pat. No. 8,662,160, which is a continuation-in-part of application No. 12/544,136, filed on Aug. 19, 2009, now Pat. No.

(Continued)

(51) Int. Cl.

| | |
|---|---|
| ***E21B 7/15*** | (2006.01) |
| ***E21B 17/20*** | (2006.01) |
| ***E21B 44/00*** | (2006.01) |
| ***E21B 47/12*** | (2012.01) |
| ***H04B 10/079*** | (2013.01) |
| ***E21B 7/14*** | (2006.01) |

(52) U.S. Cl.
CPC ... *E21B 7/14* (2013.01); *E21B 7/15* (2013.01); *E21B 44/00* (2013.01)

(58) Field of Classification Search
CPC ..... E21B 7/15; E21B 17/026; E21B 44/00; E21B 44/005; E21B 47/123; H04B 10/0799
USPC ..... 175/16, 26, 27, 40, 45
See application file for complete search history.

(56) References Cited

U.S. PATENT DOCUMENTS

| | | | |
|---|---|---|---|
| 914,636 | A | 3/1909 | Case |
| 2,548,463 | A | 4/1951 | Blood |
| 2,742,555 | A | 4/1956 | Murray |
| 3,122,212 | A | 2/1964 | Karlovitz |
| 3,383,491 | A | 5/1968 | Muncheryan |

(Continued)

FOREIGN PATENT DOCUMENTS

| | | | |
|---|---|---|---|
| EP | 0 295 045 | A2 | 12/1988 |
| EP | 0 515 983 | A1 | 12/1992 |

(Continued)

OTHER PUBLICATIONS

U.S. Appl. No. 12/543,986, filed Aug. 19, 2013, Moxley et al.

(Continued)

*Primary Examiner* — Jennifer H Gay
(74) *Attorney, Agent, or Firm* — Glen P. Belvis; Steptoe & Johnson

(57) ABSTRACT

A control and monitoring system controls and monitors a high power laser system for performing high power laser operations. The control and monitoring system is configured to perform high power laser operation on, and in, remote and difficult to access locations.

14 Claims, 27 Drawing Sheets

Related U.S. Application Data

8,511,401, application No. 13/403,692, which is a continuation-in-part of application No. 12/544,136, filed on Aug. 19, 2009, now Pat. No. 8,511,401, application No. 13/403,692, which is a continuation-in-part of application No. 12/543,986, filed on Aug. 19, 2009, now Pat. No. 8,826,973.

(60) Provisional application No. 61/446,412, filed on Feb. 24, 2011, provisional application No. 61/446,312, filed on Feb. 24, 2011, provisional application No. 61/446,407, filed on Feb. 24, 2011, provisional application No. 61/153,271, filed on Feb. 17, 2009, provisional application No. 61/106,472, filed on Oct. 17, 2008, provisional application No. 61/102,730, filed on Oct. 3, 2008, provisional application No. 61/090,384, filed on Aug. 20, 2008, provisional application No. 61/446,042, filed on Feb. 24, 2011.

(56) References Cited

U.S. PATENT DOCUMENTS

| | | | | |
|---|---|---|---|---|
| 3,461,964 | A | | 8/1969 | Venghiattis |
| 3,493,060 | A | | 2/1970 | Van Dyk |
| 3,503,804 | A | | 3/1970 | Schneider et al. |
| 3,539,221 | A | | 11/1970 | Gladstone |
| 3,544,165 | A | | 12/1970 | Snedden |
| 3,556,600 | A | | 1/1971 | Shoupp et al. |
| 3,574,357 | A | | 4/1971 | Alexandru et al. |
| 3,586,413 | A | | 6/1971 | Adams |
| 3,652,447 | A | | 3/1972 | Yant |
| 3,693,718 | A | | 9/1972 | Stout |
| 3,699,649 | A | | 10/1972 | McWilliams |
| 3,802,203 | A | | 4/1974 | Ichise et al. |
| 3,820,605 | A | | 6/1974 | Barber et al. |
| 3,821,510 | A | | 6/1974 | Muncheryan |
| 3,823,788 | A | | 7/1974 | Garrison et al. |
| 3,871,485 | A | | 3/1975 | Keenan, Jr. |
| 3,882,945 | A | | 5/1975 | Keenan, Jr. |
| 3,938,599 | A | | 2/1976 | Horn |
| 3,960,448 | A | | 6/1976 | Schmidt et al. |
| 3,977,478 | A | | 8/1976 | Shuck |
| 3,992,095 | A | | 11/1976 | Jacoby et al. |
| 3,998,281 | A | | 12/1976 | Salisbury et al. |
| 4,019,331 | A | | 4/1977 | Rom et al. |
| 4,025,091 | A | | 5/1977 | Zeile, Jr. |
| 4,026,356 | A | | 5/1977 | Shuck |
| 4,047,580 | A | | 9/1977 | Yahiro et al. |
| 4,057,118 | A | | 11/1977 | Ford |
| 4,061,190 | A | | 12/1977 | Bloomfield |
| 4,066,138 | A | | 1/1978 | Salisbury et al. |
| 4,090,572 | A | | 5/1978 | Welch |
| 4,113,036 | A | | 9/1978 | Stout |
| 4,125,757 | A | | 11/1978 | Ross |
| 4,151,393 | A | | 4/1979 | Fenneman et al. |
| 4,162,400 | A | | 7/1979 | Pitts, Jr. |
| 4,189,705 | A | | 2/1980 | Pitts, Jr. |
| 4,194,536 | A | | 3/1980 | Stine et al. |
| 4,199,034 | A | | 4/1980 | Salisbury et al. |
| 4,227,582 | A | | 10/1980 | Price |
| 4,228,856 | A | | 10/1980 | Reale |
| 4,243,298 | A | | 1/1981 | Kao et al. |
| 4,249,925 | A | | 2/1981 | Kawashima et al. |
| 4,252,015 | A | | 2/1981 | Harbon et al. |
| 4,256,146 | A | | 3/1981 | Genini et al. |
| 4,266,609 | A | | 5/1981 | Rom et al. |
| 4,280,535 | A | | 7/1981 | Willis |
| 4,281,891 | A | | 8/1981 | Shinohara et al. |
| 4,282,940 | A | | 8/1981 | Salisbury et al. |
| 4,332,401 | A | | 6/1982 | Stephenson et al. |
| 4,336,415 | A | | 6/1982 | Walling |
| 4,340,245 | A | | 7/1982 | Stalder |
| 4,367,917 | A | | 1/1983 | Gray |
| 4,370,886 | A | | 2/1983 | Smith, Jr. et al. |
| 4,374,530 | A | | 2/1983 | Walling |
| 4,375,164 | A | | 3/1983 | Dodge et al. |
| 4,389,645 | A | | 6/1983 | Wharton |
| 4,415,184 | A | | 11/1983 | Stephenson et al. |
| 4,417,603 | A | | 11/1983 | Argy |
| 4,436,177 | A | | 3/1984 | Elliston |
| 4,444,420 | A | | 4/1984 | McStravick et al. |
| 4,453,570 | A | | 6/1984 | Hutchison |
| 4,459,731 | A | | 7/1984 | Hutchison |
| 4,477,106 | A | | 10/1984 | Hutchison |
| 4,504,112 | A | | 3/1985 | Gould et al. |
| 4,504,727 | A | * | 3/1985 | Melcher et al. ..... 219/121.62 |
| 4,522,464 | A | | 6/1985 | Thompson et al. |
| 4,531,552 | A | | 7/1985 | Kim |
| 4,565,351 | A | | 1/1986 | Conti et al. |
| 4,662,437 | A | | 5/1987 | Renfro |
| 4,694,865 | A | | 9/1987 | Tauschmann |
| 4,715,451 | A | * | 12/1987 | Bseisu et al. ..... 175/40 |
| 4,725,116 | A | | 2/1988 | Spencer et al. |
| 4,741,405 | A | | 5/1988 | Moeny et al. |
| 4,770,493 | A | | 9/1988 | Ara et al. |
| 4,774,420 | A | | 9/1988 | Sutton |
| 4,793,383 | A | | 12/1988 | Gyory et al. |
| 4,830,113 | A | | 5/1989 | Geyer |
| 4,860,654 | A | | 8/1989 | Chawla et al. |
| 4,860,655 | A | | 8/1989 | Chawla |
| 4,872,520 | A | | 10/1989 | Nelson |
| 4,924,870 | A | | 5/1990 | Wlodarczyk et al. |
| 4,952,771 | A | | 8/1990 | Wrobel |
| 4,989,236 | A | | 1/1991 | Myllymäki |
| 4,997,250 | A | | 3/1991 | Ortiz, Jr. |
| 5,003,144 | A | | 3/1991 | Lindroth et al. |
| 5,004,166 | A | | 4/1991 | Sellar |
| 5,033,545 | A | | 7/1991 | Sudol |
| 5,049,738 | A | | 9/1991 | Gergely et al. |
| 5,084,617 | A | | 1/1992 | Gergely |
| 5,086,842 | A | | 2/1992 | Cholet |
| 5,093,880 | A | | 3/1992 | Matsuda et al. |
| 5,107,936 | A | | 4/1992 | Foppe |
| 5,121,872 | A | | 6/1992 | Legget |
| 5,125,061 | A | | 6/1992 | Marlier et al. |
| 5,125,063 | A | | 6/1992 | Panuska et al. |
| 5,128,882 | A | | 7/1992 | Cooper et al. |
| 5,136,410 | A | * | 8/1992 | Heiling et al. ..... 398/15 |
| 5,140,664 | A | | 8/1992 | Bosisio et al. |
| 5,163,321 | A | | 11/1992 | Perales |
| 5,168,940 | A | | 12/1992 | Foppe |
| 5,172,112 | A | | 12/1992 | Jennings |
| 5,182,785 | A | | 1/1993 | Savegh et al. |
| 5,212,755 | A | | 5/1993 | Holmberg |
| 5,226,107 | A | | 7/1993 | Stern et al. |
| 5,269,377 | A | | 12/1993 | Martin |
| 5,285,204 | A | | 2/1994 | Sas-Jaworsky |
| 5,348,097 | A | | 9/1994 | Giannesini et al. |
| 5,351,533 | A | | 10/1994 | Macadam et al. |
| 5,353,875 | A | | 10/1994 | Schultz et al. |
| 5,355,967 | A | | 10/1994 | Mueller et al. |
| 5,356,081 | A | | 10/1994 | Sellar |
| 5,396,805 | A | | 3/1995 | Surjaatmadja |
| 5,397,372 | A | | 3/1995 | Partus et al. |
| 5,411,081 | A | | 5/1995 | Moore et al. |
| 5,411,085 | A | | 5/1995 | Moore et al. |
| 5,411,105 | A | | 5/1995 | Gray |
| 5,413,045 | A | | 5/1995 | Miszewski |
| 5,413,170 | A | | 5/1995 | Moore |
| 5,419,188 | A | | 5/1995 | Rademaker et al. |
| 5,423,383 | A | | 6/1995 | Pringle |
| 5,425,420 | A | | 6/1995 | Pringle |
| 5,435,351 | A | | 7/1995 | Head |
| 5,435,395 | A | | 7/1995 | Connell |
| 5,463,711 | A | | 10/1995 | Chu |
| 5,465,793 | A | | 11/1995 | Pringle |
| 5,469,878 | A | | 11/1995 | Pringle |
| 5,479,860 | A | | 1/1996 | Ellis |
| 5,483,988 | A | | 1/1996 | Pringle |
| 5,488,992 | A | | 2/1996 | Pringle |
| 5,500,768 | A | | 3/1996 | Doggett et al. |
| 5,503,014 | A | | 4/1996 | Griffith |
| 5,503,370 | A | | 4/1996 | Newman et al. |

(56) References Cited

U.S. PATENT DOCUMENTS 5,505,259 A 4/1996 Wittrisch et al.
5,515,926 A 5/1996 Boychuk
5,526,887 A 6/1996 Vestavik
5,561,516 A 10/1996 Noble et al.
5,566,764 A 10/1996 Elliston
5,573,225 A 11/1996 Boyle et al.
5,574,815 A 11/1996 Kneeland
5,577,560 A 11/1996 Coronado et al.
5,586,609 A 12/1996 Schuh
5,599,004 A 2/1997 Newman et al.
5,615,052 A 3/1997 Doggett
5,638,904 A 6/1997 Misselbrook et al.
5,655,745 A 8/1997 Morrill
5,692,087 A 11/1997 Partus et al.
5,694,408 A 12/1997 Bott et al.
5,707,939 A 1/1998 Patel
5,757,484 A 5/1998 Miles et al.
5,759,859 A 6/1998 Sausa
5,771,984 A 6/1998 Potter et al.
5,773,791 A 6/1998 Kuykendal
5,794,703 A 8/1998 Newman et al.
5,813,465 A 9/1998 Terrell et al.
5,828,003 A 10/1998 Thomeer et al.
5,832,006 A 11/1998 Rice et al.
5,833,003 A 11/1998 Longbottom et al.
5,847,825 A 12/1998 Alexander
5,862,273 A 1/1999 Pelletier
5,862,862 A 1/1999 Terrell
5,896,482 A 4/1999 Blee et al.
5,896,938 A 4/1999 Moeny et al.
5,902,499 A 5/1999 Richerzhagen
5,909,306 A 6/1999 Goldberg et al.
5,913,337 A 6/1999 Williams et al.
5,924,489 A 7/1999 Hatcher
5,929,986 A 7/1999 Slater et al.
5,933,945 A 8/1999 Thomeer et al.
5,938,954 A 8/1999 Onuma et al.
5,973,783 A 10/1999 Goldner et al.
5,986,756 A 11/1999 Slater et al.
RE36,525 E 1/2000 Pringle
6,015,015 A 1/2000 Luft et al.
6,038,363 A 3/2000 Slater et al.
6,059,037 A 5/2000 Longbottom et al.
6,060,662 A 5/2000 Rafie et al.
6,065,540 A 5/2000 Thomeer et al.
RE36,723 E 6/2000 Moore et al.
6,076,602 A 6/2000 Gano et al.
6,092,601 A 7/2000 Gano et al.
6,104,022 A 8/2000 Young et al.
RE36,880 E 9/2000 Pringle
6,116,344 A 9/2000 Longbottom et al.
6,135,206 A 10/2000 Gano et al.
6,147,754 A 11/2000 Theriault et al.
6,157,893 A 12/2000 Berger et al.
6,166,546 A 12/2000 Scheihing et al.
6,215,734 B1 4/2001 Moeny et al.
6,227,300 B1 5/2001 Cunningham et al.
6,250,391 B1 6/2001 Proudfoot
6,273,193 B1 8/2001 Hermann et al.
6,275,645 B1 8/2001 Vereecken et al.
6,281,489 B1 8/2001 Tubel et al.
6,288,362 B1 * 9/2001 Thomas et al. ..... 219/121.84
6,301,423 B1 10/2001 Olson
6,309,195 B1 10/2001 Bottos et al.
6,321,839 B1 11/2001 Vereecken et al.
6,352,114 B1 3/2002 Toalson et al.
6,355,928 B1 3/2002 Skinner et al.
6,356,683 B1 3/2002 Hu et al.
6,377,591 B1 4/2002 Hollister et al.
6,378,627 B1 * 4/2002 Tubel et al. ..... 175/24
6,384,738 B1 5/2002 Carstensen et al.
6,386,300 B1 5/2002 Curlett et al.
6,401,825 B1 6/2002 Woodrow
6,426,479 B1 7/2002 Bischof
6,437,326 B1 8/2002 Yamate et al.
6,450,257 B1 9/2002 Douglas
6,463,198 B1 10/2002 Coleman et al.
6,494,259 B2 12/2002 Surjaatmadja
6,497,290 B1 12/2002 Misselbrook et al.
6,557,249 B1 5/2003 Pruett et al.
6,561,289 B2 5/2003 Portman et al.
6,564,046 B1 5/2003 Chateau
6,591,046 B2 7/2003 Stottlemyer
6,615,922 B2 9/2003 Deul et al.
6,626,249 B2 9/2003 Rosa
6,644,848 B1 11/2003 Clayton et al.
6,661,815 B1 12/2003 Kozlovsky et al.
6,710,720 B2 3/2004 Carstensen et al.
6,712,150 B1 3/2004 Crabtree et al.
6,725,924 B2 4/2004 Davidson et al.
6,747,743 B2 6/2004 Skinner et al.
6,755,262 B2 6/2004 Parker
6,808,023 B2 10/2004 Smith et al.
6,832,654 B2 12/2004 Ravensbergen et al.
6,847,034 B2 1/2005 Shah et al.
6,851,488 B2 2/2005 Batarseh
6,867,858 B2 3/2005 Owen et al.
6,870,128 B2 3/2005 Kobayashi et al.
6,874,361 B1 4/2005 Meltz et al.
6,880,646 B2 4/2005 Batarseh
6,885,784 B2 4/2005 Bohnert
6,888,097 B2 5/2005 Batarseh
6,888,127 B2 5/2005 Jones et al.
6,892,812 B2 * 5/2005 Niedermayr et al. .... 166/250.15
6,912,898 B2 7/2005 Jones et al.
6,913,079 B2 7/2005 Tubel
6,920,395 B2 7/2005 Brown
6,920,946 B2 7/2005 Oglesby
6,923,273 B2 8/2005 Terry et al.
6,944,380 B1 9/2005 Hideo et al.
6,957,576 B2 10/2005 Skinner et al.
6,967,322 B2 11/2005 Jones et al.
6,977,367 B2 12/2005 Tubel et al.
6,978,832 B2 12/2005 Gardner et al.
6,981,561 B2 1/2006 Krueger et al.
6,994,162 B2 2/2006 Robison
7,013,993 B2 3/2006 Masui et al.
7,040,746 B2 5/2006 McCain et al.
7,055,604 B2 6/2006 Jee et al.
7,055,629 B2 6/2006 Oglesby
7,072,044 B2 7/2006 Kringlebotn et al.
7,072,588 B2 7/2006 Skinner
7,086,484 B2 8/2006 Smith, Jr.
7,087,865 B2 8/2006 Lerner
7,088,437 B2 8/2006 Blomster et al.
7,099,533 B1 8/2006 Chenard
7,126,332 B2 10/2006 Blanz et al.
7,134,488 B2 11/2006 Tudor et al.
7,134,514 B2 11/2006 Riel et al.
7,140,435 B2 11/2006 Defretin et al.
7,147,064 B2 12/2006 Batarseh et al.
7,152,700 B2 12/2006 Church et al.
7,163,875 B2 1/2007 Richerzhagen
7,172,026 B2 2/2007 Misselbrook
7,172,038 B2 2/2007 Terry et al.
7,174,067 B2 2/2007 Murshid et al.
7,188,687 B2 3/2007 Rudd et al.
7,195,731 B2 3/2007 Jones
7,196,786 B2 3/2007 DiFoggio
7,199,869 B2 4/2007 MacDougall
7,201,222 B2 4/2007 Kanady et al.
7,210,343 B2 5/2007 Shammai et al.
7,212,283 B2 5/2007 Hother et al.
7,249,633 B2 7/2007 Ravensbergen et al.
7,264,057 B2 9/2007 Rytlewski et al.
7,270,195 B2 9/2007 MacGregor et al.
7,273,108 B2 9/2007 Misselbrook
7,310,466 B2 12/2007 Fink et al.
7,334,637 B2 2/2008 Smith, Jr.
7,337,660 B2 3/2008 Ibrahim et al.
7,362,422 B2 4/2008 DiFoggio et al.
7,372,230 B2 5/2008 McKay
7,394,064 B2 7/2008 Marsh
7,395,696 B2 7/2008 Bissonnette et al.

(56) References Cited

U.S. PATENT DOCUMENTS 7,416,032 B2 8/2008 Moeny et al.
7,416,258 B2 8/2008 Reed et al.
7,424,190 B2 9/2008 Dowd et al.
7,471,831 B2 12/2008 Bearman et al.
7,487,834 B2 2/2009 Reed et al.
7,490,664 B2 2/2009 Skinner et al.
7,503,404 B2 3/2009 McDaniel et al.
7,515,782 B2 4/2009 Zhang et al.
7,516,802 B2 4/2009 Smith, Jr.
7,518,722 B2 4/2009 Julian et al.
7,527,108 B2 5/2009 Moeny
7,530,406 B2 5/2009 Moeny et al.
7,535,628 B2 5/2009 Tsuchiya et al.
7,540,337 B2 * 6/2009 McLoughlin et al. ..... 175/45
7,559,378 B2 7/2009 Moeny
7,587,111 B2 9/2009 de Montmorillon et al.
7,600,564 B2 10/2009 Shampine et al.
7,603,011 B2 10/2009 Varkey et al.
7,617,873 B2 11/2009 Lovell et al.
7,624,743 B2 12/2009 Sarkar et al.
7,628,227 B2 12/2009 Marsh
7,646,953 B2 1/2010 Dowd et al.
7,647,948 B2 1/2010 Quigley et al.
7,671,983 B2 3/2010 Shammai et al.
7,715,664 B1 5/2010 Shou et al.
7,720,323 B2 5/2010 Yamate et al.
7,769,260 B2 8/2010 Hansen et al.
7,802,384 B2 9/2010 Kobayashi et al.
7,834,777 B2 11/2010 Gold
7,848,368 B2 12/2010 Gapontsev et al.
7,900,699 B2 3/2011 Ramos et al.
7,938,175 B2 5/2011 Skinner et al.
8,011,454 B2 9/2011 Castillo
8,062,986 B2 11/2011 Khrapko et al.
8,074,332 B2 12/2011 Keatch et al.
8,082,996 B2 12/2011 Kocis et al.
8,086,100 B2 * 12/2011 Aronson et al. ..... 398/25
8,091,638 B2 1/2012 Dusterhoft et al.
8,109,345 B2 2/2012 Jeffryes
8,175,433 B2 5/2012 Caldwell et al.
8,385,705 B2 2/2013 Overton et al.
8,627,901 B1 * 1/2014 Underwood et al. ..... 175/16
2002/0007945 A1 1/2002 Neuroth et al.
2002/0028287 A1 3/2002 Kawada et al.
2002/0039465 A1 4/2002 Skinner
2002/0189806 A1 12/2002 Davidson et al.
2003/0000741 A1 1/2003 Rosa
2003/0053783 A1 3/2003 Shirasaki
2003/0056990 A1 3/2003 Oglesby
2003/0085040 A1 5/2003 Hemphill et al.
2003/0094281 A1 5/2003 Tubel
2003/0132029 A1 7/2003 Parker
2003/0145991 A1 8/2003 Olsen
2003/0159283 A1 8/2003 White
2003/0160164 A1 8/2003 Jones et al.
2003/0226826 A1 12/2003 Kobayashi et al.
2004/0006429 A1 1/2004 Brown
2004/0016295 A1 1/2004 Skinner et al.
2004/0020643 A1 2/2004 Thomeer et al.
2004/0026127 A1 2/2004 Masui et al.
2004/0026382 A1 2/2004 Richerzhagen
2004/0033017 A1 2/2004 Kringlebotn et al.
2004/0074979 A1 4/2004 McGuire
2004/0093950 A1 5/2004 Bohnert
2004/0104046 A1 * 6/2004 Kelpe ..... 175/26
2004/0112642 A1 6/2004 Krueger et al.
2004/0119471 A1 6/2004 Blanz et al.
2004/0129418 A1 7/2004 Jee et al.
2004/0190374 A1 * 9/2004 Alft et al. ..... 367/14
2004/0195003 A1 10/2004 Batarseh
2004/0206505 A1 10/2004 Batarseh
2004/0207731 A1 10/2004 Bearman et al.
2004/0211894 A1 10/2004 Hother et al.
2004/0218176 A1 11/2004 Shammal et al.
2004/0244970 A1 12/2004 Smith, Jr.
2004/0252748 A1 12/2004 Gleitman
2004/0256103 A1 12/2004 Batarseh
2005/0007583 A1 1/2005 DiFoggio
2005/0012244 A1 1/2005 Jones
2005/0024716 A1 2/2005 Nilsson et al.
2005/0034857 A1 2/2005 Defretin et al.
2005/0094129 A1 5/2005 MacDougall
2005/0099618 A1 5/2005 DiFoggio et al.
2005/0115741 A1 6/2005 Terry et al.
2005/0121235 A1 6/2005 Larsen et al.
2005/0189146 A1 9/2005 Oglesby
2005/0201652 A1 9/2005 Ellwood
2005/0230107 A1 10/2005 McDaniel et al.
2005/0252286 A1 11/2005 Ibrahim et al.
2005/0263281 A1 12/2005 Lovell et al.
2005/0268704 A1 12/2005 Bissonnette et al.
2005/0269132 A1 12/2005 Batarseh et al.
2005/0272512 A1 12/2005 Bissonnette et al.
2005/0272513 A1 12/2005 Bissonnette et al.
2005/0272514 A1 12/2005 Bissonnette et al.
2005/0282645 A1 12/2005 Bissonnette et al.
2006/0005579 A1 1/2006 Jacobsen et al.
2006/0038997 A1 2/2006 Julian et al.
2006/0049345 A1 3/2006 Rao et al.
2006/0065815 A1 3/2006 Jurca
2006/0070770 A1 4/2006 Marsh
2006/0102343 A1 5/2006 Skinner et al.
2006/0118303 A1 6/2006 Schultz et al.
2006/0137875 A1 6/2006 Dusterhoft et al.
2006/0173148 A1 8/2006 Sasaki et al.
2006/0185843 A1 8/2006 Smith, Jr.
2006/0191684 A1 8/2006 Smith, Jr.
2006/0204188 A1 9/2006 Clarkson et al.
2006/0207799 A1 9/2006 Yu
2006/0217688 A1 * 9/2006 Lai ..... 606/4
2006/0231257 A1 10/2006 Reed et al.
2006/0237233 A1 10/2006 Reed et al.
2006/0257150 A1 11/2006 Tsuchiya et al.
2006/0260832 A1 11/2006 McKay
2006/0266522 A1 11/2006 Eoff et al.
2006/0283592 A1 12/2006 Sierra et al.
2006/0289724 A1 12/2006 Skinner et al.
2007/0034409 A1 2/2007 Dale et al.
2007/0081157 A1 4/2007 Csutak et al.
2007/0125163 A1 6/2007 Dria et al.
2007/0193990 A1 8/2007 Richerzhagen et al.
2007/0217736 A1 9/2007 Zhang et al.
2007/0227741 A1 10/2007 Lovell et al.
2007/0242265 A1 10/2007 Vessereau et al.
2007/0247701 A1 10/2007 Akasaka et al.
2007/0267220 A1 11/2007 Magiawala et al.
2007/0278195 A1 12/2007 Richerzhagen et al.
2007/0280615 A1 12/2007 de Montmorillon et al.
2008/0023202 A1 1/2008 Keatch et al.
2008/0053702 A1 3/2008 Smith, Jr.
2008/0073077 A1 3/2008 Tunc et al.
2008/0073121 A1 * 3/2008 Cartwright et al. ..... 175/24
2008/0093125 A1 4/2008 Potter et al.
2008/0112760 A1 5/2008 Curlett
2008/0128123 A1 6/2008 Gold
2008/0138022 A1 6/2008 Tassone
2008/0165356 A1 7/2008 DiFoggio et al.
2008/0166132 A1 7/2008 Lynde et al.
2008/0180787 A1 7/2008 DiGiovanni et al.
2008/0245568 A1 10/2008 Jeffryes
2008/0273852 A1 11/2008 Parker et al.
2009/0020333 A1 1/2009 Marsh
2009/0029842 A1 1/2009 Khrapko et al.
2009/0031870 A1 2/2009 O'Connor
2009/0033176 A1 2/2009 Huang et al.
2009/0049345 A1 2/2009 Mock et al.
2009/0050371 A1 2/2009 Moeny
2009/0078467 A1 3/2009 Castillo
2009/0105955 A1 4/2009 Castillo et al.
2009/0126235 A1 5/2009 Kobayashi et al.
2009/0133871 A1 5/2009 Skinner et al.
2009/0133929 A1 5/2009 Rodland
2009/0139768 A1 6/2009 Castillo
2009/0166042 A1 7/2009 Skinner

(56) References Cited

U.S. PATENT DOCUMENTS

2009/0190887 A1 7/2009 Freeland et al.
2009/0194292 A1 8/2009 Oglesby
2009/0205675 A1 8/2009 Sarkar et al.
2009/0226166 A1* 9/2009 Aronson et al. ..... 398/25
2009/0260834 A1 10/2009 Henson et al.
2009/0266552 A1 10/2009 Barra et al.
2009/0266562 A1 10/2009 Greenaway
2009/0272424 A1 11/2009 Ortabasi
2009/0272547 A1 11/2009 Dale et al.
2009/0279835 A1 11/2009 de Montmorillon et al.
2009/0294050 A1 12/2009 Traggis et al.
2009/0299693 A1* 12/2009 Kane et al. ..... 702/179
2009/0308852 A1 12/2009 Alpay et al.
2009/0324183 A1 12/2009 Bringuier et al.
2010/0000790 A1 1/2010 Moeny
2010/0001179 A1 1/2010 Kobayashi et al.
2010/0008631 A1 1/2010 Herbst
2010/0013663 A1 1/2010 Cavender et al.
2010/0018703 A1 1/2010 Lovell et al.
2010/0025032 A1 2/2010 Smith et al.
2010/0032207 A1 2/2010 Potter et al.
2010/0044102 A1 2/2010 Rinzler
2010/0044103 A1 2/2010 Moxley
2010/0044104 A1 2/2010 Zediker
2010/0044105 A1 2/2010 Faircloth
2010/0044106 A1 2/2010 Zediker
2010/0071794 A1 3/2010 Homan
2010/0078414 A1 4/2010 Perry et al.
2010/0084132 A1 4/2010 Noya et al.
2010/0089571 A1 4/2010 Revellat et al.
2010/0089574 A1 4/2010 Wideman et al.
2010/0089576 A1 4/2010 Wideman et al.
2010/0089577 A1 4/2010 Wideman et al.
2010/0108384 A1* 5/2010 Byreddy et al. ..... 175/27
2010/0111474 A1 5/2010 Satake
2010/0114190 A1 5/2010 Bendett et al.
2010/0155059 A1 6/2010 Ullah
2010/0158457 A1 6/2010 Drozd et al.
2010/0158459 A1 6/2010 Homa
2010/0170672 A1 7/2010 Schwoebel et al.
2010/0170680 A1 7/2010 Mcgregor et al.
2010/0187010 A1 7/2010 Abbasi et al.
2010/0197116 A1 8/2010 Shah et al.
2010/0197119 A1 8/2010 Lai et al.
2010/0215326 A1 8/2010 Zediker
2010/0218993 A1 9/2010 Wideman et al.
2010/0224408 A1 9/2010 Kocis et al.
2010/0226135 A1 9/2010 Chen
2010/0236785 A1 9/2010 Collis et al.
2010/0290781 A1 11/2010 Overton et al.
2010/0314173 A1* 12/2010 Hbaieb et al. ..... 175/57
2010/0326659 A1 12/2010 Schultz et al.
2010/0326665 A1 12/2010 Redlinger et al.
2011/0030957 A1 2/2011 Constantz et al.
2011/0031015 A1* 2/2011 Downton et al. ..... 175/27
2011/0035154 A1 2/2011 Kendall et al.
2011/0048743 A1 3/2011 Stafford et al.
2011/0061869 A1 3/2011 Abass et al.
2011/0079437 A1 4/2011 Hopkins et al.
2011/0122644 A1 5/2011 Okuno
2011/0127028 A1 6/2011 Strickland
2011/0139450 A1 6/2011 Vasques et al.
2011/0147013 A1 6/2011 Kilgore
2011/0162854 A1 7/2011 Bailey et al.
2011/0168443 A1 7/2011 Smolka
2011/0170563 A1 7/2011 Heebner et al.
2011/0174537 A1 7/2011 Potter et al.
2011/0186298 A1 8/2011 Clark et al.
2011/0198075 A1 8/2011 Okada et al.
2011/0205652 A1 8/2011 Abbasi et al.
2011/0220409 A1 9/2011 Foppe
2011/0240314 A1 10/2011 Greenaway
2011/0266062 A1 11/2011 Shuman, V et al.
2011/0278070 A1 11/2011 Hopkins et al.
2011/0278270 A1* 11/2011 Braga et al. ..... 219/121.71
2011/0290563 A1 12/2011 Kocis et al.
2011/0303460 A1 12/2011 Von Rohr et al.
2012/0000646 A1 1/2012 Liotta et al.
2012/0012392 A1 1/2012 Kumar
2012/0012393 A1 1/2012 Kumar
2012/0020631 A1 1/2012 Rinzler
2012/0048550 A1 3/2012 Dusterhoft et al.
2012/0048568 A1 3/2012 Li et al.
2012/0061091 A1 3/2012 Radi
2012/0067643 A1 3/2012 DeWitt
2012/0068086 A1 3/2012 DeWitt
2012/0068523 A1 3/2012 Bowles
2012/0074110 A1 3/2012 Zediker
2012/0103693 A1 5/2012 Jeffryes
2012/0111578 A1 5/2012 Tverlid
2012/0118568 A1 5/2012 Kleefisch et al.
2012/0118578 A1 5/2012 Skinner
2012/0189258 A1 7/2012 Overton et al.
2012/0217015 A1 8/2012 Zediker
2012/0217017 A1 8/2012 Zediker
2012/0217018 A1 8/2012 Zediker
2012/0217019 A1 8/2012 Zediker
2012/0239013 A1 9/2012 Islam
2012/0248078 A1 10/2012 Zediker et al.
2012/0255774 A1 10/2012 Grubb
2012/0255933 A1 10/2012 McKay
2012/0261188 A1 10/2012 Zediker
2012/0266803 A1 10/2012 Zediker
2012/0267168 A1 10/2012 Grubb
2012/0273269 A1 11/2012 Rinzler
2012/0273470 A1 11/2012 Zediker
2012/0275159 A1 11/2012 Fraze
2013/0011102 A1 1/2013 Rinzler
2013/0032402 A1* 2/2013 Byreddy et al. ..... 175/27
2013/0175090 A1 7/2013 Zediker
2013/0186687 A1* 7/2013 Snyder ..... 175/40
2013/0192893 A1 8/2013 Zediker
2013/0192894 A1 8/2013 Zediker
2013/0220626 A1 8/2013 Zediker
2013/0228372 A1 9/2013 Linyaev
2013/0228557 A1 9/2013 Zediker
2013/0266031 A1 10/2013 Norton
2013/0308936 A1* 11/2013 Aronson et al. ..... 398/25
2013/0319984 A1 12/2013 Linyaev
2014/0000902 A1 1/2014 Wolfe
2014/0060802 A1 3/2014 Zediker
2014/0060930 A1 3/2014 Zediker
2014/0069896 A1 3/2014 Deutch
2014/0090846 A1 4/2014 Deutch
2014/0190949 A1 7/2014 Zediker
2014/0231085 A1 8/2014 Zediker
2014/0231398 A1 8/2014 Land
2014/0248025 A1 9/2014 Rinzler
2014/0345872 A1 11/2014 Zediker

FOREIGN PATENT DOCUMENTS

EP 0 565 287 A1 10/1993
EP 0 950 170 B1 9/2002
FR 2 716 924 A1 9/1995
GB 1 284 454 8/1972
GB 2420358 B 5/2006
JP 1987-011804 1/1987
JP 1993-118185 5/1993
JP 1993-33574 9/1993
JP 09072738 A 3/1997
JP 09-242453 A 9/1997
JP 2000-334590 A 12/2000
JP 2001-208924 8/2001
JP 2003-239673 8/2003
JP 2004-108132 4/2004
JP 2004-108132 A 4/2004
JP 2006-039147 2/2006
JP 2006-509253 3/2006
JP 2006-307481 A 11/2006
JP 2007-120048 A 5/2007
JP 2008-242012 10/2008
WO WO 95/32834 A1 12/1995
WO WO 97/49893 A1 12/1997

(56) References Cited

FOREIGN PATENT DOCUMENTS

| | | | | |
|---|---|---|---|---|
| WO | WO 98/50673 | A1 | 11/1998 | |
| WO | WO 98/56534 | A1 | 12/1998 | |
| WO | WO 02/057805 | A2 | 7/2002 | |
| WO | WO 03/027433 | A1 | 4/2003 | |
| WO | WO 03/060286 | A1 | 7/2003 | |
| WO | WO 2004/009958 | A1 | 1/2004 | |
| WO | WO2004/052078 | | 6/2004 | |
| WO | WO 2004/094786 | A1 | 11/2004 | |
| WO | WO 2005/001232 | A2 | 1/2005 | |
| WO | WO 2005/001239 | A1 | 1/2005 | |
| WO | WO 2006/008155 | A1 | 1/2006 | |
| WO | WO 2006/041565 | A1 | 4/2006 | |
| WO | WO 2006/054079 | A1 | 5/2006 | |
| WO | WO 2007/002064 | A1 | 1/2007 | |
| WO | WO 2007/112387 | A2 | 10/2007 | |
| WO | WO 2007/136485 | A2 | 11/2007 | |
| WO | WO 2008/016852 | A1 | 2/2008 | |
| WO | WO 2008/070509 | A2 | 6/2008 | |
| WO | WO 2008/085675 | A1 | 7/2008 | |
| WO | WO 2009/042774 | A2 | 4/2009 | |
| WO | WO 2009/042781 | A2 | 4/2009 | |
| WO | WO 2009/042785 | A2 | 4/2009 | |
| WO | WO 2009/131584 | A1 | 10/2009 | |
| WO | WO 2010/036318 | A1 | 4/2010 | |
| WO | WO 2010/060177 | A1 | 6/2010 | |
| WO | WO 2010060177 | A1 * | 6/2010 | ..... E21B 7/14 |
| WO | WO 2010/087944 | A1 | 8/2010 | |
| WO | WO 2011/008544 | A2 | 1/2011 | |
| WO | WO 2011/032083 | A1 | 3/2011 | |
| WO | WO 2011/041390 | A2 | 4/2011 | |
| WO | WO 2011/075247 | A2 | 6/2011 | |
| WO | WO 2011/106078 | A2 | 9/2011 | |
| WO | WO 2012/003146 | A2 | 1/2012 | |
| WO | WO 2012/012006 | A1 | 1/2012 | |
| WO | WO 2012/027699 | A1 | 3/2012 | |
| WO | WO 2012/064356 | A1 | 5/2012 | |
| WO | WO 2012/116189 | A2 | 8/2012 | |

OTHER PUBLICATIONS

U.S. Appl. No. 12/544,094, filed Aug. 19, 2009, Faircloth et al.
U.S. Appl. No. 12/543,968, filed Aug. 19, 2009, Rinzler et al.
U.S. Appl. No. 12/544,136, filed Aug. 19, 2009, Zediker et al.
U.S. Appl. No. 12/544,038, filed Aug. 19, 2009, Zediker et al.
U.S. Appl. No. 12/706,576, filed Feb. 16, 2010, Zediker et al.
U.S. Appl. No. 12/840,978, filed Jul. 21, 2010, Rinzler et al.
U.S. Appl. No. 12/896,021, filed Oct. 1, 2010, Underwood et al.
U.S. Appl. No. 13/034,017, filed Feb. 24, 2011, Zediker et al.
U.S. Appl. No. 13/034,037, filed Feb. 24, 2011, Zediker et al.
U.S. Appl. No. 13/034,175, filed Feb. 24, 2011, Zediker et al.
U.S. Appl. No. 13/034,183, filed Feb. 24, 2011, Zediker et al.
U.S. Appl. No. 13/210,581, filed Aug. 16, 2011, DeWitt et al.
U.S. Appl. No. 13/211,729, filed Aug. 17, 2011, DeWitt et al.
U.S. Appl. No. 13/222,931, filed Aug. 31, 2011, Zediker et al.
U.S. Appl. No. 13/347,445, filed Jan. 10, 2012, Zediker et al.
U.S. Appl. No. 13/403,132, filed Feb. 2, 2012, Zediker et al.
U.S. Appl. No. 13/403,287, filed Feb. 23, 2012, Grubb et al.
U.S. Appl. No. 13/403,615, filed Feb. 23, 2012, Grubb et al.
U.S. Appl. No. 13/366,882, filed Feb. 6, 2012, McKay et al.
U.S. Appl. No. 13/403,723, filed Feb. 23, 2012, Rinzler et al.
U.S. Appl. No. 13/403,509, filed Feb. 23, 2012, Fraze et al.
U.S. Appl. No. 13/403,741, filed Feb. 23, 2012, Zediker et al.
U.S. Appl. No. 13/486,795, filed Feb. 23, 2012, Rinzler et al.
U.S. Appl. No. 13/565,345, filed Feb. 23, 2012, Zediker et al.
U.S. Appl. No. 13/768,149, filed Feb. 15, 2013, Zediker et al.
U.S. Appl. No. 13/777,650, filed Feb. 26, 2013, Zediker et al.
U.S. Appl. No. 13/782,869, filed Mar. 1, 2013, Schroit et al.
U.S. Appl. No. 13/782,942, filed Mar. 1, 2013, Norton et al.
U.S. Appl. No. 13/800,559, filed Mar. 13, 2013, Zediker et al.
U.S. Appl. No. 13/800,820, filed Mar. 13, 2013, Zediker et al.
U.S. Appl. No. 13/800,879, filed Mar. 13, 2013, Zediker et al.
U.S. Appl. No. 13/800,933, filed Mar. 13, 2013, Zediker et al.
U.S. Appl. No. 13/849,831, filed Mar. 25, 2013, Zediker et al.
International Search Report and Written Opinion for PCT App. No. PCT/US10/24368, dated Nov. 2, 2010, 16 pgs.
International Search Report for PCT Application No. PCT/US09/54295, dated Apr. 26, 2010, 16 pgs.
International Search Report for PCT Application No. PCT/US2011/044548, dated Jan. 24, 2012, 17 pgs.
International Search Report for PCT Application No. PCT/US2011/047902, dated Jan. 17, 2012, 9 pgs.
International Search Report for PCT Application No. PCT/US2011/050044 dated Feb. 1, 2012, 26 pgs.
International Search Report for PCT Application No. PCT/US2012/026277, dated May 30, 2012, 11 pgs.
International Search Report for PCT Application No. PCT/US2012/026265, dated May 30, 2012, 14 pgs.
International Search Report for PCT Application No. PCT/US2012/026280, dated May 30, 2012, 12 pgs.
International Search Report for PCT Application No. PCT/US2012/026337, dated Jun. 7, 2012, 21 pgs.
International Search Report for PCT Application No. PCT/US2012/026471, dated May 30, 2012, 13 pgs.
International Search Report for PCT Application No. PCT/US2012/026525, dated May 31, 2012, 8 pgs.
International Search Report for PCT Application No. PCT/US2012/026526, dated May 31, 2012, 10 pgs.
International Search Report for PCT Application No. PCT/US2012/026494, dated May 31, 2012, 12 pgs.
International Search Report for PCT Application No. PCT/US2012/020789, dated Jun. 29, 2012, 9 pgs.
International Search Report for PCT Application No. PCT/US2012/040490, dated Oct. 22, 2012, 14 pgs.
International Search Report for PCT Application No. PCT/US2012/049338, dated Jan. 22, 2013, 14 pgs.
Abdulagatova, Z. et al., "Effect of Temperature and Pressure on the Thermal Conductivity of Sandstone", *International Journal of Rock Mechanics & Mining Sciences*, vol. 46, 2009, pp. 1055-1071.
Abousleiman, Y. et al., "Poroelastic Solution of an Inclined Borehole in a Transversely Isotropic Medium", *Rock Mechanics*, Daemen & Schultz (eds), 1995, pp. 313-318.
Ackay, H. et al., Paper titled "Orthonormal Basis Functions for Continuous-Time Systems and Lp Convergence", date unknown but prior to Aug. 19, 2009, pp. 1-12.
Acosta, A. et al., paper from X Brazilian MRS meeting titled "Drilling Granite With Laser Light", X Encontro da SBPMat Granado-RS, Sep. 2011, 4 pages including pp. 56 and 59.
Agrawal Dinesh et al., "Microstructural by TEM of WC/Co composites Prepared by Conventional and Microwave Processes", Materials Research Lab, The Pennsylvania State University, *15th International Plansee Seminar*, vol. 2, 2001, pp. 677-684.
Agrawal Dinesh et al., Report on "Development of Advanced Drill Components for BHA Using Mircowave Technology Incorporating Carbide Diamond Composites and Functionally Graded Materials", Microwave Processing and Engineering Center, Material Research Institute, The Pennsylvania State University, 2003, 10 pgs.
Agrawal Dinesh et al., Report on "Graded Steele-Tungsten Cardide/Cobalt-Diamond Systems Using Microwave Heating", Material Research Institute, Penn State University, *Proceedings of the 2002 International Conference on Functionally Graded Materials*, 2002, pp. 50-58.
Agrawal, Govind P., "Nonlinear Fiber Optics", Chap. 9, Fourth Edition, Academic Press copyright 2007, pp. 334-337.
Ahmadi, M. et al., "The Effect of Interaction Time and Saturation of Rock on Specific Energy in ND:YAG Laser Perforating", *Optics and Laser Technology*, vol. 43, 2011, pp. 226-231.
Ai, H.A. et al., "Simulation of dynamic response of granite: A numerical approach of shock-induced damage beneath impact craters", *International Journal of Impact Engineering*, vol. 33, 2006, pp. 1-10.
Akhatov, I. et al., "Collapse and Rebound of a Laser-Induced Cavitation Bubble", *Physics of Fluids*, vol. 13, No. 10, Oct. 2001, pp. 2805-2819.
Albertson, M. L. et al., "Diffusion of Submerged Jets", a paper for the *American Society of Civil Engineers*, Nov. 5, 1852, pp. 1571-1596.

(56) References Cited

OTHER PUBLICATIONS

Al-Harthi, A. A. et al., "The Porosity and Engineering Properties of Vesicular Basalt in Saudi Arabia", *Engineering Geology*, vol. 54, 1999, pp. 313-320.
Anand, U. et al., "Prevention of Nozzle Wear in Abrasive Water Suspension Jets (AWSJ) Using PoroLubricated Nozzles", *Transactions of the ASME*, vol. 125, Jan. 2003, pp. 168-181.
Andersson, J. C. et al., "The Aspo Pillar Stability Experiment: Part II—Rock Mass Response to Coupled Excavation-Induced and Thermal-Induced Stresses", *International Journal of Rock Mechanics & Mining Sciences*, vol. 46, 2009, pp. 879-895.
Anovitz, L. M. et al., "A New Approach to Quantification of Metamorphism Using Ultra-Small and Small Angle Neutron Scattering", *Geochimica et Cosmochimica Acta*, vol. 73, 2009, pp. 7303-7324.
Anton, Richard J. et al., "Dynamic Vickers indentation of brittle materials", *Wear*, vol. 239, 2000, pp. 27-35.
Antonucci, V. et al., "Numerical and Experimental Study of a Concentrated Indentation Force on Polymer Matrix Composites", an excerpt from the *Proceedings of the COMSOL Conference*, 2009, 4 pages.
Aptukov, V. N., "Two Stages of Spallation", publisher unknown, while the date of the publication is unknown, it is believed to be prior to Aug. 19, 2009, 6 pages.
Ashby, M. F. et al., "The Failure of Brittle Solids Containing Small Cracks Under Compressive Stress States", *Acta Metall.*, vol. 34, No. 3,1986, pp. 497-510.
ASTM International, "Standard Test Method for Thermal Conductivity of Solids by Means of the Guarded-Comparative-Longitudinal Heat Flow Technique", Standard under the fixed Designation E1225-09, 2009, pp. 1-9.
Atkinson, B. K., "Introduction to Fracture Mechanics and Its Geophysical Applications", *Fracture Mechanics of Rock*, 1987, pp. 1-26.
Aubertin, M. et al., "A Multiaxial Stress Criterion for Short- and Long-Term Strength of Isotropic Rock Media", *International Journal of Rock Mechanics & Mining Sciences*, vol. 37, 2000, pp. 1169-1193.
Author unknown, by RIO Technical Services, "Sub-Task 1: Current Capabilities of Hydraulic Motors, Air/Nitrogen Motors, and Electric Downhole Motors", a final report for Department of Energy National Petroleum Technology Office for the Contract Task 03NT30429, Jan. 30, 2004, 26 pages.
Aver, B. B. et al., "Porosity Dependence of the Elastic Modulof Lithophysae-rich Tuff: Numerical and Experimental Investigations", *International Journal of Rock Mechanics & Mining Sciences*, vol. 40, 2003, pp. 919-928.
Aydin, A. et al., "The Schmidt hammer in rock material characterization", *Engineering Geology*, vol. 81, 2005, pp. 1-14.
Backers, T. et al., "Tensile Fracture Propagation and Acoustic Emission Activity in Sandstone: The Effect of Loading Rate", *International Journal of Rock Mechanics & Mining Sciences*, vol. 42, 2005, pp. 1094-1101.
Baek, S. Y. et al., "Simulation of the Coupled Thermal/Optical Effects for Liquid Immersion Micro-/Nanolithography", source unknown, believed to be publically available prior to 2012,13 pages.
Baflon, Jean-Paul et al., "On the Relationship Between the Parameters of Paris' Law for Fatigue Crack Growth in Aluminium Alloys", *Scripta Metallurgica*, vol. 11, No. 12, 1977, pp. 1101-1106.
Bagatur, T. et al., "Air-entrainment Characteristics in a Plunging Water Jet System Using Rectangular Nozzles with Rounded Ends", *Water SA*, vol. 29, No. 1, Jan. 2003, pp. 35-38.
Bailo, El Tahir et al., "Spectral signatures and optic coefficients of surface and reservoir shales and limestones at COIL, $CO_2$ and Nd:YAG laser wavelengths", *Petroleum Engineering Department, Colorado School of Mines*, 2004, 13 pgs.
Baird, J. A. "GEODYN: A Geological Formation/Drillstring Dynamics Computer Program", *Society of Petroleum Engineers of AIME*, 1964, 9 pgs.
Baird, J. A. et al., "Analyzing the Dynamic Behavior of Downhole Equipment During Drilling", government Sandia Report, SAND-84-0758C, DE84 008840, 7 pages, Jul. 2010.
Baird, Jerold et al., Phase 1 Theoretical Description, A Geological Formation Drill String Dynamic Interaction Finite Element Program (GEODYN), *Sandia National Laboratories*, Report No. Sand-84/7101, 1984, 196 pgs.
Batarseh, S. I. et al, "Innovation in Wellbore Perforation Using High-Power Laser", *International Petroleum Technology Conference*, IPTC No. 10981, Nov. 2005, 7 pages.
Batarseh, S. et al. "Well Perforation Using High-Power Lasers", *Society of Petroleum Engineers*, SPE 84418, 2003, pp. 1-10.
Batarseh, S. et al., "Well Perforation Using High-Power Lasers", a paper prepared for presentation at the SPE (Society of Petroleum Engineers) Annual Technical Conference and Exhibition, SPE No. 84418, Oct. 2003, 10 pages.
Baykasoglu, A. et al., "Prediction of Compressive and Tensile Strength of Limestone via Genetic Programming", *Expert Systems with Applications*, vol. 35, 2008, pp. 111-123.
BDM Corporation, Geothermal Completion Technology Life-Cycle Cost Model (GEOCOM), *Sandia National Laboratories*, for the U.S. Dept. of Energy, vols. 1 and 2, 1982, 222 pgs.
Bechtel SAIC Company LLC, "Heat Capacity Analysis", a report prepared for Department of Energy, Nov. 2004, 100 pages.
Belushi, F. et al., "Demonstration of the Power of Inter-Disciplinary Integration to Beat Field Development Challenges in Complex Brown Field-South Oman", *Society of Petroleum Engineers*, a paper prepared for presentation at the Abu Dhabi International Petroleum Exhibition & Conference, SPE No. 137154, Nov. 2010, 18 pages.
Belyaev, V. V., "Spall Damage Modelling and Dynamic Fracture Specificities of Ceramics", *Journal of Materials Processing Technology*, vol. 32, 1992, pp. 135-144.
Benavente, D. et al., "The Combined Influence of Mineralogical, Hygric and Thermal Properties on the Durability of PoroBuilding Stones", *Eur. J. Mineral*, vol. 20, Aug. 2008, pp. 673-685.
Beste, U. et al., "Micro-scratch evaluation of rock types—a means to comprehend rock drill wear", *Tribology International*, vol. 37, 2004, pp. 203-210.
Bieniawski, Z. T., "Mechanism of Brittle Fracture of Rock: Part I—Theory of the Fracture Process", *Int. J. Rock Mech. Min. Sci.*, vol. 4, 1967, pp. 395-406.
Bilotsky, Y. et al., "Modelling Multilayers Systems with Time-Depended Heaviside and New Transition Functions", excerpt from the Proceedings of the 2006 Nordic COMSOL Conference, 2006, 4 pages.
Birkholzer, J. T. et al., "The Impact of Fracture—Matrix Interaction on Thermal—Hydrological Conditions in Heated Fractured Rock", an origial research paper published online http://vzy.scijournals.org/cgi/content/full/5/2/657, May 26, 2006, 27 pages.
Blackwell, B. F., "Temperature Profile in Semi-infinite Body With Exponential Source and Convective Boundary Condition", *Journal of Heat Transfer, Transactions of the ASME*, vol. 112, 1990, pp. 567-571.
Blackwell, D. D. et al., "Geothermal Resources in Sedimentary Basins", a presentation for the Geothermal Energy Generation in Oil and Gas Settings, Mar. 13, 2006, 28 pages.
Blair, S. C. et al., "Analysis of Compressive Fracture in Rock Using Statistical Techniques: Part I. A Non-linear Rule-based Model", *Int. J. Rock Mech. Min. Sci.*, vol. 35 No. 7, 1998, pp. 837-848.
Blomqvist, M. et al., "All-in-Quartz Optics for Low Focal Shifts", *SPIE Photonics West Conference in San Francisco*, Jan. 2011, 12 pages.
Boechat, A. A. P. et al., "Bend Loss in Large Core Multimode Optical Fiber Beam Delivery Systems", *Applied Optics.*, vol. 30 No. 3, Jan. 20, 1991, pp. 321-327.
Bolme, C. A., "Ultrafast Dynamic Ellipsometry of Laser Driven Shock Waves", a dissertation for the degree of Doctor of Philosophy in Physical Chemistry at Massachusetts Institute of Technology, Sep. 2008, pp. 1-229.
Britz, Dieter, "Digital Simulation in Electrochemistry", *Lect. Notes Phys.*, vol. 666, 2005, pp. 103-117.
Brown, G., "Development, Testing and Track Record of Fiber-Optic, Wet-Mate, Connectors", *IEEE*, 2003, pp. 83-88.

(56) References Cited

OTHER PUBLICATIONS

Browning, J. A. et al., "Recent Advances in Flame Jet Working of Minerals", *7th Symposium on Rock Mechanics*, Pennsylvania State Univ., 1965, pp. 281-313.
Brujan, E. A. et al., "Dynamics of Laser-Induced Cavitation Bubbles Near an Elastic Boundar", *J. Fluid Mech.*, vol. 433, 2001, pp. 251-281.
Burdine, N. T., "Rock Failure Under Dynamic Loading Conditions", Society of Petroleum Engineers Journal, Mar. 1963, pp. 1-8.
Bybee, K., "Modeling Laser-Spallation Rock Drilling", *JPT*, an SPE available at www.spe.org/jpt, Feb. 2006, 2 pages 62-63.
Bybee, Karen, highlight of "Drilling a Hole in Granite Submerged in Water by Use of CO2 Laser", an SPE available at www.spe.org/jpt, *JPT*, Feb. 2010, pp. 48, 50 and 51.
Cai, W. et al., "Strength of Glass from Hertzian Line Contact", *Optomechanics 2011: Innovations and Solutions*, 2011, 5 pages.
Capetta, I. S. et al., "Fatigue Damage Evaluation on Mechanical Components Under Multiaxial Loadings", European Comsol Conference, University of Ferrara, Oct. 16, 2009, 25 pages.
Cardenas, R., "Protected Polycrystalline Diamond Compact Bits for Hard Rock Drilling", Report No. DOE-99049-1381, *U.S. Department of Energy*, 2000, pp. 1-79.
Carstens, J. P. et al., "Rock Cutting by Laser", a paper of *Society of Petroleum Engineers of AIME*, 1971, 11 pages.
Carstens, Jeffrey et al., "Heat-Assisted Tunnel Boring Machines", *Federal Railroad Administration and Urban Mass Transportation Administration*, U.S. Dept. of Transportation, Report No. FRA-RT-71-63, 1970, 340 pgs.
Caruso, C. et al., "Dynamic Crack Propagation in Fiber Reinforced Composites", Excerpt from the Proceedings of the COMSOL Conference, 2009, 5 pages.
Chastain, T. et al., "Deepwater Drilling Riser System", *SPE Drilling Engineering*, Aug. 1986, pp. 325-328.
Chen, H. Y. et al., "Characterization of the Austin Chalk Producing Trend", *SPE*, a paper prepared for presentation at the 61st Annual Technical Conference and Exhibition of the Society of Petroleum Engineers, SPE No. 15533, Oct. 1986, pp. 1-12.
Chen, K., paper titled "Analysis of Oil Film Interferometry Implementation in Non-Ideal Conditions", source unknown, Jan. 7, 2010, pp. 1-18.
Chraplyvy, A. R., "Limitations on Lightwave Communications Imposed by Optical-Fiber Nonlinearities", *Journal of Lightwave Technology*, vol. 8 No. 10, Oct. 1990, pp. 1548-1557.
Churcher, P. L. et al., "Rock Properties of Berea Sandstone, Baker Dolomite, and Indiana Limestone", a paper prepared for presentation at the SPE International Symposium on Oilfield Chemistry), *SPE*, SPE No. 21044, Feb. 1991, pp. 431-446 and 3 additional pages.
Cimetiere, A. et al., "A Damage Model for Concrete Beams in Compression", *Mechanics Research Communications*, vol. 34, 2007, pp. 91-96.
Clegg, John et al., "Improved Optimisation of Bit Selection Using Mathematically Modelled Bit-Performance Indices", *IADC/SPE International 102287*, 2006, pp. 1-10.
Close, F. et al., "Successful Drilling of Basalt in a West of Shetland Deepwater Discovery", a paper prepared for presentation at Offshore Europe 2005 by SPE (Society of Petroleum Engineers) Program Committee, SPE No. 96575, Sep. 2005, pp. 1-10.
Close, F. et al., "Successful Drilling of Basalt in a West of Shetland Deepwater Discovery", *SPE International 96575*, Society of Petroleum Engineers, 2006, pp. 1-10.
Cobern, Martin E., "Downhole Vibration Monitoring & Control System Quarterly Technical Report #1", *APS Technology, Inc.*, Quarterly Technical Report #1, DVMCS, 2003, pp. 1-15.
Cogotsi, G. A. et al., "Use of Nondestructive Testing Methods in Evaluation of Thermal Damage for Ceramics Under Conditions of Nonstationary Thermal Effects", *Institute of Strength Problems, Academy of Sciences of the Ukrainian SSR*, 1985, pp. 52-56.
Cohen, J. H., "High-Power Slim-Hole Drilling System", a paper presented at the conference entitled Natural Gas RD&D Contractors Review Meeting, Office of Scientific and Technical Information, Apr. 1995, 10 pages.
Cone, C., "Case History of the University Block 9 (Wolfcamp) Field—Gas-Water Injection Secondary Recovery Project", *Journal of Petroleum Technology*, Dec. 1970, pp. 1485-1491.
Contreras, E. et al., "Effects of Temperature and Stress on the Compressibilities, Thermal Expansivities, and Porosities of Cerro Prieto and Berea Sandstones to 9000 PSI and 208 degrees Celsius", Proceedings Eighth Workshop Geothermal Reservoir Engineering, Leland Stanford Junior University, Dec. 1982, pp. 197-203.
Cook, Troy, "Chapter 23, Calculation of Estimated Ultimate Recovery (EUR) for Wells in Continuous-Type Oil and Gas Accumulations", *U.S. Geological Survey Digital Data Series DDS-69-D*, Denver, Colorado: Version 1, 2005, pp. 1-9.
Cooper, R., "Coiled Tubing Deployed ESPs Utilizing Internally Installed Power Cable—A Project Update", a paper prepared by SPE (Society of Petroleum Engineers) Program Committee for presentation at the 2nd North American Coiled Tubing Roundtable, SPE 38406, Apr. 1997, pp. 1-6.
Coray, P. S. et al., "Measurements on 5:1 Scale Abrasive Water Jet Cutting Head Models", source unknown, available prior to 2012, 15 pages.
Cruden, D. M., "The Static Fatigue of Brittle Rock Under Uniaxial Compression", *Int. J. Rock Mech. Min. Sci. & Geomech. Abstr.*, vol. 11, 1974, pp. 67-73.
da Silva, B. M. G., "Modeling of Crack Initiation, Propagation and Coalescence in Rocks", a thesis for the degree of Master of Science in Civil and Environmental Engineering at the Massachusetts Institute of Technology, Sep. 2009, pp. 1-356.
Dahl, F. et al., "Development of a New Direct Test Method for Estimating Cutter Life, Based on the Sievers' J Miniature Drill Test", *Tunnelling and Underground Space Technology*, vol. 22, 2007, pp. 106-116.
Dahl, Filip et al., "Development of a new direct test method for estimating cutter life, based on the Sievers J miniature drill test", *Tunnelling and Underground Space Technology*, vol. 22, 2007, pp. 106-116.
Damzen, M. J. et al., "Stimulated Brillion Scattering", Chapter 8—SBS in Optical Fibres, OP Publishing Ltd, Published by Institute of Physics, London, England, 2003, pp. 137-153.
Das, A. C. et al., "Acousto-ultrasonic study of thermal shock damage in castable refractory", *Journal of Materials Science Letters*, vol. 10, 1991, pp. 173-175.
de Castro Lima, J. J. et al., "Linear Thermal Expansion of Granitic Rocks: Influence of Apparent Porosity, Grain Size and Quartz Content", *Bull Eng Geol Env.*, 2004, vol. 63, pp. 215-220.
De Guire, Mark R., "Thermal Expansion Coefficient (start)", *EMSE 201—Introduction to Materials Science & Engineering*, 2003, pp. 15.1-15.15.
Degallaix, J. et al., "Simulation of Bulk-Absorption Thermal Lensing in Transmissive Optics of Gravitational Waves Detector", *Appl. Phys.*, B77, 2003, pp. 409-414.
Dey, T. N. et al., "Some Mechanisms of Microcrack Growth and Interaction in Compressive Rock Failure", *Int. J. Rock Mech. Min. Sci. & Geomech. Abstr.*, vol. 18, 1981, pp. 199-209.
Diamond-Cutter Drill Bits, by Geothermal Energy Program, Office of Geothermal and Wind Technologies, 2000, 2 pgs.
Dimotakis, P. E. et al., "Flow Structure and Optical Beam Propagation in High-Reynolds-Number Gas-Phase Shear Layers and Jets", *J. Fluid Mech.*, vol. 433, 2001, pp. 105-134.
Dinçer, Ismail et al., "Correlation between Schmidt hardness, uniaxial compressive strength and Young's modulfor andesites, basalts and tuffs", *Bull Eng Geol Env*, vol. 63, 2004, pp. 141-148.
Dole, L. et al., "Cost-Effective CementitioMaterial Compatible with Yucca Mountain Repository Geochemistry", a paper prepared by Oak Ridge National Laboratory for the Department of Energy, No. ORNL/TM-2004/296, Dec. 2004, 128 pages.
Dumans, C. F. F. et al., "PDC Bit Selection Method Through the Analysis of Past Bit Performances", a paper prepared for presentation at the *SPE* (Society of Petroleum Engineers—Latin American Petroleum Engineering Conference), Oct. 1990, pp. 1-6.

(56) References Cited

OTHER PUBLICATIONS

Dunn, James C., "Geothermal Technology Development at Sandia", *Geothermal Research Division, Sandia National Laboratories*, 1987, pp. 1-6.
Dutton, S. P. et al., "Evolution of Porosity and Permeability in the Lower CretaceoTravis Peak Formation, East Texas", *The American Association of Petroleum Geologists Bulletin*, vol. 76, No. 2, Feb. 1992, pp. 252-269.
Dyskin, A. V. et al., "Asymptotic Analysis of Crack Interaction with Free Boundary", *International Journal of Solids and Structure*, vol. 37, 2000, pp. 857-886.
Eckel, J. R. et al., "Nozzle Design and its Effect on Drilling Rate and Pump Operation", a paper presented at the spring meeting of the Southwestern District, Division of Production, Beaumont, Texas, Mar. 1951, pp. 28-46.
Ehrenberg, S. N. et al., "Porosity-Permeability Relationship in Interlayered Limestone-Dolostone Reservoir", *The American Association of Petroleum Geologists Bulletin*, vol. 90, No. 1, Jan. 2006, pp. 91-114.
Eichler, H.J. et al., "Stimulated Brillouin Scattering in Multimode Fibers for Optical Phase Conjugation", *Optics Communications*, vol. 208, 2002, pp. 427-431.
Eighmy, T. T. et al., "Microfracture Surface Charaterizations: Implications for In Situ Remedial Methods in Fractured Rock", *Bedrock Bioremediation Center, Final Report, National Risk Management Research Laboratory, Office of Research and Development, U.S. Environmental Protection Agency*, EPA/600/R-05/121, 2006, pp. 1-99.
Elsayed, M.A. et al., "Measurement and analysis of Chatter in a Compliant Model of a Drillstring Equipped With a PDC Bit", *Mechanical Engineering Dept., University of Southwestern Louisiana* and *Sandia National Laboratories*, 2000, pp. 1-10.
Ersoy, A., "Wear Characteristics of PDC Pin and Hybrid Core Bits in Rock Drilling", *Wear*, vol. 188, 1995, pp. 150-165.
Extreme Coil Drilling, by Extreme Drilling Corporation, 2009, 10 pgs.
Falcao, J. L. et al., "PDC Bit Selection Through Cost Prediction Estimates Using Crossplots and Sonic Log Data", *SPE*, a paper prepared for presentation at the 1993 SPE/IADC Drilling Conference, Feb. 1993, pp. 525-535.
Falconer, I. G. et al., "Separating Bit and Lithology Effects from Drilling Mechanics Data", *SPE*, a paper prepared for presentation at the 1988 IADC/SPE Drilling Conference, Feb./Mar. 1988, pp. 123-136.
Farra, G., "Experimental Observations of Rock Failure Due to Laser Radiation", a thesis for the degree of Master of Science at Massachusetts Institute of Technology, Jan. 1969, 128 pages.
Farrow, R. L. et al., "Peak-Power Limits on Fiber Amplifiers Imposed by Self-Focusing", *Optics Letters*, vol. 31, No. 23, Dec. 1, 2006, pp. 3423-3425.
Ferro, D. et al., "Vickers and Knoop hardness of electron beam deposited ZrC and HfC thin films on titanium", *Surface & Coatings Technology*, vol. 200, 2006, pp. 4701-4707.
Fertl, W. H. et al., "Spectral Gamma-Ray Logging in the Texas Austin Chalk Trend", *SPE of AIME*, a paper for Journal of Petroleum Technology, Mar. 1980, pp. 481-488.
Field, F. A., "A Simple Crack-Extension Criterion for Time-Dependent Spallation", *J. Mech. Phys. Solids*, vol. 19, 1971, pp. 61-70.
Figueroa, H. et al., "Rock removal using high power lasers for petroleum exploitation purposes", *Gas Technology Institute, Colorado School of Mines, Halliburton Energy Services, Argonne National Laboratory*, 2002, pp. 1-13.
Finger, J. T. et al., "PDC Bit Research at Sandia National Laboratories", Sandia Report No. SAND89-0079-UC-253, a report prepared for Department of Energy, Jun. 1989, 88 pages.
Finger, John T. et al., "PDC Bit Research at Sandia National Laboratories", Sandia Report, *Geothermal Research Division 6252, Sandia National Laboratories*, SAND89-0079—UC-253, 1989, pp. 1-88.
Freeman, T. T. et al., "THM Modeling for Reservoir Geomechanical Applications", presented at the COMSOL Conference, Oct. 2008, 22 pages.
Friant, J. E. et al., "Disc Cutter Technology Applied to Drill Bits", a paper prepared by Exacavation Engineering Associates, Inc. for the Department of Energy's Natural Gas Conference, Mar. 1997, pp. 1-16.
Fuerschbach, P. W. et al., "Understanding Metal Vaporization from Laser Welding", Sandia Report No. SAND-2003-3490, a report prepared for DOE, Sep. 2003, pp. 1-70.
Gahan, B. C. et al., "Analysis of Efficient High-Power Fiber Lasers for Well Perforation", *SPE*, No. 90661, a paper prepared for presentation at the SPE Annual Technical Conference and Exhibition, Sep. 2004, 9 pages.
Gahan, B. C. et al., "Effect of Downhole Pressure Conditions on High-Power Laser Perforation", *SPE*, No. 97093, a paper prepared for the 2005 SPE (Society of Petroleum Engineers) Annual Technical Conference and Exhibition, Oct. 12, 2005, 7 pages.
Gahan, B. C. et al., "Laser Drilling: Drilling with the Power of Light, Phase 1: Feasibility Study", a Topical Report by the *Gas Technology Institute*, for the Government under Cooperative Agreement No. DE-FC26-00NT40917, Sep. 30, 2001, 107 pages.
Gahan, B. C. et al., "Laser Drilling: Determination of Energy Required to Remove Rock", *Society of Petroleum Engineers* International, SPE 71466, 2001, pp. 1-11.
Gahan, B. C., et al., "Laser Drilling—Drilling with the Power of Light: High Energy Laser Perforation and Completion Techniques", Annual Technical Progress Report by the *Gas Technology Institute*, to the Department of Energy, Nov. 2006, 94 pages.
Gahan, Brian C. et al. "Analysis of Efficient High-Power Fiber Lasers for Well Perforation", *Society of Petroleum Engineers*, SPE 90661, 2004, pp. 1-9.
Gahan, Brian C. et al. "Efficient of Downhole Pressure Conditions on High-Power Laser Perforation", *Society of Petroleum Engineers*, SPE 97093, 2005, pp. 1-7.
Gahan, Brian C. et al., "Laser Drilling: Drilling with the Power of Light, Phase 1: Feasibility Study", *Topical Report*, Cooperative Agreement No. DE-FC26-00NT40917, 2000-2001, pp. 1-148.
Gale, J. F. W. et al., "Natural Fractures in the Barnett Shale and Their Importance for Hydraulic Fracture Treatments", The American Assoction of Petroleum Geologists, *AAPG Bulletin*, vol. 91, No. 4, Apr. 2007, pp. 603-622.
Gardner, R. D. et al., "Flourescent Dye Penetrants Applied to Rock Fractures", *Int. J. Rock Mech. Min. Sci.*, vol. 5, 1968, pp. 155-158 with 2 additional pages.
Gelman, A., "Multi-level (hierarchical) modeling: what it can and can't do", source unknown, Jun. 1, 2005, pp. 1-6.
Gerbaud, L. et al., "PDC Bits: All Comes From the Cutter/Rock Interaction", SPE, No. IADC/SPE 98988, a paper presented at the IADC/SPE Drilling Conference, Feb. 2006, pp. 1-9.
Glowka, David A. et al., "Program Plan for the Development of Advanced Synthetic-Diamond Drill Bits for Hard-Rock Drilling", *Sandia National Laboratories*, SAND 93/1953, 1993, pp. 1-50.
Glowka, David A. et al., "Progress in the Advanced Synthetic-Diamond Drill Bit Program", *Sandia National Laboratories*, SAND95-2617C, 1994, pp. 1-9.
Glowka, David A., "Design Considerations for a Hard-Rock PDC Drill Bit", *Geothermal Technology Development Division 6241, Sandia National Laboratories*, SAND-85-0666C, DE85 008313, 1985, pp. 1-23.
Glowka, David A., "Development of a Method for Predicting the Performance and Wear of PDC Drill Bits", *Sandia National Laboratories*, SAND86-1745-UC-66c, 1987, pp. 1-206.
Glowka, David A., "The Use of Single-Cutter Data in the Analysis of PDC Bit Designs", *61st Annual Technical Conference and Exhibition of Society of Petroleum Engineers*, 1986, pp. 1-37.
Gonthier, F. "High-power All-Fiber® components: The missing link for high power fiber fasers", source unknown, 11 pages, Jul. 2010.
Graves, R. M. et al., "Comparison of Specific Energy Between Drilling With High Power Lasers and Other Drilling Methods", *SPE*, No. SPE 77627, a paper presented at the SPE (Society of Petroleum Engineers) Annual Technical Conference and Exhibiton, Sep. 2002, pp. 1-8.

(56) References Cited

OTHER PUBLICATIONS

Graves, R. M. et al., "Spectral signatures and optic coeffecients of surface and reservoir rocks at COIL, CO2 and Nd:YAG laser wavelenghts", source unknown, 13 pages, Jul. 2010.
Graves, R. M. et al., "StarWars Laser Technology Applied to Drilling and Completing Gas Wells", *SPE*, No. 49259, a paper prepared for presentation at the 1998 SPE Annual Technical Conference and Exhibition, 1998, pp. 761-770.
Graves, Ramona M. et al., "Application of High Power Laser Technology to Laser/Rock Destruction: Where Have We Been? Where Are We Now?", *SW AAPG Convention*, 2002, pp. 213-224.
Graves, Ramona M. et al., "Laser Parameters That Effect Laser-Rock Interaction: Determining the Benefits of Applying Star Wars Laser Technology for Drilling and Completing Oil and Natural Gas Wells", Topical Report, *Petroleum Engineering Department, Colorado School of Mines*, 2001, pp. 1-157.
Green, D. J. et al., "Crack Arrest and Multiple Crackling in Glass Through the Use of Designed Residual Stress Profiles", *Science*, vol. 283, No. 1295, 1999, pp. 1295-1297.
Grigoryan, V., "InhomogeneoBoundary Value Problems", a lecture for Math 124B, Jan. 26, 2010, pp. 1-5.
Grigoryan, V., "Separathion of variables: Neumann Condition", a lecture for Math 124A, Dec. 1, 2009, pp. 1-3.
Gunn, D. A. et al., "Laboratory Measurement and Correction of Thermal Properties for Application to the Rock Mass", *Geotechnical and Geological Engineering*, vol. 23, 2005, pp. 773-791.
Guo, B. et al., "Chebyshev Rational Spectral and Pseudospectral Methods on a Semi-infinite Interval", *Int. J. Numer. Meth. Engng*, vol. 53, 2002, pp. 65-84.
Gurarie, V. N., "Stress Resistance Parameters of Brittle Solids Under Laser/Plasma Pulse Heating", *Materials Science and Engineering*, vol. A288, 2000, pp. 168-172.
Habib, P. et al., "The Influence of Residual Stresses on Rock Hardness", *Rock Mechanics*, vol. 6, 1974, pp. 15-24.
Hagan, P. C., "The Cuttability of Rock Using a High Pressure Water Jet", University of New South Wales, Sydney, Australia, obtained form the Internet on Sep. 7, 2010, at: http://www.mining.unsw.edu.au/Publications/publications_staff/Paper_Hagan_WASM.htm, 16 pages.
Hall, K. et al., "Rock Albedo and Monitoring of Thermal Conditions in Respect of Weathering: Some Expected and Some Unexpected Results", *Earth Surface Processes and Landforms*, vol. 30, 2005, pp. 801-811.
Hall, Kevin, "The role of thermal stress fatigue in the breakdown of rock in cold regions", *Geomorphology*, vol. 31, 1999, pp. 47-63.
Hammer, D. X. et al., "Shielding Properties of Laser-Induced Breakdown in Water for Pulse Durations from 5 ns to 125 fs", *Applied Optics*, vol. 36, No. 22, Aug. 1, 1997, pp. 5630-5640.
Han, Wei, "Computational and experimental investigations of laser drilling and welding for microelectronic packaging", *Dorchester Polytechnic Institute*, A Dissertation submitted in May 2004, 242 pgs.
Hancock, M. J., "The 1-D Heat Equation: 18.303 Linear Partial Differential Equations", source unknown, 2004, pp. 1-41.
Hareland, G. et al., "Drag—Bit Model Including Wear", *SPE*, No. 26957, a paper prepared for presentation at the Latin American/Caribbean Petroleum Engineering Conference, Apr. 1994, pp. 657-667.
Hareland, G. et al., "Cutting Efficiency of a Single PDC Cutter on Hard Rock", *Journal of Canadian Petroleum Technology*, vol. 48, No. 6, 2009, pp. 1-6.
Hareland, G., et al., "A Drilling Rate Model for Roller Cone Bits and Its Application", *SPE*, No. 129592, a paper prepared for presentation at the CPS/SPE International Oil and Gas Conference and Exhibition, Jun. 2010, pp. 1-7.
Harrison, C. W. III et al., "Reservoir Characterization of the Frontier Tight Gas Sand, Green River Basin, Wyoming", *SPE*, No. 21879, a paper prepared for presentation at the Rocky Mountain Regional Meeting and Low-Permeability Reservoirs Symposium, Apr. 1991, pp. 717-725.
Hashida, T. et al., "Numerical Simulation with Experimental Verification of the Fracture Behavior in Granite Under Confining Pressures based on the Tension-Softening Model", *International Journal of Fracture*, vol. 59, 1993, pp. 227-244.
Nesting, M. A. et al., "Evaluation of the Environmental Impacts of Induced Seismicity at the Naknek Geothermal Energy Project, Naknek, Alaska", a final report prepared for ASRC Energy Services Alaska Inc., May 2010, pp. 1-33.
Head, P. et al., "Electric Coiled Tubing Drilling (E-CTD) Project Update", *SPE*, No. 68441, a paper prepared for presentation at the SPE/CoTA Coiled Tubing Roundtable, Mar. 2001, pp. 1-9.
Healy, Thomas E., "Fatigue Crack Growth in Lithium Hydride", *Lawrence Livermore National Laboratory*, 1993, pp. 1-32.
Hettema, M. H. H. et al., "The Influence of Steam Pressure on Thermal Spelling of Sedimentary Rock: Theory and Experiments", *Int. J. Rock Mech. Min. Sci.*, vol. 35, No. 1, 1998, pp. 3-15.
Hibbs, Louis E. et al., "Wear Machanisms for Polycrystalline-Diamond Compacts as Utilized fro Drilling in Geothermal Environments", *Sandia National Laboratories*, for The United States Government, Report No. SAND-82-7213, 1983, 287 pgs.
Hoek, E., "Fracture of Anisotropic Rock", *Journal of the South African Institute of Mining and Metallurgy*, vol. 64, No. 10, 1964, pp. 501-523.
Hood, M., "Waterjet-Assisted Rock Cutting Systems—The Present State of the Art", *International Journal of Mining Engineering*, vol. 3, 1985, pp. 91-111.
Hoover, Ed R. et al., "Failure Mechanisms of Polycrystalline-Diamond Compact Drill Bits in Geothermal Environments", Sandia Report, *Sandia National Laboratories*, SAND81-1404, 1981, pp. 1-35.
Howard, A. D. et al., "VOLAN Interpretation and Application in the Bone Spring Formation (Leonard Series) in Southeastern New Mexico", *SPE*, No. 13397, a paper presented at the 1984 SPE Production Technology Symposium, Nov. 1984, 10 pages.
Howells, G., "Super-Water [R] Jetting Applications from 1974 to 1999", paper presented st the Proceedings of the 10$^{th}$ American Waterjet Confeence in Houston, Texas, 1999, 25 pages.
Hu, H. et al., "SimultaneoVelocity and Concentration Measurements of a Turbulent Jet Mixing Flow", *Ann. N.Y. Acad. Sci.*, vol. 972, 2002, pp. 254-259.
Huang, C. et al., "A Dynamic Damage Growth Model for Uniaxial Compressive Response of Rock Aggregates", *Mechanics of Materials*, vol. 34, 2002, pp. 267-277.
Huang, H. et al., "Intrinsic Length Scales in Tool-Rock Interaction", *International Journal of Geomechanics*, Jan./Feb. 2008, pp. 39-44.
Huenges, E. et al., "The Stimulation of a Sedimentary Geothermal Reservoir in the North German Basin: Case Study Grob Schonebeck", *Proceedings, Twenty-Ninth Workshop on Geothermal Reservoir Engineering*, Stanford University, Stanford, California, Jan. 26-28, 2004, 4 pages.
Huff, C. F. et al., "Recent Developments in Polycrystalline Diamond-Drill-Bit Design", *Drilling Technology Division—4741, Sandia National Laboratories*, 1980, pp. 1-29.
Hutchinson, J. W., "Mixed Mode Cracking in Layered Materials", *Advances in Applied Mechanics*, vol. 29, 1992, pp. 63-191.
IADC Dull Grading System for Fixed Cutter Bits, by Hughes Christensen, 1996, 14 pgs.
Imbt, W. C. et al., "Porosity in Limestone and Dolomite Petroleum Reservoirs", paper presented at the Mid Continent District, Division of Production, Oklahoma City, Oklahoma, Jun. 1946, pp. 364-372.
Jackson, M. K. et al., "Nozzle Design for Coherent Water Jet Production", source unknown, believed to be published prior to 2012, pp. 53-89.
Jadoun, R. S., "Study on Rock-Drilling Using PDC Bits for the Prediction of Torque and Rate of Penetration", *Int. J. Manufacturing Technology and Management*, vol. 17, No. 4, 2009, pp. 408-418.
Jain, R. K. et al., "Development of Underwater Laser Cutting Technique for Steel and Zircaloy for Nuclear Applications", *Journal of Physics for Indian Academy of Sciences*, vol. 75 No. 6, Dec. 2010, pp. 1253-1258.
Jen, C. K. et al., "Leaky Modes in Weakly Guiding Fiber Acoustic Waveguides", *IEEE Transactions on Ultrasonic Ferroelectrics and Frequency Control*, vol. UFFC-33 No. 6, Nov. 1986, pp. 634-643.

(56) References Cited

OTHER PUBLICATIONS

Jimeno, Carlos Lopez et al., Drilling and Blasting of Rocks, *a. a. Balkema* Publishers, 1995, 30 pgs.
Judzis, A. et al., "Investigation of Smaller Footprint Drilling System; Ultra-High Rotary Speed Diamond Drilling Has Potential for Reduced Energy Requirements", IADC/SPE No. 99020, 33 pages, Jul. 2010.
Jurewicz, B. R., "Rock Excavation with Laser Assistance", *Int. J. Rock Mech. Min. Sci. & Geomech. Abstr.*, vol. 13, 1976, pp. 207-219.
Kahraman, S. et al., "Dominant rock properties affecting the penetration rate of percussive drills", *International Journal of Rock Mechanics and Mining Sciences*, 2003, vol. 40, pp. 711-723.
Karakas, M., "Semianalytical Productivity Models for Perforated Completions", *SPE*, No. 18247, a paper for SPE (Society of Petroleum Engineers) Production Engineering, Feb. 1991, pp. 73-82.
Karasawa, H. et al., "Development of PDC Bits for Downhole Motors", *Proceedings 17th NZ Geothermal Workshop*, 1995, pp. 145-150.
Kelsey, James R., "Drilling Technology/GDO", *Sandia National Laboratories*, SAND-85-1866c, DE85 017231, 1985, pp. 1-7.
Kemeny, J. M., "A Model for Non-linear Rock Deformation Under Compression Due to Sub-critical Crack Growth", *Int. J. Rock Mech. Min. Sci. & Geomech. Abstr.*, vol. 28 No. 6, 1991, pp. 459-467.
Kerr, Callin Joe, "PDC Drill Bit Design and Field Application Evolution", *Journal of Petroleum Technology*, 1988, pp. 327-332.
Ketata, C. et al., "Knowledge Selection for Laser Drilling in the Oil and Gas Industry", *Computer Society*, 2005, pp. 1-6.
Khan, Ovais U. et al., "Laser heating of sheet metal and thermal stress development", *Journal of Materials Processing Technology*, vol. 155-156, 2004, pp. 2045-2050.
Khandelwal, M., "Prediction of Thermal Conductivity of Rocks by Soft Computing", *Int. J. Earth Sci.* (*Geol. Rundsch*), May 11, 2010, 7 pages.
Kim, C. B. et al., "Measurement of the Refractive Index of Liquids at 1.3 and 1.5 Micron Using a Fibre Optic Fresnel Ratio Meter", *Meas. Sci. Technol.*,vol. 5, 2004, pp. 1683-1686.
Kim, K. R. et al., "$CO_2$ laser-plume interaction in materials processing", *Journal of Applied Physics*, vol. 89, No. 1, 2001, pp. 681-688.
Kiwata, T. et al., "Flow Visualization and Characteristics of a Coaxial Jet with a Tabbed Annular Nozzle", *JSME International Journal Series B*, vol. 49, No. 4, 2006, pp. 906-913.
Klotz, K. et al., "Coatings with intrinsic stress profile: Refined creep analysis of (Ti,A1)N and cracking due to cyclic laser heating", *Thin Solid Films*, vol. 496, 2006, pp. 469-474.
Kobayashi, T. et al., "Drilling a 2-inch in Diameter Hole in Granites Submerged in Water by CO2 Lasers", *SPE*, No. 119914, a paper prepared for presentation at the SPE/IADC Drilling Conference and Exhibition, Mar. 2009, 6 pages.
Kobayashi, Toshio et al., "Drilling a 2-inch in Diameter Hole in Granites Submerged in Water by $CO_2$ Lasers", *SPE International, IADC 119914 Drilling Conference and Exhibition*, 2009, pp. 1-11.
Kobyakov, A. et al., "Design Concept for Optical Fibers with Enhanced SBS Threshold", *Optics Express*, vol. 13, No. 14, Jul. 11, 2005, pp. 5338-5346.
Kolari, K., "Damage Mechanics Model for Brittle Failure of Transversely Isotropic Solids (Finite Element Implementation)", *VTT Publications 628*, 2007, 210 pages.
Kollé, J. J., "A Comparison of Water Jet, Abrasive Jet and Rotary Diamond Drilling in Hard Rock", *Tempress Technologies Inc.*, 1999, pp. 1-8.
Kolle, J. J., "HydroPulse Drilling", a Final Report for Department of Energy under Cooperative Development Agreement No. DE-FC26-FT34367, Apr. 2004, 28 pages.
Kovalev, V. I. et al., "Observation of Hole Burning in Spectrum in SBS in Optical Fibres Under CW Monochromatic Laser Excitation", *IEEE*, Jun. 3, 2010, pp. 56-57.
Koyamada, Y. et al., "Simulating and Designing Brillouin Gain Spectrum in Single-Mode Fibers", *Journal of Lightwave Technology*, vol. 22, No. 2, Feb. 2004, pp. 631-639.
Krajcinovic, D. et al., "A Micromechanical Damage Model for Concrete", *Engineering Fracture Mechanics*, vol. 25, No. 5/6, 1986, pp. 585-596.
Kranz, R. L., "Microcracks in Rocks: A Review", *Tectonophysics*, vol. 100, 1983, pp. 449-480.
Kubacki, Emily et al., "Optics for Fiber Laser Applications", *CVI Laser, LLC*, Technical Reference Document #20050415, 2005, 5 pgs.
Kujawski, Daniel, "A fatigue crack driving force parameter with load ratio effects", *International Journal of Fatigue*, vol. 23, 2001, pp. S239-S246.
Labuz, J. F. et al., "Experiments with Rock: Remarks on Strength and Stability Issues", *International Journal of Rock Mechanics & Mining Science*, vol. 44, 2007, pp. 525-537.
Labuz, J. F. et al., "Size Effects in Fracture of Rock", *Rock Mechanics for Industry*, Amadei, Kranz, Scott & Smeallie (eds), 1999, pp. 1137-1143.
Labuz, J. F. et al., "Microrack-dependent fracture of damaged rock", *International Journal of Fracture*, vol. 51, 1991, pp. 231-240.
Lacy, Lewis L., "Dynamic Rock Mechanics Testing for Optimized Fracture Designs", *Society of Petroleum Engineers International, Annual Technical Conference and Exhibition*, 1997, pp. 23-36.
Lally, Evan M., "A Narrow-Linewidth Laser at 1550 nm Using the Pound-Drever-Hall Stabilization Technique", *Thesis*, submitted to Virginia Polytechnic Institute and State University, Blacksburg, Virginia, 2006, 92 pgs.
Langeveld, C. J., "PDC Bit Dynamics", a paper prepared for presentation at the 1992 IADC/SPE Drilling Conference, Feb. 1992, pp. 227-241.
Lau, John H., "Thermal Fatigue Life Prediction of Flip Chip Solder Joints by Fracture Mechanics Method", *Engineering Fracture Mechanics*, vol. 45, No. 5, 1993, pp. 643-654.
Lee, S. H. et al., "Themo-Poroelastic Analysis of Injection-Induced Rock Deformation and Damage Evolution", *Proceedings Thirty-Fifth Workshop on Geothermal Reservoir Engineering*, Feb. 2010, 9 pages.
Lee, Y. W. et al., "High-Power Yb3+ Doped Phosphate Fiber Amplifier", *IEEE Journal of Selected Topics in Quantum Electronics*, vol. 15, No. 1, Jan./Feb. 2009, pp. 93-102.
Legarth, B. et al., "Hydraulic Fracturing in a Sedimentary Geothermal Reservoir: Results and Implications", *International Journal of Rock Mechanics & Mining Sciences*, vol. 42, 2005, pp. 1028-1041.
Lehnhoff, T. F. et al., "The Influence of Temperature Dependent Properties on Thermal Rock Fragmentation", *Int. J. Rock Mech. Min. Sci. & Geomech. Abstr.*, vol. 12, 1975, pp. 255-260.
Leong, K. H. et al., "Lasers and Beam Delivery for Rock Drilling", *Argonne National Laboratory*, ANL/TD/TM03-01, 2003, pp. 1-35.
Leong, K. H., "Modeling Laser Beam-Rock Interaction", a report prepared for Department of Energy (http://www.doe.gov/bridge), 8 pages, Jul. 21, 2010.
Leung, M. et al., "Theoretical study of heat transfer with moving phase-change interface in thawing of frozen food", *Journal of Physics D: Applied Physics*, vol. 38, 2005, pp. 477-482.
Li, Q. et al., "Experimental Research on Crack Propagation and Failure in Rock-type Materials under Compression", *EJGE*, vol. 13, Bund. D, 2008, p. 1-13.
Li, X. B. et al., "Experimental Investigation in the Breakage of Hard Rock by the PDC Cutters with Combined Action Modes", *Tunnelling and Underground Space Technology*, vol. 16., 2001, pp. 107-114.
Liddle, D. et al., "Cross Sector Decommissioning Workshop", presentation, Mar. 23, 2011, 14 pages.
Lima, R. S. et al., "Elastic ModulMeasurements via Laser-Ultrasonic and Knoop Indentation Techniques in Thermally Sprayed Coatings", *Journal of Thermal Spray Technology*, vol. 14(1), 2005, pp. 52-60.
Lin, Y. T., "The Impact of Bit Performance on Geothermal-Well Cost", *Sandia National Laboratories*, SAND-81-1470C, 1981, pp. 1-6.
Lindholm, U. S. et al., "The Dynamic Strength and Fracture Properties of Dresser Basalt", *Int. J. Rock Mech. Min. Sci. & Geomech. Abstr.*, vol. 11, 1974, pp. 181-191.
Loland, K. E., "ContinuoDamage Model for Load-Response Estimation of Concrete", *Cement and Concrete Research*, vol. 10, 1980, pp. 395-402.

(56) References Cited

OTHER PUBLICATIONS

Lomov, I. N. et al., "Explosion in the Granite Field: Hardening and Softening Behavior in Rocks", *U.S. Department of Energy, Lawrence Livermore National Laboratory*, 2001, pp. 1-7.
Long, S. G. et al., "Thermal fatigue of particle reinforced metal-matrix composite induced by laser heating and mechanical load", *Composites Science and Technology*, vol. 65, 2005, pp. 1391-1400.
Lorenzana, H. E. et al., "Metastability of Molecular Phases of Nitrogen: Implications to the Phase Diagram", a manuscript submitted to the European Hight Pressure Research Group 39 Conference, *Advances on High Pressure*, Sep. 21, 2001, 18 pages.
Lubarda, V. A. et al., "Damage Model for Brittle Elastic Solids with Unequal Tensile and Compressive Strengths", *Engineering Fracture Mechanics*, vol. 29, No. 5, 1994, pp. 681-692.
Lucia, F. J. et al., "Characterization of Diagenetically Altered Carbonate Reservoirs, South Cowden Grayburg Reservoir, West Texas", a paper prepared for presentation at the 1996 SPE Annual Technical Conference and Exhibition, Oct. 1996, pp. 883-893.
Luffel, D. L. et al., "Travis Peak Core Permeability and Porosity Relationships at Reservoir Stress", *SPE Formation Evaluation*, Sep. 1991, pp. 310-318.
Luft, H. B. et al., "Development and Operation of a New Insulated Concentric Coiled Tubing String for ContinuoSteam Injection in Heavy Oil Production", Conference Paper published by Society of Petroleum Engineers on the Internet at: (http://www.onepetro.org/mslib/servlet/onepetropreview?id=00030322), on Aug. 8, 2012, 1 page.
Lund, M. et al., "Specific Ion Binding to Macromolecules: Effect of Hydrophobicity and Ion Pairing", *Langmuir*, 2008 vol. 24, 2008, pp. 3387-3391.
Lyons, K. David et al., "NETL Extreme Drilling Laboratory Studies High Pressure High Temperature Drilling Phenomena", *U.S. Department of Energy, National Energy Technology Laboratory*, 2007, pp. 1-6.
Manrique, E. J. et al., "EOR Field Experiences in Carbonate Reservoirs in the United States", *SPE Reservoir Evaluation & Engineering*, Dec. 2007, pp. 667-686.
Maqsood, A. et al., "Thermophysical Properties of PoroSandstones: Measurement and Comparative Study of Some Representative Thermal Conductivity Models", *International Journal of Thermophysics*, vol. 26, No. 5, Sep. 2005, pp. 1617-1632.
Marcuse, D., "Curvature Loss Formula for Optical Fibers", *J. Opt. Soc. Am.*, vol. 66, No. 3, 1976, pp. 216-220.
Marshall, David B. et al., "Indentation of Brittle Materials", *Microindentation Techniques in Materials Science and Engineering, ASTM STP 889; American Society for Testing and Materials*, 1986, pp. 26-46.
Martin, C. D., "Seventeenth Canadian Geotechnical Colloquium: The Effect of Cohesion Loss and Stress Path on Brittle Rock Strength", *Canadian Geotechnical Journal*, vol. 34, 1997, pp. 698-725.
Martins, A. et al., "Modeling of Bend Losses in Single-Mode Optical Fibers", Institutu de Telecomunicacoes, Portugal, 3 pages, Aug. 19, 2009.
Maurer, W. C. et al., "Laboratory Testing of High-Pressure, High-Speed PDC Bits", a paper prepared for presentation at the 61st Annual Technical Conference and Exhibition of the Society of Petroleum Engineers, Oct. 1986, pp. 1-8.
Maurer, William C., "Advanced Drilling Techniques", published by Petroleum Publishing Co., copyright 1980, 26 pgs.
Maurer, William C., "Novel Drilling Techniques", published by Pergamon Press, UK, copyright 1968, pp. 1-64.
Mazerov, Katie, "Bigger coil sizes, hybrid rigs, rotary steerable advances push coiled tubing drilling to next level", *Drilling Contractor*, 2008, pp. 54-60.
McElhenny, John E. et al., "Unique Characteristic Features of Stimulated Brillouin Scattering in Small-Core Photonic Crystal Fibers", *J. Opt. Soc. Am. B*, vol. 25, No. 4, 2008, pp. 582-593.
McKenna, T. E. et al., "Thermal Conductivity of Wilcox and Frio Sandstones in South Texas (Gulf of Mexico Basin)", *AAPG Bulletin*, vol. 80, No. 8, Aug. 1996, pp. 1203-1215.
Medvedev, I. F. et al., "Optimum Force Characteristics of Rotary-Percussive Machines for Drilling Blast Holes", Moscow, Translated from *Fiziko-Tekhnicheskie Problemy Razrabotki Poleznykh Iskopaemykh*, No. 1, 1967, pp. 77-80.
Meister, S. et al., "Glass Fibers for Stimulated Brillouin Scattering and Phase Conjugation", *Laser and Particle Beams*, vol. 25, 2007, pp. 15-21.
Mejia-Rodriguez, G. et al., "Multi-Scale Material Modeling of Fracture and Crack Propagation", Final Project Report in Multi-Scale Methods in Applied Mathematics, while the date of the publication is unknown, it is believed to be prior to Aug. 19, 2009, pp. 1-9.
Mensa-Wilmot, G. et al., "New PDC Bit Technology, Improved Drillability Analysis, and Operational Practices Improve Drilling Performance in Hard and Highly HeterogeneoApplications", a paper prepared for the 2004 SPE (Society of Petroleum Engineers) Eastern Regional Meeting, Sep. 2004, pp. 1-14.
Mensa-Wilmot, Graham et al., "Advanced Cutting Structure Improves PDC Bit Performance in Hard and Abrasive Drilling Environments", *Society of Petroleum Engineers International*, 2003, pp. 1-13.
Messaoud, Louafi, "Influence of Fluids on the Essential Parameters of Rotary Percussive Drilling", *Laboratoire d'Environnement (Tébessa)*, vol. 14, 2009, pp. 1-8.
Messica, A. et al., "Theory of Fiber-Optic Evanescent-Wave Spectroscopy and Sensor", *Applied Optics*, vol. 35, No. 13, May 1, 1996, pp. 2274-2284.
Mills, W. R. et al., "Pulsed Neutron Porosity Logging", SPWLA Twenty-Ninth Annual Logging Symposium, Jun. 1988, pp. 1-21.
Mirkovich, V. V., "Experimental Study Relating Thermal Conductivity to Thermal Piercing of Rocks", *Int. J. Rock Mech. Min. Sci.*, vol. 5, 1968, pp. 205-218.
Mittelstaedt, E. et al., "A Noninvasive Method for Measuring the Velocity of Diffuse Hydrothermal Flow by Tracking Moving Refractive Index Anomalies", *Geochemistry Geophysics Geosystems*, vol. 11, No. 10, Oct. 8, 2010, pp. 1-18.
Moavenzadeh, F. et al., "Thin Disk Technique for Analyzing Fock Fractures Induced by Laser Irradiation", a report prepared for the Department of Transportation under Contract C-85-65, May 1968, 91 pages.
Mocofanescu, A. et al., "SBS threshold for single mode and multimode GRIN fibers in an all fiber configuration", *Optics Express*, vol. 13, No. 6, 2005, pp. 2019-2024.
Montross, C. S. et al., "Laser-Induced Shock Wave Generation and Shock Wave Enhancement in Basalt", *International Journal of Rock Mechanics and Mining Sciences*, 1999, pp. 849-855.
Moradian, Z. A. et al., "Predicting the Uniaxial Compressive Strength and Static Young's Modulof Intact Sedimentary Rocks Using the Ultrasonic Test", *International Journal of Geomechanics*, vol. 9, No. 1, 2009, pp. 14-19.
Morozumi, Y. et al., "Growth and Structures of Surface Disturbances of a Round Liquid Jet in a Coaxial Airflow", *Fluid Dynamics Research*, vol. 34, 2004, pp. 217-231.
Morse, J. W. et al., "Experimental and Analytic Studies to Model Reaction Kinetics and Mass Transport of Carbon Dioxide Sequestration in Depleted Carbonate Reservoirs", a Final Scientific/Technical Report for DOE, while the date of the publication is unknown, it is believed to be prior to Aug. 19, 2009, 158 pages.
Moshier, S. O., "Microporosity in Micritic Limestones: A Review", *Sedimentary Geology*, vol. 63, 1989, pp. 191-213.
Mostafa, M. S. et al., "Investigation of Thermal Properties of Some Basalt Samples in Egypt", *Journal of Thermal Analysis and Calorimetry*, vol. 75, 2004, pp. 178-188.
Mukhin, I. B. et al., "Experimental Study of Kilowatt-Average-Power Faraday Isolators", OSA/ASSP, 2007, 3 pages.
Multari, R. A. et al., "Effect of Sampling Geometry on Elemental Emissions in Laser-Induced Breakdown Spectroscopy", *Applied Spectroscopy*, vol. 50, No. 12, 1996, pp. 1483-1499.
Munro, R. G., "Effective Medium Theory of the Porosity Dependence of Bulk Moduli", *Communications of American Ceramic Society*, vol. 84, No. 5, 2001, pp. 1190-1192.

(56) References Cited

OTHER PUBLICATIONS

Murphy, H. D., "Thermal Stress Cracking and Enhancement of Heat Extraction from Fractured Geothermal Reservoirs", a paper submitted to the Geothermal Resource Council for its 1978 Annual Meeting, Jul. 1978, 7 pages.
Murrell, S. A. F. et al., "The Effect of Temperature on the Strength at High Confining Pressure of Granodiorite Containing Free and Chemically-Bound Water", *Mineralogy and Petrology*, vol. 55, 1976, pp. 317-330.
Muto, Shigeki et al., "Laser cutting for thick concrete by multi-pass technique", *Chinese Optics Letters*, vol. 5 Supplement, 2007, pp. S39-S41.
Myung, I. J., "Tutorial on Maximum Likelihood Estimation", *Journal of Mathematical Psychology*, vol. 47, 2003, pp. 90-100.
Nakano, A. et al., "Visualization for Heat and Mass Transport Phenomena in Supercritical Artificial Air", *Cryogenics*, vol. 45, 2005, pp. 557-565.
Naqavi, I. Z. et al., "Laser heating of multilayer assembly and stress levels: elasto-plastic consideration", *Heat and Mass Transfer*, vol. 40, 2003, pp. 25-32.
Nara, Y. et al., "Study of Subcritical Crack Growth in Andesite Using the Double Torsion Test", *International Journal of Rock Mechanics & Mining Sciences*, vol. 42, 2005, pp. 521-530.
Nara, Y. et al., "Sub-critical crack growth in anisotropic rock", *International Journal of Rock Mechanics and Mining Sciences*, vol. 43, 2006, pp. 437-453.
Nemat-Nasser, S. et al., "Compression-Induced Nonplanar Crack Extension With Application to Splitting, Exfoliation, and Rockburst", *Journal of Geophysical Research*, vol. 87, No. B8, 1982, pp. 6805-6821.
Nicklaus, K. et al., "Optical Isolator for Unpolarized Laser Radiation at Multi-Kilowatt Average Power", *Optical Society of America*, 2005, 3 pages.
Nikles, M. et al., "Brillouin Gain Spectrum Characterization in Single-Mode Optical Fibers", *Journal of Lightwave Technology*, vol. 15, No. 10, Oct. 1997, pp. 1842-1851.
Nilsen, B. et al., "Recent Developments in Site Investigation and Testing for Hard Rock TBM Projects", *1999 RETC Proceedings*, 1999, pp. 715-731.
Nimick, F. B., "Empirical Relationships Between Porosity and the Mechanical Properties of Tuff", *Key Questions in Rock Mechanics*, Cundall et al. (eds), 1988, pp. 741-742.
Nolen-Hoeksema, R., "Fracture Development and Mechnical Stratigraphy of Austin Chalk, Texas: Discussion", a discussion for the American Association of Petroleum Geologists Bulletin, vol. 73, No. 6, Jun. 1989, pp. 792-793.
O'Hare, Jim et al., "Design Index: A Systematic Method of PDC Drill-Bit Selection", *Society of Petroleum Engineers International*, IADC/SPE Drilling Conference, 2000, pp. 1-15.
Oglesby, K. et al., "Advanced Ultra High Speed Motor for Drilling", a project update by Impact Technologies LLC for the Department of Energy, Sep. 12, 2005, 36 pages.
Okon, P. et al., "Laser Welding of Aluminium Alloy 5083", *21st International Congress on Applications of Lasers and Electro-Optics*, 2002, pp. 1-9.
Olsen, F. O., "Fundamental Mechanisms of Cutting Front Formation in Laser Cutting", *SPIE*, vol. 2207, pp. 402-413, Jul. 21, 2010.
Ortega, Alfonso et al., "Frictional Heating and Convective Cooling of Polycrystalline Diamond Drag Tools During Rock Cutting", Report No. SAND 82-0675c, *Sandia National Laboratories*, 1982, 23 pgs.
Ortega, Alfonso et al., "Studies of the Frictional Heating of Polycrystalline Diamond Compact Drag Tools During Rock Cutting", *Sandia National Laboratories*, SAND-80-2677, 1982, pp. 1-151.
Ortiz, Blas et al., Improved Bit Stability Reduces Downhole Harmonics (Vibrations), *International Association of Drilling Contractors/ Society of Petroleum Engineers Inc.*, 1996, pp. 379-389.
Ouyang, L. B. et al., "General Single Phase Wellbore Flow Model", a report prepared for the COE/PETC, May 2, 1997, 51 pages.
Palashchenko, Yuri A., "Pure Rolling of Bit Cones Doubles Performance", *I & Gas Journal*, vol. 106, 2008, 8 pgs.
Palchaev, D. K. et al., "Thermal Expansion of Silicon Carbide Materials", *Journal of Engineering Physics and Thermophysics*, vol. 66, No. 6, 1994, 3 pages.
Pardoen, T. et al., "An extended model for void growth and Coalescence", *Journal of the Mechanics and Physics of Solids*, vol. 48, 2000, pp. 2467-2512.
Park, Un-Chul et al., "Thermal Analysis of Laser Drilling Processes", *IEEE Journal of Quantum Electronics*, 1972, vol. QK-8, No. 2, 1972, pp. 112-119.
Parker, R. et al., "Drilling Large Diameter Holes in Rocks Using Multiple Laser Beams (504)", while the date of the publication is unknown, it is believed to be prior to Aug. 19, 2009, 6 pages.
Parker, Richard A. et al., "Laser Drilling Effects of Beam Application Methods on Improving Rock Removal", *Society of Petroleum Engineers*, SPE 84353, 2003, pp. 1-7.
Patricio, M. et al., "Crack Propagation Analysis", while the date of the publication is unknown, it is believed to be prior to Aug. 19, 2009, 24 pages.
Pavlina, E. J. et al., "Correlation of Yield Strength and Tensile Strength with Hardness for Steels", *Journals of Materials Engineering and Performance*, vol. 17, No. 6, 2008, pp. 888-893.
Peebler, R. P. et al., "Formation Evaluation with Logs in the Deep Anadarko Basin", *SPE of AIME*, 1972, 15 pages.
Pepper, D. W. et al., "Benchmarking COMSOL Multiphysics 3.5a—CFD Problems", a presentation, Oct. 10, 2009, 54 pages.
Percussion Drilling Manual, by Smith Tools, 2002, 67 pgs.
Pettitt, R. et al., "Evolution of a Hybrid Roller Cone/PDC Core Bit", a paper prepared for Geothermal Resources Council 1980 Annual Meeting, Sep. 1980, 7 pages.
Phani, K. K. et al., "Pororsity Dependence of Ultrasonic Velocity and Elastic Modulin Sintered Uranium Dioxide—a discussion", *Journal of Materials Science Letters*, vol. 5, 1986, pp. 427-430.
Ping, Cao et al., "Testing study of subcritical crack growth rate and fracture toughness in different rocks", *Transactions of NonferroMetals Society of China*, vol. 16, 2006, pp. 709-714.
Plinninger, Dr. Ralf J. et al., "Wear Prediction in Hardrock Excavation Using the CERCHAR Abrasiveness Index (CAI)", *EUROCK 2004 & 53rd Geomechanics Colloquium. Schubert* (*ed.*), VGE, 2004, pp. 1-6.
Plinninger, R. J. et al., "Wear Prediction in Hardrock Excavation Using the CERCHAR Abrasiveness Index (CAI)", EUROCK 2004 & 53rd Geomechanics Colloquium, 2004, 6 pages.
Plinninger, Ralf J. et al., "Predicting Tool Wear in Drill and Blast", *Tunnels & Tunneling International Magazine*, 2002, pp. 1-5.
Plumb, R. A. et al., "Influence of Composition and Texture on Compressive Strength Variations in the Travis Peak Formation", a paper prepared for presentation at the 67th Annual Technical Conference and Exhibition of the Society of Petroleum Engineers, Oct. 1992, pp. 985-998.
Polsky, Yarom et al., "Enhanced Geothermal Systems (EGS) Well Construction Technology Evaluation Report", *Sandia National Laboratories*, Sandia Report, SAND2008-7866, 2008, pp. 1-108.
Pooniwala, S. et al., "Lasers: The Next Bit", a paper prepared for the presentation at the 2006 SPE (Society of Petroleum Engineers) Eastern Regional Meeting, Oct. 2006, pp. 1-10.
Pooniwala, Shahvir, "Lasers: The Next Bit", *Society of Petroleum Engineers*, No. SPE 104223, 2006, 10 pgs.
Porter, J. A. et al., "Cutting Thin Sheet Metal with a Water Jet Guided Laser Using VarioCutting Distances, Feed Speeds and Angles of Incidence", *Int. J. Adv. Manuf. Technol.*, vol. 33, 2007, pp. 961-967.
Potyondy, D. O. et al., "A Bonded-particle model for rock", *International Journal of Rock Mechanics and Mining Sciences*, vol. 41, 2004, pp. 1329-1364.
Potyondy, D. O., "Simulating Stress Corrosion with a Bonded-Particle Model for Rock", *International Journal of Rock Mechanics & Mining Sciences*, vol. 44, 2007, pp. 677-691.
Potyondy, D., "Internal Technical Memorandum—Molecular Dynamics with PFC", a Technical Memorandum to PFC Development Files and Itasca Website, *Molecular Dynamics with PFC*, Jan. 6, 2010, 35 pages.

(56) References Cited

OTHER PUBLICATIONS

Powell, M. et al., "Optimization of UHP Waterjet Cutting Head, The Orifice", Flow International, while the date of the publication is unknown, it is believed to be prior to Aug. 19, 2009, 19 pages.
Price, R. H. et al., "Analysis of the Elastic and Strength Properties of Yuccs Mountain tuff, Nevada", 26th Symposium on Rock Mechanics, Jun. 1985, pp. 89-96.
Qixian, Luo et al., "Using compression wave ultrasonic transducers to measure the velocity of surface waves and hence determine dynamic modulof elasticity for concrete", *Construction and Building Materials*, vol. 10, No. 4, 1996, pp. 237-242.
Quinn, R. D. et al., "A Method for Calculating Transient Surface Temperatures and Surface Heating Rates for High-Speed Aircraft", NASA, Dec. 2000, 35 pages.
Radkte, Robert, "New High Strength and faster Drilling TSP Diamond Cutters", Report by *Technology International, Inc.*, DOE Award No. DE-FC26-97FT34368, 2006, 97 pgs.
Ramadan, K. et al., "On the Analysis of Short-Pulse Laser Heating of Metals Using the Dual Phase Lag Heat Conduction Model", *Journal of Heat Transfer*, vol. 131, Nov. 2009, pp. 111301-1 to 111301-7.
Rao, M. V. M. S. et al., "A Study of Progressive Failure of Rock Under Cyclic Loading by Ultrasonic and AE Monitoring Techniques", *Rock Mechanics and Rock Engineering*, vol. 25, No. 4, 1992, pp. 237-251.
Rauenzahn, R. M. et al., "Rock Failure Mechanisms of Flame-Jet Thermal Spallation Drilling—Theory and Experimental Testing",*Int. J. Rock Mech. Min. Sci. & Geomech. Abstr.*, vol. 26, No. 5, 1989, pp. 381-399.
Rauenzahn, R. M., "Analysis of Rock Mechanics and Gas Dynamics of Flame-Jet Thermal Spallation Drilling", a dissertation for the degree of Doctor of Philosophy at Massachusettes Institute of Technology, Sep. 1986, pp. 1-524.
Rauenzahn, R. M. et al., "Rock Failure Mechanisms of Flame-Jet Thermal Spallation Drilling—Theory and Experimental Testing", *Int. J. Rock Merch. Min. Sci. & Geomech. Abstr.*, vol. 26, No. 5, 1989, pp. 381-399.
Rauenzahn, R. M., "Analysis of Rock Mechanics and Gas Dynamics of Flame-Jet Thermal Spallation Drilling", *Massachusetts Institute of Technology*, submitted in partial fulfillment of doctorate degree, 1986 583 pgs.
Ravishankar, M. K., "Some Results on Search Complexity vs Accuracy", DARPA Spoken Systems Technology Workshop, Feb. 1997, 4 pages.
Raymond, David W., "PDC Bit Testing at Sandia Reveals Influence of Chatter in Hard-Rock Drilling", *Geothermal Resources Council Monthly Bulletin*, SAND99-2655J, 1999, 7 pgs.
Ream, S. et al., "Zinc Sulfide Optics for High Power Laser Applications", Paper 1609, while the date of the publication is unknown, it is believed to be prior to Aug. 19, 2009, 7 pages.
Rice, J. R., "On the Stability of Dilatant Hardening for Saturated Rock Masses", *Journal of Geophysical Research*, vol. 80, No. 11, Apr. 10, 1975, pp. 1531-1536.
Richter, D. et al., "Thermal Expansion Behavior of IgneoRocks", *Int. J. Rock Mech. Min. Sci. & Geomech. Abstr.*, vol. 11, 1974, pp. 403-411.
Rietman, N. D. et al., "Comparative Economics of Deep Drilling in Anadarka Basin", a paper presented at the 1979 Society of Petroleum Engineers of AIME Deep Drilling and Production Symposium, Apr. 1979, 5 pages.
Rijken, P. et al., "Predicting Fracture Attributes in the Travis Peak Formation Using Quantitative Mechanical Modeling and Stractural Diagenesis", Gulf Coast Association of Geological Societies Transactions vol. 52, 2002, pp. 837-847.
Rijken, P. et al., "Role of Shale Thickness on Vertical Connectivity of Fractures: Application of Crack-Bridging Theory to the Austin Chalk, Texas", *Tectonophysics*, vol. 337, 2001, pp. 117-133.
Rosler, M., "Generalized Hermite Polynomials and the Heat Equation for Dunkl Operators", a paper, while the date of the publication is unknown, it is believed to be prior to Aug. 19, 2009, pp. 1-24.
Rossmanith, H. P. et al., "Fracture Mechanics Applications to Drilling and Blasting", *Fatigue & Fracture Engineering Materials & Structures*, vol. 20, No. 11, 1997, pp. 1617-1636.
Rossmanith, H. P. et al., "Wave Propagation, Damage Evolution, and Dynamic Fracture Extension. Part I. Percussion Drilling", *Materials Science*, vol. 32, No. 3, 1996, pp. 350-358.
Rubin, A. M. et al., "Dynamic Tensile-Failure-Induced Velocity Deficits in Rock", *Geophysical Research Letters*, vol. 18, No. 2, Feb. 1991, pp. 219-222.
Sachpazis, C. I, M. Sc., Ph. D., "Correlating Schmidt Hardness With Compressive Strength and Young's ModulOf Carbonate Rocks", *International Association of Engineering Geology*, Bulletin, No. 42, 1990, pp. 75-83.
Salehi, I. A. et al., "Laser Drilling—Drilling with the Power Light", a final report a contract with DOE with award No. DE-FC26-00NT40917, May 2007, in parts 1-4 totaling 318 pages.
Sandler, I. S. et al., "An Algorithm and a Modular Subroutine for the Cap Model", *International Journal for Numerical and Analytical Methods in Geomechanics*, vol. 3, 1979, pp. 173-186.
Sano, Osam et al., "Acoustic Emission During Slow Crack Growth", *Department Mining and Mineral Engineering, NII-Electronic Library Service*, 1980, pp. 381-388.
Santarelli, F. J. et al., "Formation Evaluation From Logging on Cuttings", *SPE Reservoir Evaluation & Engineering*, Jun. 1998, pp. 238-244.
Sattler, A. R., "Core Analysis in a Low Permeability Sandstone Reservoir: Results from the Multiwell Experiment", a report by Sandia National Laboratories for The Department of Energy, Apr. 1989, 69 pages.
Scaggs, M. et al., "Thermal Lensing Compensation Objective for High Power Lasers", published by Haas Lasers Technologies, Inc., while the date of the publication is unknown, it is believed to be prior to Aug. 19, 2009, 7 pages.
Schaff, D. P. et al., "Waveform Cross-Correlation-Based Differential Travel-Time Measurements at the Northern California Seismic Network", *Bulletin of the Seismological Society of America*, vol. 95, No. 6, Dec. 2005, pp. 2446-2461.
Schaffer, C. B. et al., "Dynamics of Femtosecond Laser-Induced Breakdown in Water from Femtoseconds to Microseconds", *Optics Express*, vol. 10, No. 3, Feb. 11, 2002, pp. 196-203.
Scholz, C. H., "Microfracturing of Rock in Compression", a dissertation for the degree of Doctor of Philosophy at Massachusettes Instutute of Trechnology, Sep. 1967, 177 pages.
Schormair, Nik et al., "The influence of anisotropy on hard rock drilling and cutting", *The Geological Society of London, IAEG*, Paper No. 491, 2006, pp. 1-11.
Schroeder, R. J. et al., "High Pressure and Temperature Sensing for the Oil Industry Using Fiber Bragg Gratings Written onto Side Hole Single Mode Fiber", publisher unknown, while the date of the publication is unknown, it is believed to be prior to Aug. 19, 2009, 4 pages.
Shannon, G. J. et al., "High power laser welding in hyperbaric gas and water environments", *Journal of Laser Applications*, vol. 9, 1997, pp. 129-136.
Shiraki, K. et al., "SBS Threshold of a Fiber with a Brillouin Frequency Shift Distribution", *Journal of Lightwave Technology*, vol. 14, No. 1, Jan. 1996, pp. 50-57.
Shuja, S. Z. et al., "Laser heating of semi-infinite solid with consecutive pulses: Influence of materaial properties on temperature field", *Optics & Laser Technology*, vol. 40, 2008, pp. 472-480.
Simple Drilling Methods, WEDC Loughborough University, United Kingdom, 1995, 4 pgs.
Singh, T. N. et al., "Prediction of Thermal Conductivity of Rock Through Physico-Mechanical Properties", *Building and Environment*, vol. 42, 2007, pp. 146-155.
Sinha, D., "Cantilever Drilling—Ushering a New Genre of Drilling", a paper prepared for presentation at the SPE/IADC Middle East Drilling Technology Conference and Exhibition, Oct. 2003, 6 pages.
Sinor, a. et al., "Drag Bit Wear Model", *SPE Drilling Engineering*, Jun. 1989, pp. 128-136.
Smith, D., "Using Coupling Variables to Solve Compressible Flow, Multiphase Flow and Plasma Processing Problems", COMSOL Users Conference 2006, 38 pages.

(56) References Cited

OTHER PUBLICATIONS

Smith, E., "Crack Propagation at a Constant Crack Tip Stress Intensity Factor", *Int. Journal of Fracture*, vol. 16, 1980, pp. R215-R218.
Sneider, RM et al., "Rock Types, Depositional History, and Diangenetic Effects, Ivishak reservoir Prudhoe Bay Field", *SPE Reservoir Engineering*, Feb. 1997, pp. 23-30.
Soeder, D. J. et al., "Pore Geometry in High- and Low-Permeability Sandstones, Travis Peak Formation, East Texas", *SPE Formation Evaluation*, Dec. 1990, pp. 421-430.
Solomon, A. D. et al., "Moving Boundary Problems in Phase Change Models Current Research Questions", *Engineering Physics and Mathematics Division*, ACM Signum Newsletter, vol. 20, Issue 2, 1985, pp. 8-12.
Somerton, W. H. et al., "Thermal Expansion of Fluid Saturated Rocks Under Stress", SPWLA Twenty-Second Annual Logging Symposium, Jun. 1981, pp. 1-8.
Sousa, L. M. O. et al., "Influence of Microfractures and Porosity on the Physico-Mechanical Properties and Weathering of Ornamental Granites", *Engineering Geology*, vol. 77, 2005, pp. 153-168.
Sousa, Luis M. O. et al., "Influence of microfractures and porosity on the physico-mechanical properties and weathering of ornamental granites", *Engineering Geology*, vol. 77, 2005, pp. 153-168.
Stone, Charles M. et al., "Qualification of a Computer Program for Drill String Dynamics", *Sandia National Laboratories*, SAND-85-0633C, 1985, pp. 1-20.
Stowell, J. F. W., "Characterization of Opening-Mode Fracture Systems in the Austin Chalk", *Gulf Coast Association of Geological Societies Transactions*, vol. L1, 2001, pp. 313-320.
Straka, W. A. et al., "Cavitation Inception in Quiescent and Co-Flow Nozzle Jets", 9th International Conference on Hydrodynamics, Oct. 2010, pp. 813-819.
Suarez, M. C. et al., "COMSOL in a New Tensorial Formulation of Non-Isothermal Poroelasticity", publisher unknown, while the date of the publication is unknown, it is believed to be prior to Aug. 19, 2009,2 pages.
Summers, D. A., "Water Jet Cutting Related to Jet & Rock Properties", publisher unknown, while the date of the publication is unknown, it is believed to be prior to Aug. 19, 2009, 13 pages.
Suwarno, et al., "Dielectric Properties of Mixtures Between Mineral Oil and Natural Ester from Palm Oil", *WSEAS Transactions on Power Systems*, vol. 3, Issue 2, Feb. 2008, pp. 37-46.
Takarli, Mokhfi et al., "Damage in granite under heating/cooling cycles and water freeze-thaw condition", *International Journal of Rock Mechanics and Mining Sciences*, vol. 45, 2008, pp. 1164-1175.
Tanaka, K. et al., "The Generalized Relationship Between the Parameters *C* and *m* of Paris' Law for Fatigue Crack Growth", *Scripta Metallurgica*, vol. 15, No. 3, 1981, pp. 259-264.
Tang, C. A. et al., "Numerical Studies of the Influence of Microstructure on Rock Failure in Uniaxial Compression—Park I: Effect of Heterogeneity", *International Journal of Rock Mechanics and Mining Sciences*, vol. 37, 2000, pp. 555-569.
Tang, C. A. et al., "Coupled analysis of flow, stress and damage (FSD) in rock failure", *International Journal of Rock Mechanics and Mining Sciences*, vol. 39, 2002, pp. 477-489.
Tao, Q. et al., "A Chemo-Poro-Thermoelastic Model for Stress/Pore Pressure Analysis around a Wellbore in Shale", a paper prepared for presentation at the Symposium on Rock Mechanics (USRMS): *Rock Mechanics for Energy*, Mineral and Infrastructure Development in the Northern Regions, Jun. 2005, 7 pages.
Terra, O. et al., "Brillouin Amplification in Phase Coherent Transfer of Optical Frequencies over 480 km Fiber", publisher unknown, while the date of the publication is unknown, it is believed to be prior to Aug. 19, 2009, 9 pages.
Terzopoulos, D. et al., "Modeling Inelastic Deformation: Viscoelasticity, Plasticity, Fracture", *SIGGRAPH '88*, Aug. 1988, pp. 269-278.
Thomas, R. P., "Heat Flow Mapping at the Geysers Geothermal Field", published by the California Department of Conservation Division of Oil and Gas, 1986, 56 pages.
Thompson, G. D., "Effects of Formation Compressive Strength on Perforator Performance", a paper presented of the Southern District API Division of Production, Mar. 1962, pp. 191-197.
Thorsteinsson, Hildigunnur et al., "The Impacts of Drilling and Reservoir Technology Advances on EGS Exploitation", *Proceedings, Thirty-Third Workshop on Geothermal Reservoir Engineering, Institute for Sustainable Energy, Environment, and Economy* (*ISEEE*), 2008, pp. 1-14.
Tovo, R. et al., "Fatigue Damage Evaluation on Mechanical Components Under Multiaxial Loadings", excerpt from the Proceedings of the COMSOL Conference, 2009, 8 pages.
Tuler, F. R. et al., "A Criterion for the Time Dependence of Dynamic Fracture", *The International Jopurnal of Fracture Mechanics*, vol. 4, No. 4, Dec. 1968, pp. 431-437.
Turner, D. et al., "New DC Motor for Downhole Drilling and Pumping Applications", a paper prepared for presentation at the SPE/ICoTA Coiled Tubing Roundtable, Mar. 2001, pp. 1-7.
Turner, D. R. et al., "The All Electric BHA: Recent Developments Toward an Intelligent Coiled-Tubing Drilling System", a paper prepared for presentation at the 1999 SPE/ICoTA Coiled Tubing Roundtable, May 1999, pp. 1-10.
Tutuncu, A. N. et al., "An Experimental Investigation of Factors Influencing Compressional- and Shear-Wave Velocities and Attenuations in Tight Gas Sandstones", *Geophysics*, vol. 59, No. 1, Jan. 1994, pp. 77-86.
U.S. Dept of Energy, "Chapter 6—Drilling Technology and Costs", from Report for the Future of Geothermal Energy, 2005, 53 pgs.
U.S. Appl. No. 12/840,978, filed Jul. 21, 2009, 61 pgs.
Udd, E. et al., "Fiber Optic Distributed Sensing Systems for Harsh Aerospace Environments", publisher unknown, while the date of the publication is unknown, it is believed to be prior to Aug. 19, 2009, 12 pages.
Valsangkar, A. J. et al., Stress-Strain Relationship for Empirical Equations of Creep in Rocks, *Engineering Geology*, Mar. 29, 1971, 5 pages.
Varnado, S. G. et al., "The Design and Use of Polycrystalline Diamond Compact Drag Bits in the Geothermal Environment", *Society of Petroleum Engineers of AIME*, SPE 8378, 1979, pp. 1-11.
Wagh, A. S. et al., "Dependence of Ceramic Fracture Properties on Porosity", *Journal of Material Sience*, vol. 28, 1993, pp. 3589-3593.
Wagner, F. et al., "The Laser Microjet Technology—10 Years of Development (M401)", publisher unknown, while the date of the publication is unknown, it is believed to be prior to Aug. 19, 2009, 9 pages.
Waldron, K. et al., "The Microstructures of Perthitic Alkali Feldspars Revealed by Hydroflouric Acid Etching", *Contributions to Mineralogy and Petrology*, vol. 116, 1994, pp. 360-364.
Walker, B. H. et al., "Roller-Bit Penetration Rate Response as a Function of Rock Properties and Well Depth", a paper prepared for presentation at the 61st Annual Technical Conference and Exhibition of the Society of Petroleum Engineers, Oct. 1986, 12 pages.
Wandera, C. et al., "Characterization of the Melt Removal Rate in Laser Cutting of Thick-Section Stainless Steel", *Journal of Laser Applications*, vol. 22, No. 2, May 2010, pp. 62-70.
Wandera, C. et al., "Inert Gas Cutting of Thick-Section Stainless Steel and Medium Section Aluminun Using a High Power Fiber Laser", *Journal of Chemical Physics*, vol. 116, No. 4, Jan. 22, 2002, pp. 154-161.
Wandera, C. et al., "Laser Power Requirement for Cutting of Thick-Section Steel and Effects of Processing Parameters on Mild Steel Cut Quality", a paper accepted for publication in the Proceedings IMechE Part B, *Journal of Engineering Manufacture*, vol. 225, 2011, 23 pages.
Wandera, C. et al., "Optimization of Parameters for Fiber Laser Cutting of 10mm Stainless Steel Plate", a paper for publication in the Proceeding IMechE Part B, *Journal of Engineering Manufacture*, vol. 225, 2011, 22 pages.
Wandera, C., "Performance of High Power Fibre Laser Cutting of Thick-Section Steel and Medium-Section Aluminium", a thesis for the degree of Doctor of Science (Technology) at, Lappeenranta University of Technology, Oct. 2010, 74 pages.

(56) References Cited

OTHER PUBLICATIONS

Wang, C. H., "Introduction to Fractures Mechanics", published by DSTO Aeronautical and Maritime Research Laboratory, Jul. 1996, 82 pages.
Wang, G. et al., "Particle Modeling Simulation of Thermal Effects on Ore Breakage", *Computational Materials Science*, vol. 43, 2008, pp. 892-901.
Waples, D. W. et al., "A Review and Evaluation of Specific Heat Capacities of Rocks, Minerals, and Subsurface Fluids. Part 1: Minerals and NonporoRocks", *Natural Resources Research*, vol. 13, No. 2, Jun. 2004, pp. 97-122.
Waples, D. W. et al., "A Review and Evaluation of Specific Heat Capacities of Rocks, Minerals, and Subsurface Fluids. Part 2: Fluids and PoroRocks", *Natural Resources Research*, vol. 13 No. 2, Jun. 2004, pp. 123-130.
Warren, T. M. et al., "Laboratory Drilling Performance of PDC Bits", *SPE Drilling Engineering*, Jun. 1988, pp. 125-135.
Wen-gui, Cao et al., "Damage constituitive model for strain-softening rock based on normal distribution and its parameter determination", *J. Cent. South Univ. Technol.*, vol. 14, No. 5, 2007, pp. 719-724.
White, E. J. et al., "Reservoir Rock Characteristics of the Madison Limestone in the Williston Basin", *The Log Analyst*, Sep.-Oct. 1970, pp. 17-25.
White, E. J. et al., "Rock Matrix Properties of the Ratcliffe Interval (Madison Limestone) Flat Lake Field, Montana", *SPE of AIME*, Jun. 1968, 16 pages.
Wiercigroch, M., "Dynamics of ultrasonic percussive drilling of hard rocks", *Journal of Sound and Vibration*, vol. 280, 2005, pp. 739-757.
Wilkinson, M. A. et al., "Experimental Measurement of Surface Temperatures During Flame-Jet Induced Thermal Spallation", *Rock Mechanics and Rock Engineering*, 1993, pp. 29-62.
Williams, R. E. et al., "Experiments in Thermal Spallation of VarioRocks", *Transactions of the ASME*, vol. 118, 1996, pp. 2-8.
Willis, David A. et al., "Heat transfer and phase change during picosecond laser ablation of nickel", *International Journal of Heat and Mass Transfer*, vol. 45, 2002, pp. 3911-3918.
Winters, W. J. et al., "Roller Bit Model with Rock Ductility and Cone Offset", a paper prepared for presentation at 62nd Annual Technical Conference and Exhibition of the Society of Petroleum Engineers, Sep. 1987, 12 pages.
Wippich, M. et al., "Tunable Lasers and Fiber-Bragg-Grating Sensors", Obatined from the at: from the Internet website of The Industrial Physicist at: http://www.aip.org/tip/INPHFA/vol-9/iss-3/p24.html, on May 18, 2010, pp. 1-5.
Wong, Teng-fong et al., "Microcrack statistics, Weibull distribution and micromechanical modeling of compressive failure in rock", *Mechanics of Materials*, vol. 38, 2006, pp. 664-681.
Wood, Tom, "Dual Purpose COTD™ Rigs Establish New Operational Records", *Treme Coil Drilling Corp., Drilling Technology Without Borders*, 2009, pp. 1-18.
Wu, X. Y. et al., "The Effects of Thermal Softening and Heat Conductin on the Dynamic Growth of Voids", *International Journal of Solids and Structures*, vol. 40, 2003, pp. 4461-4478.
Xia, K. et al., "Effects of microstructures on dynamic compression of Barre granite", *International Journal of Rock Mechanics and Mining Sciences*, vol. 45, 2008. pp. 879-887, available at: www.sciencedirect.com.
Xiao, J. Q. et al., "Inverted S-Shaped Model for Nonlinear Fatigue Damage of Rock", *International Journal of Rock Mechanics & Mining Sciences*, vol. 46, 2009, pp. 643-648.
Xu, Z et al. "Modeling of Laser Spallation Drilling of Rocks fro gas-and Oilwell Drilling", *Society of Petroleum Engineers*, SPE 95746, 2005, pp. 1-6.
Xu, Z. et al., "Application of High Powered Lasers to Perforated Completions", *International Congress on Applications of Laser & Electro-Optics*, Oct. 2003, 6 pages.
Xu, Z. et al., "Laser Rock Drilling by a Super-Pulsed CO2 Laser Beam", a manuscript created for the Department of Energy, while the date of the publication is unknown, it is believed to be prior to Aug. 19, 2009, 9 pages.
Xu, Z. et al., "Laser Spallation of Rocks for Oil Well Drilling", Proceedings of the 23rd International Congress on Applications of Lasers and Electro-Optics, 2004, pp. 1-6.
Xu, Z. et al., "Modeling of Laser Spallation Drilling of Rocks for Gas-and Oilwell Drilling", a paper prepared for the presentation at the 2005 SPE (Society of Petroleum Engineers) Annual Technical Conference and Exhibition, Oct. 2005, 6 pages.
Xu, Z. et al., "Rock Perforation by Pulsed Nd: YAG Laser", Proceedings of the 23rd International Congress on Applications of Lasers and Electro-Optics 2004, 2004, 5 pages.
Xu, Z. et al., "Specific Energy of Pulsed Laser Rock Drilling", *Journal of Laser Applications*, vol. 15, No. 1, Feb. 2003, pp. 25-30.
Xu, Z. et al., "Specific Energy for Laser Removal of Rocks", *Proceedings of the 20th International Congress on Applications of Lasers & Electro-Optics*, 2001, pp. 1-8.
Xu, Z. et al., "Specific energy for pulsed laser rock drilling", *Journal of Laser Applications*, vol. 15, No. 1, 2003, pp. 25-30.
Xu, Zhiyue et al., "Laser Spallation of Rocks for Oil Well Drilling", *Proceedings of the 23rd International Congress on Applications of Lasers and Electro-Optics*, 2004, pp. 1-6.
Yabe, T. et al., "The Constrained Interpolation Profile Method for Multiphase Analysis", *Journal of Computational Physics*, vol. 169, 2001, pp. 556-593.
Yamamoto, K. Y. et al., "Detection of Metals in the Environment Using a Portable Laser-Induced Breakdown Spectroscopy Instrument", *Applied Spectroscopy*, vol. 50, No. 2, 1996, pp. 222-233.
Yamashita, Y. et al., "Underwater Laser Welding by 4kW CW YAG Laser", *Journal of Nuclear Science and Technology*, vol. 38, No. 10, Oct. 2001, pp. 891-895.
Yamshchikov, V. S. et al., "An Evaluation of the Microcrack Density of Rocks by Ultrasonic Velocimetric Method", *Moscow Mining Institute. (Translated from Fiziko-Tekhnicheskie Problemy Razrabotki Poleznykh Iskopaemykh)*, 1985, pp. 363-366.
Yasar, E. et al., "Determination of the Thermal Conductivity from Physico-Mechanical Properties", *Bull Eng. Geol. Environ.*, vol. 67, 2008, pp. 219-225.
Yilbas, B. S. et al., "Laser short pulse heating: Influence of pulse intensity on temperature and stress fields", *Applied Surface Science*, vol. 252, 2006, pp. 8428-8437.
Yilbas, B. S. et al., "Laser treatment of aluminum surface: Analysis of thermal stress field in the irradiated región", *Journal of Materials Processing Technology*, vol. 209, 2009, pp. 77-88.
Yilbas, B. S. et al., "Nano-second laser pulse heating and assisting gas jet considerations", *International Journal of Machine Tools & Manufacture*, vol. 40, 2000, pp. 1023-1038.
Yilbas, B. S. et al., "Repetitive laser pulse heating with a convective boundary condition at the surface", *Journal of Physics D: Applied Physics*, vol. 34, 2001, pp. 222-231.
York, J. L. et al., "The Influence of Flashing and Cavitation on Spray Formation", a progress report for UMRI Project 2815 with Delavan Manufacturing Company, Oct. 1959, 27 pages.
Yun, Yingwei et al., "Thermal Stress Distribution in Thick Wall Cylinder Under Thermal Shock", *Journal of Pressure Vessel Technology, Transactions of the ASME*, 2009, vol. 131, pp. 1-6.
Zamora, M. et al., "An Empirical Relationship Between Thermal Conductivity and Elastic Wave Velocities in Sandstone", *Geophysical Research Letters*, vol. 20, No. 16, Aug. 20, 1993, pp. 1679-1682.
Zehnder, A. T., "Lecture Notes on Fracture Mechanics", 2007, 227 pages.
Zeng, Z. W. et al., "Experimental Determination of Geomechanical and Petrophysical Properties of Jackfork Sandstone—A Tight Gas Formation", a paper prepared for the presentation at the 6th North American Rock Mechanics Symposium (NARMS): *Rock Mechanics Across Borders and Disciplines*, Jun. 2004, 9 pages.
Zeuch, D. H. et al., "Rock Breakage Mechanisms With a PDC Cutter", a paper prepared for presentation at the 60th Annual Technical Conference and Exhibition of the Society of Petroleum Engineers, Sep. 1985, 12 pages.
Zeuch, D.H. et al., "Rock Breakage Mechanism Wirt A PDC Cutter", *Society of Petroleum Engineers, 60th Annual Technical Conference*, Las Vegas, Sep. 22-25, 1985, 11 pgs.

(56) References Cited

OTHER PUBLICATIONS

Zhai, Yue et al., "Dynamic failure analysis on granite under uniaxial impact compressive load", *Front. Archit. Civ. Eng. China*, vol. 2, No. 3, 2008, pp. 253-260.
Zhang, L. et al., "Energy from Abandoned Oil and Gas Reservoirs", a paper prepared for presentation at the 2008 SPE (Society of Petroleum Engineers) Asia Pacific Oil & Gas Conference and Exhibition, 2008, pp. 1-10.
Zheleznov, D. S. et al., "Faraday Rotators With Short Magneto-Optical Elements for 50-kW Laser Power", *IEEE Journal of Quantum Electronics*, vol. 43, No. 6, Jun. 2007, pp. 451-457.
Zhou, T. et al., "Analysis of Stimulated Brillouin Scattering in Multi-Mode Fiber by Numerical Solution", *Journal of Zhejiang University of Science*, vol. 4 No. 3, May-Jun. 2003, pp. 254-257.
Zhou, X.P., "Microcrack Interaction Brittle Rock Subjected to Uniaxial Tensile Loads", *Theoretical and Applied Fracture Mechanics*, vol. 47, 2007, pp. 68-76.
Zhou, Zehua et al., "A New Thermal-Shock-Resistance Model for Ceramics: Establishment and validation", *Materials Science and Engineering*, A 405, 2005, pp. 272-276.
Zhu, Dongming et al., "Influence of High Cycle Thermal Loads on Thermal Fatigue Behavior of Thick Thermal Barrier Coatings", *National Aeronautics and Space Administration, Army Research Laboratory*, Technical Report ARL-TR-1341, NASA TP-3676, 1997, pp. 1-50.
Zhu, Dongming et al., "Investigation of thermal fatigue behavior of thermal barrier coating systems", *Surface and Coatings Technology*, vol. 94-95, 1997, pp. 94-101.
Zhu, Dongming et al., "Investigation of Thermal High Cycle and Low Cycle Fatigue Mechanisms of Thick Thermal Barrier Coatings", *National Aeronautics and Space Administration, Lewis Research Center*, NASA/TM-1998-206633, 1998, pp. 1-31.
Zhu, Dongming et al., "Thermophysical and Thermomechanical Properties of Thermal Barrier Coating Systems", *National Aeronautics and Space Administration, Glenn Research Center*, NASA/TM-2000-210237, 2000, pp. 1-22.
Zhu, X. et al., "High-Power ZBLAM Glass Fiber Lasers: Review and Prospect", *Advances in OptoElectronics*, vol. 2010, pp. 1-23.
Zietz, J. et al., "Determinants of House Prices: A Quantile Regression Approach", *Department of Economics and Finance Working Paper Series*, May 2007, 27 pages.
Zuckerman, N. et al., "Jet Impingement Heat Transfer: Physics, Correlations, and Numerical Modeling", *Advances in Heat Transfer*, vol. 39, 2006, pp. 565-631.
A Built-for-Purpose Coiled Tubing Rig, by Schulumberger Wells, No. DE-PS26-03NT15474, 2006, 1 pg.
"Chapter I—Laser-Assisted Rock-Cutting Tests", publisher unknown, while the date of the publication is unknown, it is believed to be prior to Aug. 19, 2009, 64 pages.
"Chapter 7: Energy Conversion Systems—Options and Issues", publisher unknown, while the date of the publication is unknown, it is believed to be prior to Aug. 19, 2009, pp. 7-1 to 7-32 and table of contents page.
"Cross Process Innovations", Obtained from the Internet at: http://www.mrl.columbia.edu/ntm/CrossProcess/CrossProcessSect5.htm, on Feb. 2, 2010, 11 pages.
"Fourier Series, Generalized Functions, Laplace Transform", publisher unknown, while the date of the publication is unknown, it is believed to be prior to Aug. 19, 2009, 6 pages.
"Introduction to Optical Liquids", published by Cargille-Sacher Laboratories Inc., Obtained from the Internet at: http://www.cargille.com/opticalintro.shtml, on Dec. 23, 2008, 5 pages.
"Laser Drilling", Oil & Natural Gas Projects (Exploration & Production Technologies) Technical Paper, Dept. of Energy, Jul. 2007, 3 pages.
"Leaders in Industry Luncheon", IPAA & TIPRO, Jul. 8, 2009, 19 pages.
"Measurement and Control of Abrasive Water-Jet Velocity", publisher unknown, while the date of the publication is unknown, it is believed to be prior to Aug. 19, 2009, 8 pages.
"NonhomogeneoPDE—Heat Equation with a Forcing Term", a lecture, 2010, 6 pages.
"Performance Indicators for Geothermal Power Plants", prepared by International Geothermal Association for World Energy Council Working Group on Performance of Renewable Energy Plants, author unknown, Mar. 2011, 7 pages.
"Rock Mechanics and Rock Engineering", publisher unknown, while the date of the publication is unknown, it is believed to be prior to Aug. 19, 2009, 69 pages.
"Shock Tube", Cosmol MultiPhysics 3.5a, 2008, 5 pages.
"Silicone Fluids: Stable, Inert Media", Gelest, Inc., while the date of the publication is unknown, it is believed to be prior to Aug. 19, 2009, 27 pages.
"Stimulated Brillouin Scattering (SBS) in Optical Fibers", Centro de Pesquisa em Optica e Fotonica, Obtained from the Internet at: http://cepof.ifi.unicamp.br/index.php . . . ), on Jun. 25, 2012, 2 pages.
"Underwater Laser Cutting", TWI Ltd, May/Jun. 2011, 2 pages.
Utility U.S. Appl. No. 13/768,149, filed Feb. 15, 2013, 27 pages.
Utility U.S. Appl. No. 13/777,650, filed Feb. 26, 2013, 73 pages.
Utility U.S. Appl. No. 13/782,869, filed Mar. 1, 2013, 80 pages.
Utility U.S. Appl. No. 13/782,942, filed Mar. 1, 2013, 81 pages.
Utility U.S. Appl. No. 13/800,559, filed Mar. 13, 2013, 73 pages.
Utility U.S. Appl. No. 13/800,820, filed Mar. 13, 2013, 73 pages.
Utility U.S. Appl. No. 13/800,879, filed Mar. 13, 2013, 73 pages.
Utility U.S. Appl. No. 13/800,933, filed Mar. 13, 2013, 73 pages.
Utility U.S. Appl. No. 13/849,831, filed Mar. 25, 2013, 83 pages.
Office Action from JP Application No. 2011-551172 dated Sep. 17, 2013.
Office Action from JP Application No. 2011-523959 dated Aug. 27, 2013.
Office Action regarding corresponding Chinese Patent Application 200980141304.7 dated Mar. 5, 2013, 6 pages with English-language translation, 11 pages.

* cited by examiner

| Item | Subsystem | Device | Location | Parameter | Monitor/Control | Interlock | Interface |
|---|---|---|---|---|---|---|---|
| 1 | Laser | IPG YLS-20000 | Laser Housing | Power set point | Control | Yes | 0-10V direct |
| 2 | | | | Power status | Monitor | Yes | .DLL |
| 3 | | | | Power on/off | Control | Yes | .DLL |
| 4 | | | | Back reflection | Monitor | Yes | 0-10V direct |
| 5 | | | | Interlocks status | Monitor | ---- | .DLL |
| 6 | | | | Emergency stop | Control | Yes | 0/10V direct |
| 7 | | | | Emission status | Monitor | Yes | 0/10V direct |
| 8 | | | | Laser ready status | Monitor | Yes | 0/10V direct |
| 9 | | | | PC control status | Monitor | Yes | 0/10V direct |
| 10 | | | | Analog control status | Control | Yes | 0/10V direct |
| 11 | | | | Safety circuit status | Control | Yes | Relay |
| 12 | | | | Channel selection | Control | Yes | 0/10V direct |
| 13 | | | | Chiller warnings | Monitor | Yes | .DLL |
| 14 | | | | Chiller error status | Monitor | Yes | .DLL |
| 15 | | | | Faults | Monitor | Yes | .DLL |
| 16 | Rig (PLC system) | Load cell | Field | WOB | Monitor | Yes | 4-20 mA direct |
| 17 | | Depth encoders | | Depth 1 | Monitor | No | 5V pulses |
| 18 | | | | Depth 2 | Monitor | No | 5V pulses |
| 19 | | | | Rate of penetration (ROP) | Calculate | No | ---- |
| 20 | | Pressure transducer | | SP pressure | Monitor | No | 4-20 mA direct |
| 21 | Compressed Air (N2) Flow | Neles Rotary valve | Field | On/off | Control | NA | NA |
| 22 | | | | Valve open | Control | No | Direct |
| 23 | | | | Valve open read back | Monitor | Yes | Direct |
| 24 | | | | Flow rate | Control | No | .DLL |
| 25 | | Vortek Flow meter | | On/off | Control | ---- | NA |
| 26 | | | | Flow rate | Monitor | No | 4-20 mA direct |
| 27 | Oil Injection Valve | Solenoid Valve | Field | Open/close | Control | No | 0/24V direct |
| 28 | Pressure sensor at oil injection | Pressure transducer | Field | N2 pressure at oil injection junction | Monitor | No | 4-20 mA direct |
| 29 | Accelerometers | 3-axis accel. | BHA | RPM of motor | Monitor | No | 0-5V |
| 30 | | 1-axis accel. | OSR | OSR vibration | Monitor | No | 0-5V |
| 31 | Optical Slip Ring | Water flow meter | Laser Housing | Cooling fluid flow | Monitor | Yes | 4-20 mA direct |
| 32 | | Air flow meter | Laser Housing | Air flow | Monitor | Yes | 4-20 mA direct |
| 33 | | Photodiode 1 | OSR | Stray light | Monitor | | 0-10V direct |
| 34 | | Photodiode 2 | OSR | Stray light | Monitor | Yes | 0-10V direct |
| 35 | | Photodiode | OSR | Water Leak | Monitor | Yes | 0-15V direct |
| 36 | Splice Monitor | Photodiode | Hub | laser light at splice | Monitor | No | 0-5V |
| 37 | E-Stops and Hazard Lights | E-stop | Field | Continuity | Monitor/Control | Yes | 0/24V direct |

Fig. 1A

Male connector configuration

| | A | B | C | D | Device |
|---|---|---|---|---|---|
| 1 | 202 Red | 202 Green | 202 White | | OSR PD'S |
| 2 | | | | | |
| 3 | 206 Black | | | 206 White | Flow meter |
| 4 | | | | | |
| 5 | | | | | |
| 6 | | 238 White | | 238 Black | Solenoid |
| 7 | 317 Black | 317 White | 217 Black | 217 White | E-stops |
| 8 | | 236 White | 236 Green | | Oil pres. sensor |
| 9 | | | 236 Black | 236 Red | Oil pres. power |
| 10 | 200 White | 200 Green | 200 Red | | OSR power |
| 11 | | | | | |
| 12 | 230 White | 230 Black | | | WOB |
| 13 | 231 White | 231 Black | | | Rig pressure |
| 14 | 230 Red | 232 Green | 233 Red | 233 Green | Encoder 1, 2 |
| 15 | | 232 Black | 233 Black | | Encoder GND |
| 16 | 202 Black | 200 Black | 233 White | 232 White | N/A |

1015

Female connector configuration

| | A | B | C | D | Device |
|---|---|---|---|---|---|
| 1 | 102 Red | 102 Green | 102 White | | NI 9201 |
| 2 | | | | | |
| 3 | 106 Black | | | 106 White | Flow meter |
| 4 | 109 Black | | | 109 White | Valve monitor |
| 5 | 111 White | | 111 Black | | Valve open |
| 6 | | 138 White | | 138 Black | Solenoid |
| 7 | 117 Black | C7 | B7 | 117 White | E-stops |
| 8 | | 136 White | 136 Black | | Oil pres. sensor |
| 9 | | | 137 Black | 137 White | Oil pres. power |
| 10 | 100 White | 100 Black | 100 Red | | OSR power |
| 11 | | | | | |
| 12 | 130 White | 130 Black | | | WOB |
| 13 | 131 White | 131 Black | | | Rig pressure |
| 14 | 132 White | 132 Black | 133 White | 133 Black | Encoder 1, 2 |
| 15 | | 135 Black | 135 White | | Encoder GND |
| 16 | | | | | |

Fig. 1E

LEAK SENSOR LOW POINT ORIENTATION

| Time stamp | Time Elapsed | Laser Power Output (W) | Weight on Bit (lbs) | Rig Air Flow Rate (ft3/m) | Rig Pressure (psi) | RPM | ROP (ft/m) | Depth 1 (ft) | Depth 2 (ft) | Oil Pressure (psi) |
|---|---|---|---|---|---|---|---|---|---|---|
| 11/30/10 1:30 PM | 0.0 | -0.078 | -93030 | -500 | -1249.962 | 223 | 0 | 0 | 0 | -2.354 |
| 11/30/10 1:30 PM | 0.1 | -0.078 | -93028. 665 | -500 | -1249.962 | 223 | 0 | 0 | 0 | -2.354 |

| Laser Back Reflection (V) | Max OSR Vibration (g) | OSRPD1 (V) | OSRPD2 (V) | OSR Leak (V) | OSR Purge Gas Flow Rate (L/m) | OSR Cooling Fluid Flow Rate (L/m) | Oil injection Pump Open Out | Rig Air Valve Opening (%) | Laser Power Setpoint (W) | Laser OK Mon |
|---|---|---|---|---|---|---|---|---|---|---|
| 0.001 | 0 | 0.001 | 0.001 | 0.001 | -3.75 | -1 | No | -25 | 0 | No |
| 0.001 | 0.004 | 0.001 | 0.001 | 0.001 | -3.75 | -1 | No | -25 | 0 | No |

| Laser Error Mon | Emission Mon | E-stop Mon | Interlocked by FPGA | Min Laser Back Reflection | Max Laser Back Reflection | Min Rig Air Flow Rate | Min Rig Pressure | Max Rig Pressure | Min Oil Pressure | Max OSR PD |
|---|---|---|---|---|---|---|---|---|---|---|
| No | No | Yes | No | No | No | No | No | No | No | No |
| No | No | Yes | No | No | No | No | Yes | No | Yes | No |

| Max OSR Leak | Min OSR Pure Gas Flow | Min OSR Cooling Fluid Flow | Rig Air Valve Mismatch | Chiller Warning Mon | Chiller Error Mon | PC Control Mon | Analog Control Mon | Rig Air Valve Opening Setpoint (%) | Rig Air Flow Rate Setpoint (ft3/m) | Laser Interlock 1 Out |
|---|---|---|---|---|---|---|---|---|---|---|
| No | No | No | No | No | No | No | No | 0 | 0 | Yes |
| No | Yes | No | Yes | No | No | No | No | 0 | 0 | Yes |

| Laser Interlock 2 Out | SC Connection Out | Remote Enable Out | Laser Request Out | Program Start Out | Analog Control Out | Beam SW Ch b0 Out | Beam SW Ch b1 Out |
|---|---|---|---|---|---|---|---|
| Yes | No | Yes | Yes | Yes | Yes | | |
| Yes | No | Yes | Yes | Yes | Yes | | |

Fig. 1R

CONTROL SYSTEM FOR HIGH POWER LASER DRILLING WORKOVER AND COMPLETION UNIT

This application: (i) claims, under 35 U.S.C. §119(e)(1), the benefit of the filing date of Feb. 24, 2011 of U.S. provisional application Ser. No. 61/446,412; (ii) claims, under 35 U.S.C. §119(e)(1), the benefit of the filing date of Feb. 24, 2011 of U.S. provisional application Ser. No. 61/446,312; (iii) claims, under 35 U.S.C. §119(e)(1), the benefit of the filing date of Feb. 24, 2011 of U.S. provisional application Ser. No. 61/446,407; (iv) is a continuation-in-part of U.S. patent application Ser. No. 13/210,581 filed Aug. 16, 2011 now U.S. Pat. No. 8,662,160, which is a continuation-in-part of U.S. patent application Ser. No. 12/544,136 filed Aug. 19, 2009 now U.S. Pat. No. 8,511,401, which claims under 35 U.S.C. §119(e)(1) the benefit of the filing date of Feb. 17, 2009 of U.S. provisional application Ser. No. 61/153,271, the benefit of the filing date of Oct. 17, 2008 of U.S. provisional application Ser. No. 61/106,472, the benefit of the filing date of Oct. 3, 2008 of U.S. provisional application Ser. No. 61/102,730, and the benefit of the filing date of Aug. 20, 2008 of U.S. provisional application Ser. No. 61/090,384; (v) is a continuation-in-part of U.S. patent application Ser. No. 12/544,136 filed Aug. 19, 2009 now U.S. Pat. No. 8,511,401, which claims under 35 U.S.C. §119(e)(1) the benefit of the filing date of Feb. 17, 2009 of U.S. provisional application Ser. No. 61/153,271, the benefit of the filing date of Oct. 17, 2008 of U.S. provisional application Ser. No. 61/106,472, the benefit of the filing date of Oct. 3, 2008 of U.S. provisional application Ser. No. 61/102,730, and the benefit of the filing date of Aug. 20, 2008 of U.S. provisional application Ser. No. 61/090,384; (vi) is a continuation-in-part of U.S. patent application Ser. No. 12/543,986 filed Aug. 19, 2009 now U.S. Pat. No. 8,826,973, which claims under 35 U.S.C. §119(e)(1) the benefit of the filing date of Feb. 17, 2009 of U.S. provisional application Ser. No. 61/153,271, the benefit of the filing date of Oct. 17, 2008 of U.S. provisional application Ser. No. 61/106,472, the benefit of the filing date of Oct. 3, 2008 of U.S. provisional application Ser. No. 61/102,730, and the benefit of the filing date of Aug. 20, 2008 of U.S. provisional application Ser. No. 61/090,384; and, (vii) claims, under 35 U.S.C. §119(e)(1), the benefit of the filing date of Feb. 24, 2011 of U.S. provisional application Ser. No. 61/446,042, the entire disclosures of each of which are incorporated herein by reference.

This invention was made with Government support under Award DE-AR0000044 awarded by the Office of ARPA-E U.S. Department of Energy. The Government has certain rights in this invention.

BACKGROUND OF THE INVENTION

Field of the Invention

The present inventions relate to high power laser systems and units and high power laser-mechanical tools systems and units, such as for example drilling, workover and completion, perforating, decommissioning, cleaning, mining, and laser pigging units; and, in particular to control systems and monitoring systems for high power laser systems and units.

As used herein, unless specified otherwise "high power laser energy" means a laser beam having at least about 1 kW (kilowatt) of power. As used herein, unless specified otherwise "great distances" means at least about 500 m (meter). As used herein, unless specified otherwise, the term "substantial loss of power," "substantial power loss" and similar such phrases, mean a loss of power of more than about 3.0 dB/km (decibel/kilometer) for a selected wavelength. As used herein, unless specified otherwise, the term "substantial power transmission" means at least about 50% transmittance.

As used herein the term "pipeline" should be given its broadest possible meaning, and includes any structure that contains a channel having a length that is many orders of magnitude greater than its cross-sectional area and which is for, or capable of, transporting a material along at least a portion of the length of the channel. Pipelines may be many miles long and may be many hundreds of miles long. Pipelines may be located below the earth, above the earth, under water, within a structure, or combinations of these and other locations. Pipelines may be made from metal, steel, plastics, ceramics, composite materials, or other materials and compositions know to the pipeline arts and may have external and internal coatings, known to the pipeline arts. In general, pipelines may have internal diameters that range from about 2 to about 60 inches although larger and smaller diameters may be utilized. In general natural gas pipelines may have internal diameters ranging from about 2 to 60 inches and oil pipelines have internal diameters ranging from about 4 to 48 inches. Pipelines may be used to transmit numerous types of materials, in the form of a liquid, gas, fluidized solid, slurry or combinations thereof. Thus, for example pipelines may carry hydrocarbons; chemicals; oil; petroleum products; gasoline; ethanol; biofuels; water; drinking water; irrigation water; cooling water; water for hydroelectric power generation; water, or other fluids for geothermal power generation; natural gas; paints; slurries, such as mineral slurries, coal slurries, pulp slurries; and ore slurries; gases, such as nitrogen and hydrogen; cosmetics; pharmaceuticals; and food products, such as beer.

Pipelines may be, in part, characterized as gathering pipelines, transportation pipelines and distribution pipelines, although these characterizations may be blurred and may not cover all potential types of pipelines. Gathering pipelines are a number of smaller interconnected pipelines that form a network of pipelines for bringing together a number of sources, such as for example bringing together hydrocarbons being produced from a number of wells. Transportation pipelines are what can be considered as a traditional pipeline for moving products over longer distances for example between two cities, two countries, and a production location and a shipping, storage or distribution location. The Alaskan oil pipeline is an example of a transportation pipeline. Distribution pipelines can be small pipelines that are made up of several interconnected pipelines and are used for the distribution to for example an end user, of the material that is being delivered by the pipeline, such as for example the feeder lines used to provide natural gas to individual homes. As used herein the term pipeline includes all of these and other characterizations of pipelines that are known to or used in the pipeline arts.

As used herein the term "pig" is to be given its broadest possible meaning and includes all devices that are known as or referred to in the pipeline arts as a "pig" and would include any device that is inserted into and moved along at least a portion of the length of a pipeline to perform activities such as inspecting, cleaning, measuring, analyzing, maintaining, welding, assembling, or other activities known to the pipeline arts. In general, pigs are devices that may be unitary devices, as simple as a foam or metal ball, or a complex multi-component device such as a magnetic flux leakage pig. In general, pigs are devices that when inserted in the pipeline travel along its length and are moved through the pipeline by the flow of the material within the pipe. Pigs may generally be characterized as utility and in-line inspection pigs, although these characterizations may be blurred and may not cover all potential types of pigs. Utility pigs perform such functions as for example cleaning, separation of products and removal of water. In-line inspection pigs, would include gauge pigs, as well as, more complex pigs, which may also be referred to by those of skill in the art as instrument pigs, intelligent pigs or smart pigs. Smart pigs perform such functions as for example supplying information on the condition of the pipeline, as well as on the extent and location of any problems with the pipeline. Pigs are used both during the construction and during the operational life of the pipelines. Pigs may also be used in the decommissioning of a pipeline and its removal.

As used herein, unless specified otherwise, the term "earth" should be given its broadest possible meaning, and includes, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

As used herein, unless specified otherwise, the term "borehole" should be given it broadest possible meaning and includes any opening that is created in a material, a work piece, a surface, the earth, a structure (e.g., building, protected military installation, nuclear plant, offshore platform, or ship), or in a structure in the ground, (e.g., foundation, roadway, airstrip, cave or subterranean structure) that is substantially longer than it is wide, such as a well, a well bore, a well hole, a micro hole, slimhole, a perforation and other terms commonly used or known in the arts to define these types of narrow long passages. Wells would further include exploratory, production, abandoned, reentered, reworked, and injection wells. Although boreholes are generally oriented substantially vertically, they may also be oriented on an angle from vertical, to and including horizontal. Thus, using a vertical line, based upon a level as a reference point, a borehole can have orientations ranging from 0° i.e., vertical, to 90°,i.e., horizontal and greater than 90° e.g., such as a heel and toe and combinations of these such as for example "U" and "Y" shapes. Boreholes may further have segments or sections that have different orientations, they may have straight sections and arcuate sections and combinations thereof; and for example may be of the shapes commonly found when directional drilling is employed. Thus, as used herein unless expressly provided otherwise, the "bottom" of a borehole, the "bottom surface" of the borehole and similar terms refer to the end of the borehole, i.e., that portion of the borehole furthest along the path of the borehole from the borehole's opening, the surface of the earth, or the borehole's beginning. The terms "side" and "wall" of a borehole should to be given their broadest possible meaning and include the longitudinal surfaces of the borehole, whether or not casing or a liner is present, as such, these terms would include the sides of an open borehole or the sides of the casing that has been positioned within a borehole. Boreholes may be made up of a single passage, multiple passages, connected passages and combinations thereof, in a situation where multiple boreholes are connected or interconnected each borehole would have a borehole bottom. Boreholes may be formed in the sea floor, under bodies of water, on land, in ice formations, or in other locations and settings.

Boreholes are generally formed and advanced by using mechanical drilling equipment having a rotating drilling tool, e.g., a bit. For example and in general, when creating a borehole in the earth, a drilling bit is extending to and into the earth and rotated to create a hole in the earth. In general, to perform the drilling operation the bit must be forced against the material to be removed with a sufficient force to exceed the shear strength, compressive strength or combinations thereof, of that material. Thus, in conventional drilling activity mechanical forces exceeding these strengths of the rock or earth must be applied. The material that is cut from the earth is generally known as cuttings, e.g., waste, which may be chips of rock, dust, rock fibers and other types of materials and structures that may be created by the bit's interactions with the earth. These cuttings are typically removed from the borehole by the use of fluids, which fluids can be liquids, foams or gases, or other materials know to the art.

As used herein, unless specified otherwise, the term "advancing" a borehole should be given its broadest possible meaning and includes increasing the length of the borehole. Thus, by advancing a borehole, provided the orientation is not horizontal, e.g., less than 90° the depth of the borehole may also be increased. The true vertical depth ("TVD") of a borehole is the distance from the top or surface of the borehole to the depth at which the bottom of the borehole is located, measured along a straight vertical line. The measured depth ("MD") of a borehole is the distance as measured along the actual path of the borehole from the top or surface to the bottom. As used herein unless specified otherwise the term depth of a borehole will refer to MD. In general, a point of reference may be used for the top of the borehole, such as the rotary table, drill floor, well head or initial opening or surface of the structure in which the borehole is placed.

As used herein, unless specified otherwise, the terms "ream", "reaming", a borehole, or similar such terms, should be given their broadest possible meaning and includes any activity performed on the sides of a borehole, such as, e.g., smoothing, increasing the diameter of the borehole, removing materials from the sides of the borehole, such as e.g., waxes or filter cakes, and under-reaming.

As used herein, unless specified otherwise, the terms "drill bit", "bit", "drilling bit" or similar such terms, should be given their broadest possible meaning and include all tools designed or intended to create a borehole in an object, a material, a work piece, a surface, the earth or a structure including structures within the earth, and would include bits used in the oil, gas and geothermal arts, such as fixed cutter and roller cone bits, as well as, other types of bits, such as, rotary shoe, drag-type, fishtail, adamantine, single and multi-toothed, cone, reaming cone, reaming, self-cleaning, disc, three-cone, rolling cutter, crossroller, jet, core, impreg and hammer bits, and combinations and variations of the these.

In general, in a fixed cutter bit there are no moving parts. In these bits drilling occurs when the entire bit is rotated by, for example, a rotating drill string, a mud motor, or other means to turn the bit. Fixed cutter bits have cutters that are attached to the bit. These cutters mechanically remove material, advancing the borehole as the bit is turned. The cutters in fixed cutter bits can be made from materials such as polycrystalline diamond compact ("PDC"), grit hotpressed inserts ("GHI"), and other materials known to the art or later developed by the art.

In general, a roller cone bit has one, two, three or more generally conically shaped members, e.g., the roller cones, that are connected to the bit body and which can rotate with respect to the bit. Thus, as the bit is turned, and the cones contact the bottom of a borehole, the cones rotate and in effect roll around the bottom of the borehole. In general, the cones have, for example, tungsten carbide inserts ("TCI") or milled teeth ("MT"), which contact the bottom, or other surface, of the borehole to mechanically remove material and advance the borehole as the bit it turned.

In both roller cone, fixed bits, and other types of mechanical drilling the state of the art, and the teachings and direction of the art, provide that to advance a borehole great force should be used to push the bit against the bottom of the borehole as the bit is rotated. This force is referred to as weight-on-bit ("WOB"). Typically, tens of thousands of pounds WOB are used to advance a borehole using a mechanical drilling process.

Mechanical bits cut rock by applying crushing (compressive) and/or shear stresses created by rotating a cutting surface against the rock and placing a large amount of WOB. In the case of a PDC bit this action is primarily by shear stresses and in the case of roller cone bits this action is primarily by crushing (compression) and shearing stresses. For example, the WOB applied to an 8¾" PDC bit may be up to 15,000 lbs, and the WOB applied to an 8¾" roller cone bit may be up to 60,000 lbs. When mechanical bits are used for drilling hard and ultra-hard rock excessive WOB, rapid bit wear, and long tripping times result in an effective drilling rate that is essentially economically unviable. The effective drilling rate is based upon the total time necessary to complete the borehole and, for example, would include time spent tripping in and out of the borehole, as well as, the time for repairing or replacing damaged and worn bits.

As used herein, unless specified otherwise, the term "drill pipe" should be given its broadest possible meaning and includes all forms of pipe used for drilling activities; and refers to a single section or piece of pipe, as well as, multiple pipes or sections. As used herein, unless specified otherwise, the terms "stand of drill pipe," "drill pipe stand," "stand of pipe," "stand" and similar type terms should be given their broadest possible meaning and include two, three or four sections of drill pipe that have been connected, e.g., joined together, typically by joints having threaded connections. As used herein, unless specified otherwise, the terms "drill string," "string," "string of drill pipe," string of pipe" and similar type terms should be given their broadest definition and would include a stand or stands joined together for the purpose of being employed in a borehole. Thus, a drill string could include many stands and many hundreds of sections of drill pipe.

As used herein, unless specified otherwise, the term "tubular" should be given its broadest possible meaning and includes drill pipe, casing, riser, coiled tube, composite tube, vacuum insulated tubing ("VIT"), production tubing and any similar structures having at least one channel therein that are, or could be used, in the drilling industry. As used herein the term "joint" should be given its broadest possible meaning and includes all types of devices, systems, methods, structures and components used to connect tubulars together such as for example, threaded pipe joints and bolted flanges. For drill pipe joints, the joint section typically has a thicker wall than the rest of the drill pipe. As used herein the thickness of the wall of tubular is the thickness of the material between the internal diameter of the tubular and the external diameter of the tubular.

As used herein, unless specified otherwise the terms "blowout preventer," "BOP," and "BOP stack" should be given their broadest possible meaning, and include: (i) devices positioned at or near the borehole surface, e.g., the surface of the earth including dry land or the seafloor, which are used to contain or manage pressures or flows associated with a borehole; (ii) devices for containing or managing pressures or flows in a borehole that are associated with a subsea riser or a connector; (iii) devices having any number and combination of gates, valves or elastomeric packers for controlling or managing borehole pressures or flows; (iv) a subsea BOP stack, which stack could contain, for example, ram shears, pipe rams, blind rams and annular preventers; and, (v) other such similar combinations and assemblies of flow and pressure management devices to control borehole pressures, flows or both and, in particular, to control or manage emergency flow or pressure situations.

As used herein, unless specified otherwise "offshore" and "offshore drilling activities" and similar such terms are used in their broadest sense and would include drilling activities on, or in, any body of water, whether fresh or salt water, whether manmade or naturally occurring, such as for example rivers, lakes, canals, inland seas, oceans, seas, bays and gulfs, such as the Gulf of Mexico. As used herein, unless specified otherwise the term "offshore drilling rig" is to be given its broadest possible meaning and would include fixed towers, tenders, platforms, barges, jack-ups, floating platforms, drill ships, dynamically positioned drill ships, semi-submersibles and dynamically positioned semi-submersibles. As used herein, unless specified otherwise the term "seafloor" is to be given its broadest possible meaning and would include any surface of the earth that lies under, or is at the bottom of, any body of water, whether fresh or salt water, whether manmade or naturally occurring.

As used herein the terms "decommissioning," "plugging" and "abandoning" and similar such terms should be given their broadest possible meanings and would include activities relating to the cutting and removal of casing and other tubulars from a well (above the surface of the earth, below the surface of the earth and both), modification or removal of structures, apparatus, and equipment from a site to return the site to a prescribed condition, the modification or removal of structures, apparatus, and equipment that would render such items in a prescribe inoperable condition, the modification or removal of structures, apparatus, and equipment to meet environmental, or regulatory considerations present at the end of such items useful, economical or intended life cycle. Such activities would include for example the removal of onshore, e.g., land based, structures above the earth, below the earth and combinations of these, such as e.g., the removal of tubulars from within a well in preparation for plugging. The removal of offshore structures above the surface of a body of water, below the surface, and below the seafloor and combinations of these, such as fixed drilling platforms, the removal of conductors, the removal of tubulars from within a well in preparation for plugging, the removal of structures within the earth, such as a section of a conductor that is located below the seafloor and combinations of these.

As used herein the terms "workover," "completion" and "workover and completion" and similar such terms should be given their broadest possible meanings and would include activities that place at or near the completion of drilling a well, activities that take place at or the near the commencement of production from the well, activities that take place on the well when the well is producing or operating well, activities that take place to reopen or reenter an abandoned or plugged well or branch of a well, and would also include for example, perforating, cementing, acidizing, fracturing, pressure testing, the removal of well debris, removal of plugs, insertion or replacement of production tubing, forming windows in casing to drill or complete lateral or branch wellbores, cutting and milling operations in general, insertion of screens, stimulating, cleaning, testing, analyzing and other such activities. These terms would further include applying heat, directed energy, preferably in the form of a high power laser beam to heat, melt, soften, activate, vaporize, disengage, desiccate and combinations and variations of these, materials in a well, or other structure, to remove, assist in their removal, cleanout, condition and combinations and variation of these, such materials.

As used herein, unless specified otherwise, the term "unit" and "system" should be given its broadest possible meaning, and would include any device, apparatus or system, whether integral, modular or component based. As used herein a high power laser "unit" and a high power laser "system", unless specified otherwise, would include any unit or system having a high power laser, having support equipment for a high power laser, having a high power conveyance device, and having a high power laser tool assembly. Thus, for example, high power laser units and high power laser systems may be land based, sea based, land and sea based, mobile, containerized, truck based, barge based, vessel based, rig based, fixed and combinations and variations thereof.

SUMMARY

There is a need for a control system, a monitoring system and combinations of both for the operation of high power lasers units for use in activities involving the transmission of high power laser energy over great distance to high power laser tools to perform activities, such as for example, drilling, workover and completion activities in the oil, natural gas and geothermal industries, as well as, activities in other industries, such as the nuclear industry, the chemical industry, the subsea exploration, salvage and construction industry, the pipeline industry, and the military. In particular, such control and monitoring systems are needed when the high power laser energy is transmitted over great distances to small and/or difficult to access locations, positions or environments for activities such as monitoring, cleaning, controlling, assembling, drilling, machining and cutting. The present inventions, among other things, solve these and other needs by providing the articles of manufacture, devices and processes taught herein.

There is provided a system for controlling, operating, or monitoring, a high power laser unit having a source of high power laser energy, a high power optical conveyance device, a high power laser tool, wherein the high power optical conveyance device provides optical communication for a laser beam from the high power laser energy source to be conveyed to the high power laser tool, the system having: a control network having a first monitoring device, a second monitoring device; wherein the first monitoring devices is positioned with respect to a location on the unit to detect laser energy; wherein the second monitoring device is positioned with respect to a location on the unit to detect the status of a component of the unit; the first and second monitoring devices, in communication with a controller, wherein at least one of the monitoring devices can send a signal on the network; and, the controller is configured to act upon the signal from the monitoring device and performing a predetermined operation based upon the signal.

Moreover there is provided systems and units that may also include: where the component is a laser tool and the signal indicates the failure of the laser tool and the operation is sending a signal to shut down the high power laser source; where the signal is from the first or second monitoring device and the operation is to wait for a signal from the other monitoring device; wherein the first monitoring device comprises a photo diode and the second monitoring device comprises a load cell; wherein the component is a laser tool and the signal indicates the position of the tool; where the component is a laser bottom hole assembly having a bit and the signal indicates the RPM of the bit.

Still further there is provided a system for remotely deterring and monitoring the RPM of a down hole tool, the system having: an accelerometer positioned in vibrational communication with a member near the top of a borehole; the member in vibrational communication with a down hole tool as the tool is rotated to advance the borehole; the accelerometer configured to send a signal based upon vibrations associated with the rotation of the down hole tool; and a processor configured to convert the vibration signal to the RPM of the down hole tool as it is rotated to advance the borehole. This system may also have the RPM value utilized by a controller in the system to control the RPM of the down hole tool and it may further have the down hole tool being a laser bottom hole assembly.

Yet further, there is provided a control system for a high power laser unit for performing a laser operation at a remote location, the system and unit having: a first module in communication with a source of high power laser energy, the laser source capable of providing a laser beam having at least 5 kW of power; a second module in communication with a tubing assembly, the tubing assembly having: a tubing having a distal end and a proximal end, and a high power optical fiber having a distal end and a proximal end, wherein the high power optical fiber is associated with the tubing and the high power optical fiber distal end is associated with the tubing distal end; a third module in communication with a high power laser tool, the laser tool in optical association with the distal end of the high power fiber and in mechanical association with the distal end of the tubing; a fourth module in communication with a motive means, the motive means to advancing the distal end of the tubing to a predetermined worksite location; the proximal end of the optical fiber in optical association with the laser source, whereby the laser beam can be transmitted from the laser source to the laser tool; a fifth module in communication with a human machine interface; and, a control module in communication with the first, second, third, fourth and fifth modules; whereby, the control module is configured to send a control signal to send a control signal to at least one of the first, second, third, or fourth modules based upon a signal received from at least one of the first, second, third, fourth or fifth modules, to thereby control an operation of the unit.

Additionally, there is provided a control system for a high power laser unit for performing a laser operation at a remote location, the system and unit having: a first module in communication with a source of high power laser energy, the laser source capable of providing a laser beam having at least 5 kW of power; a second module in communication with a tubing assembly, the tubing assembly having: a tubing having a distal end and a proximal end, and a high power optical fiber having a distal end and a proximal end, wherein the high power optical fiber is associated with the tubing and the high power optical fiber distal end is associated with the tubing distal end; a third module in communication with a high power laser tool, the laser tool in optical association with the distal end of the high power fiber and in mechanical association with the distal end of the tubing; a fourth module in communication with a motive means, the motive means to advancing the distal end of the tubing to a predetermined worksite location; the proximal end of the optical fiber in optical association with the laser source, whereby the laser beam can be transmitted from the laser source to the laser tool; a fifth module in communication with a human machine interface; and, a control module in communication with the first, second, third, fourth and fifth modules; whereby, the control module is configured to send a control signal to send a control signal to at least one of the first, second, third, or fourth modules based upon a signal received from at least one of the first, second, third, fourth or fifth modules, to thereby control an operation of the unit. Such a unit may also include: the control module is associated with a programmable logic controller; the control module is associated with a personal computer; where the tubing is selected from the group including composite tubing, coiled tubing and wireline; wherein the optical fiber has a length selected from the group of length of about 0.5 km, about 1 km, about 2 km, about 3 km and from about 0.5 km to about 5 km; and wherein the laser tool is selected from the group including a laser cutting tool, a laser bottom hole assembly and an electric motor laser bottom hole assembly; where the first, third and control modules reside on a control network, the network and modules configured to send and receive data signals and control signals between the first, third and control modules; where the second, fourth and fifth modules reside on the control network and the network and modules configured to send and receive data signals and control signal between the second, fourth, fifth and control modules; or where a signal is received from the fifth module causing the control to send a signal to the third and fourth modules to stop operation of the tool, and retrieve the tool.

BRIEF DESCRIPTION OF THE DRAWINGS

FIG. 1A is a schematic table for the control and monitoring system of FIG. 1.

FIGS. 1C to 1N are schematics of embodiments of components of the control and monitoring system of FIG. 1.

FIGS. 1O to 1R are drawings of embodiments of HMI displays in accordance with the present invention.

DESCRIPTION OF THE PREFERRED EMBODIMENTS

Figure 1:
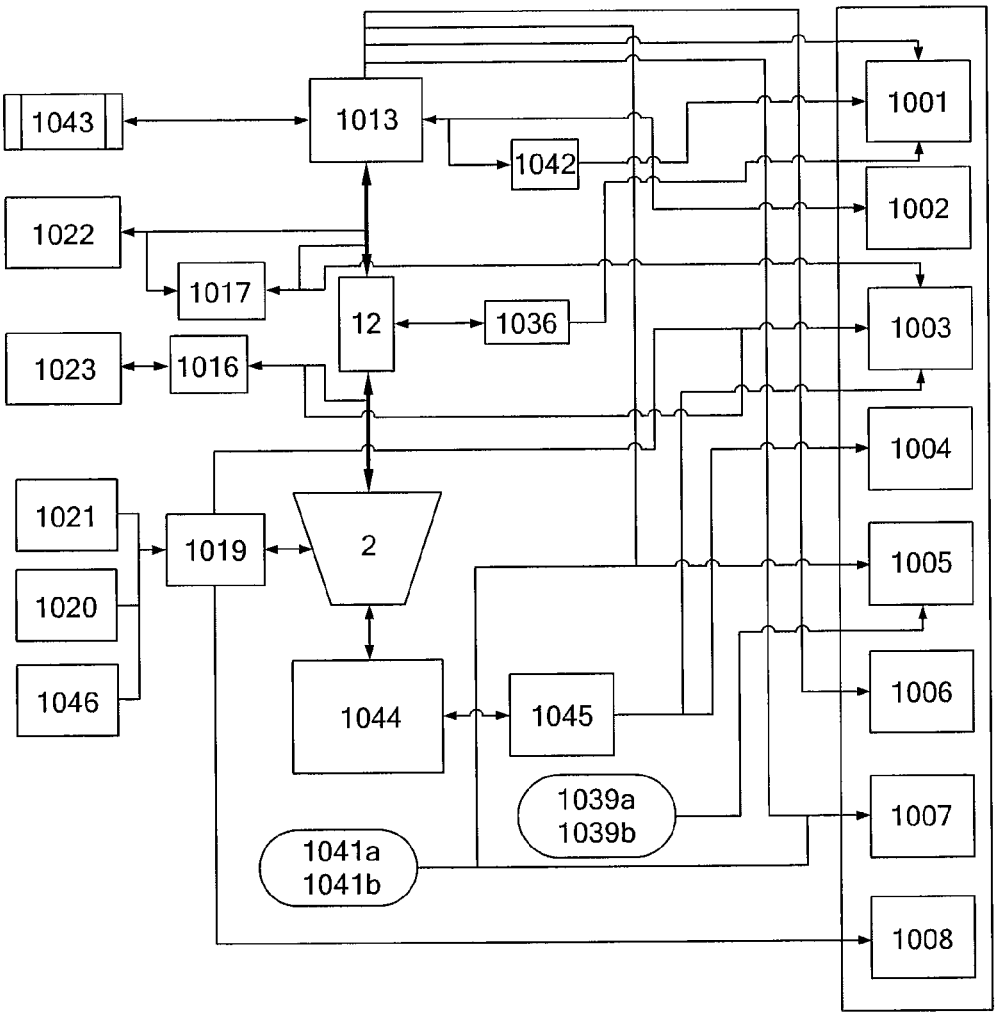
FIG. 1 is a schematic of the embodiment of the control and monitoring system for the high power laser drilling system of FIG. 4 in accordance with the present invention.

The present inventions relate to systems for delivering and utilization of high power laser energy, for example at least about 5 kW, at least about 10 kW, at least about 20 kW, at least about 50 kW, and at least about 100 kW. In particular, the present inventions relate to control and monitoring systems for high power laser units for performing activities such as drilling, working over, completing, cleaning, milling, perforating, monitoring, analyzing, cutting, removing, welding and assembling. More specifically, and by way of example, the present inventions relate to control and monitoring systems for high power energy drilling workover and completion units.

In general, a control and monitoring system for a high power laser unit or system, should preferably address primary functions, components and parameters, preferably key functions, components and parameters, and more preferably all critical functions, components and parameters of the laser unit, including such parameters, which are deemed critical when viewed from operations, productivity and combinations thereof perspective. The present inventions contemplate systems that address a single component, function or parameter, less than, or more than all critical components and parameters, only important components and parameters, more than or less than all important components and parameters, and combinations an variations of the foregoing.

It is also preferable that the control and monitoring system be fully integrated systems, such that control activities, monitoring activities and data retrieval activities are capable of being performed by a single integrated network, which may have varied individual controls, sensors, monitors and other equipment. A fully integrated system, a system having subsystems, a system that is partially integrated, a system that is a distributed control network, a system that is a control network, and an independent system, and combinations and variations thereof, are also contemplated.

There are several functions, conditions, parameters and components that preferably should be monitored and controlled by a high power laser control and monitoring system. More, less or other components, functions, parameters and conditions, depending upon the particular unit, and also upon the particular application or utilization of the unit, may be monitored and controlled. Thus, by way of general examples, equipment, parameters, and conditions that could be monitored and controlled may include, one or more of the following:

Laser—such as laser operations, laser power output, temperature, back reflections, laser chiller, laser chiller status, laser readiness and laser status. This would include the use of multiple lasers, or laser having multiple modules, as well as, a separate laser unit, such as a laser truck which is later integrated or optically associated with for example a laser tool;

High power optical fiber—such as fiber integrity, break detection, temperature, back reflections, splices, light leakage, and fiber integrity. This would include the use of multiple fibers in parallel, the use of fibers serially, e.g., connecting one component to the next, as for example, with the use of an optical slip ring ("OSR");

Optical conveyance devices—such as a beam switch, coupler, connector, OSR, temperature of these device, cooling and heat management systems for these devices, light leakage from these devices, OSR cooling system, other cooling systems, OSR alignment, beam switch alignment, other optical component alignment, other optical devices where alignment may be an issue, and a spool (or other device to handle the optical cable or conveyance device). This would include the use of multiple such devices both in serial and in parallel. It would also include the monitoring of other support or operating materials needed for the operation of such conveyance devices;

Advancement devices—this would include the mechanical components that are used for raising and lower, extending and retracting, moving, and combinations thereof, the optical cable and a high power laser tool that is at the end of the cable, such as for example a spool and injector on a coil tubing unit, or a spool on a wire line unit. This would further include, by way of example, in drilling having the capability to determine WOB and control WOB, having the ability to regulate WOB and having the ability to determine MD;

High power laser tools—this would include all of the supporting material needed for a high power laser tool, such as for example fluid flow, e.g., a liquid, compressed air, or $N_2$, as the motive fluid for a mud motor, fluid flow to keep the high power laser beam path clean of debris, e.g., a transmissive liquid or fluid, substantially transmissive liquid or fluid, compressed air, $N_2$, electric power, RPM (revolutions per minute), TVD, MD, lubrication of tools, temperature of tools and related equipment, and other conditions, or information about the operations of the tool. Further, if the tool has monitoring, measuring or analyzing functions such as MWD, LWD the operation of those functions may be monitored and controlled; and, Interlocks—such as for example the monitoring, sensing for conditions that are out of set operating parameter, or predictive of conditions becoming out of set operating parameters, and similar types of monitoring and control that will automatically stop or shut down the laser or the unit to prevent a dangerous situation or stop the occurrence of a dangerous situation either for personnel, equipment or both.

Figure 1B:
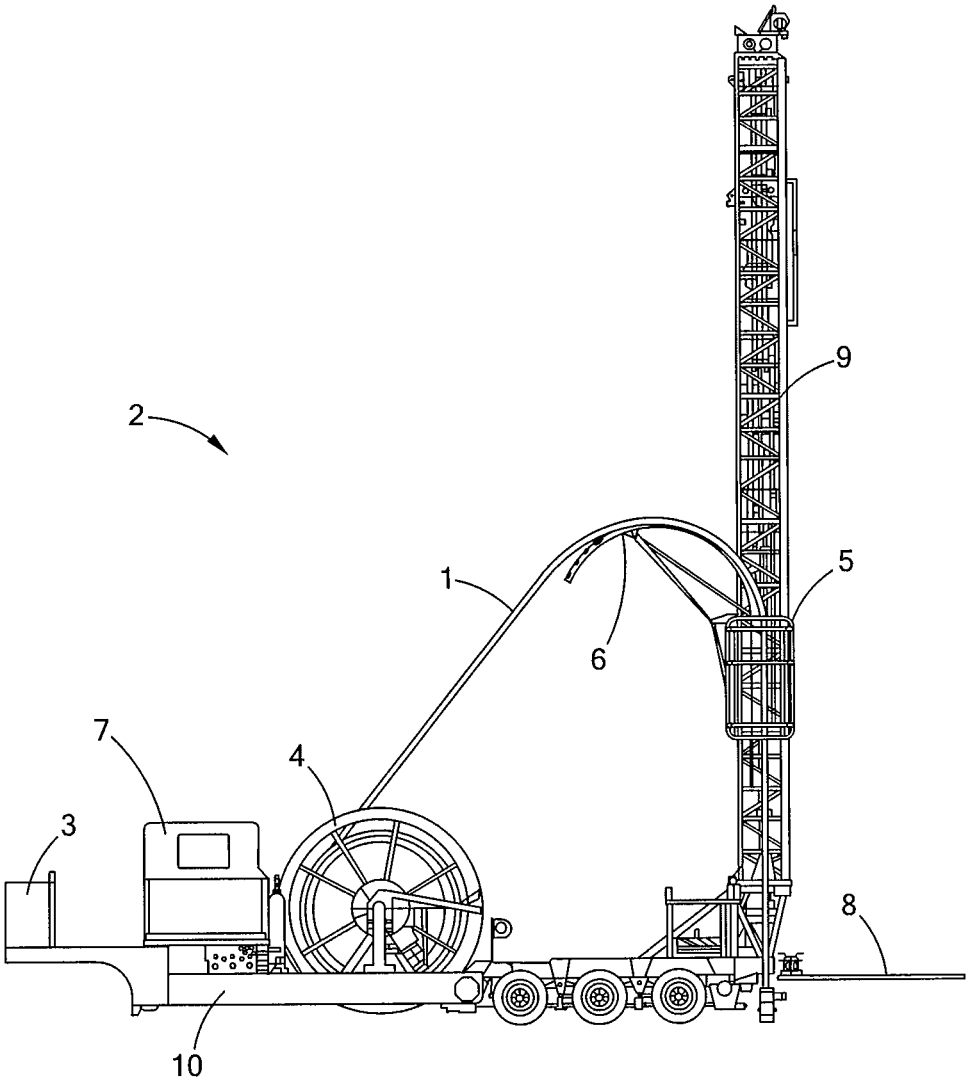
FIG. 1B is a schematic of an embodiment of an advancement device associated with the control and monitoring system of FIG. 1.
Figure 1C:
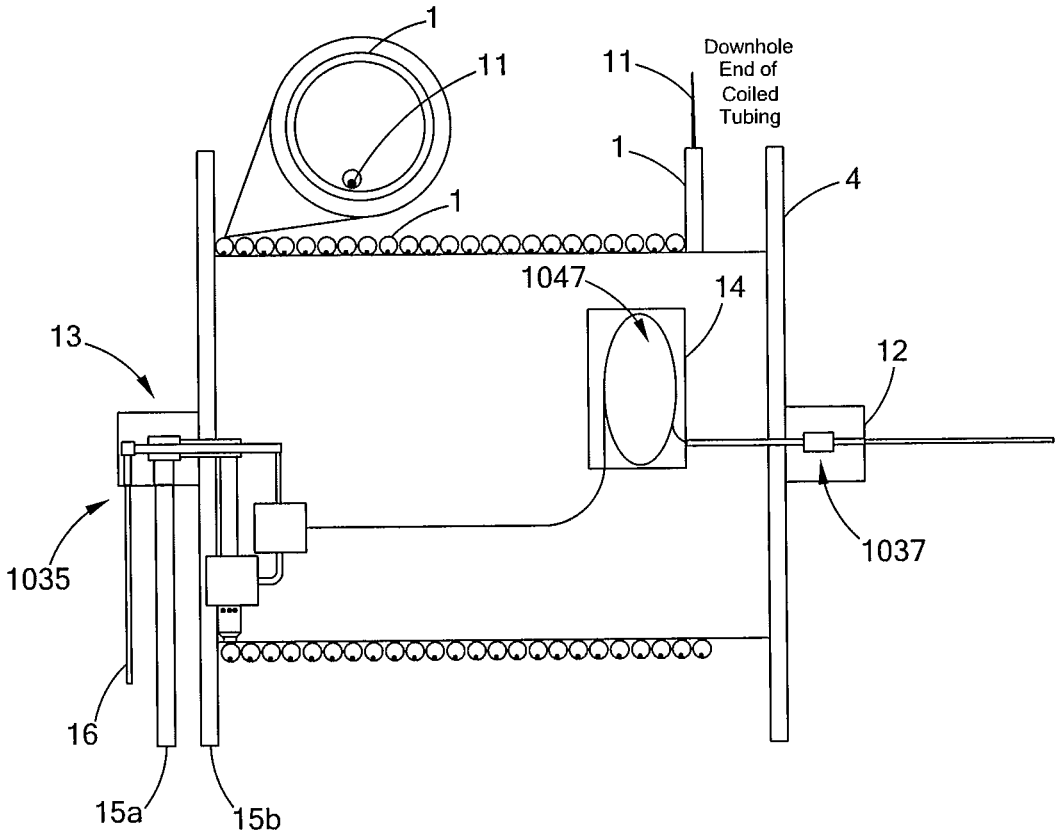
Figure 1D:
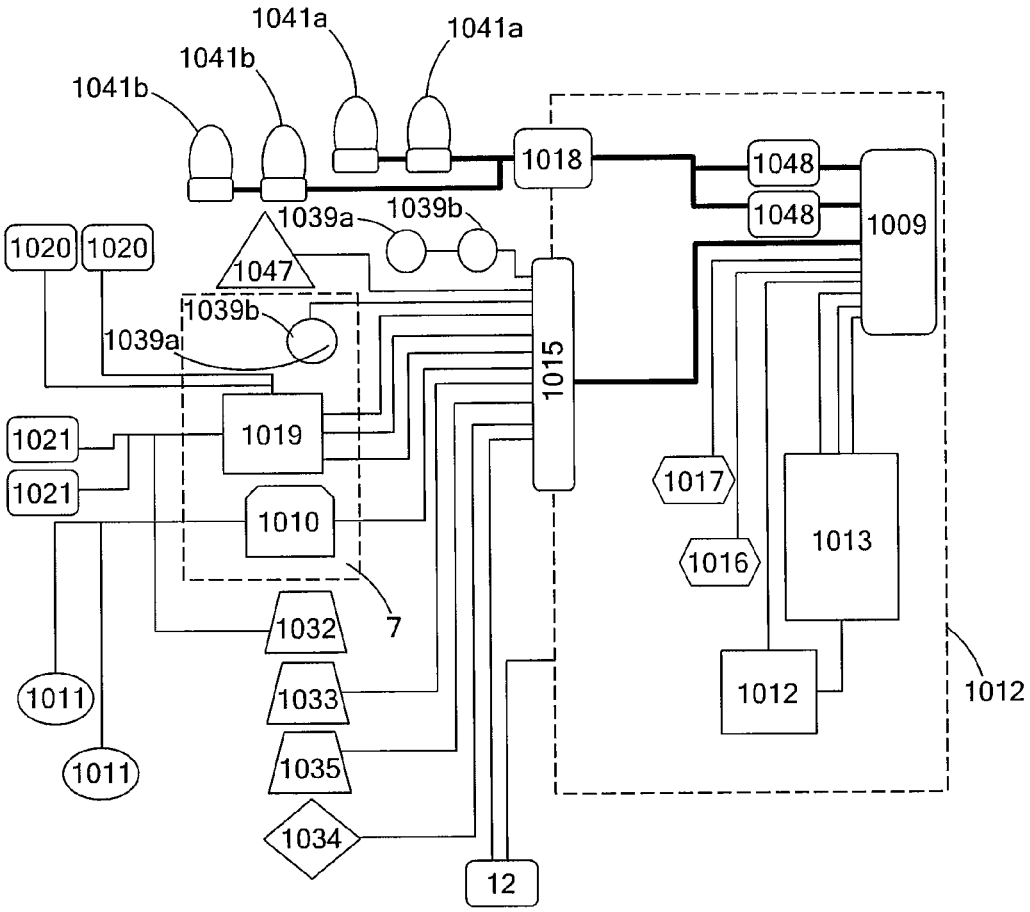
Figure 1F:
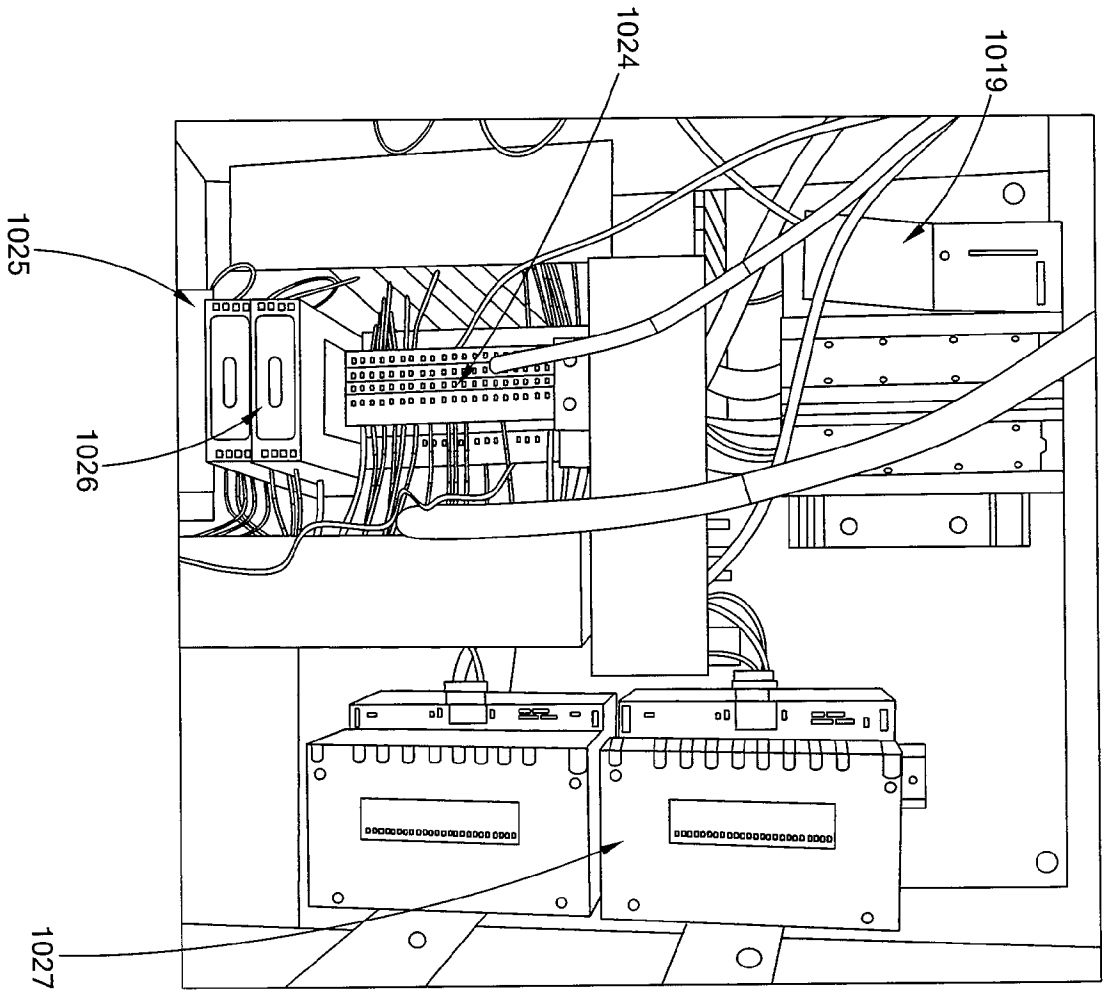
Figure 1G:
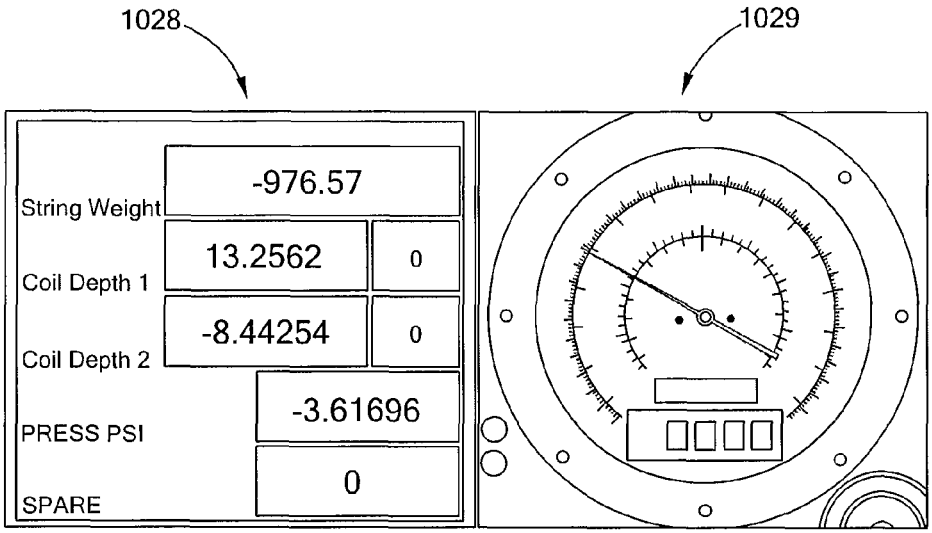
Figure 1H:
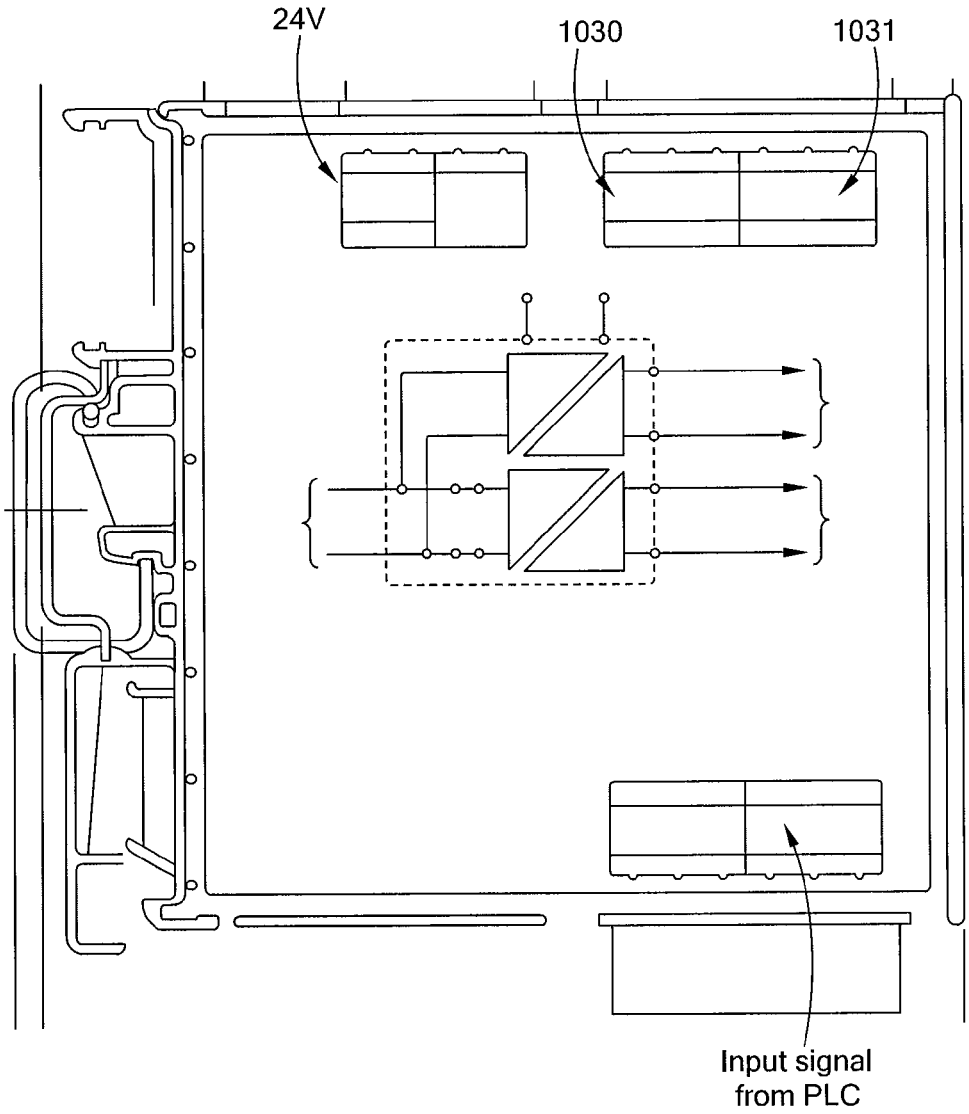
Figure 1I:
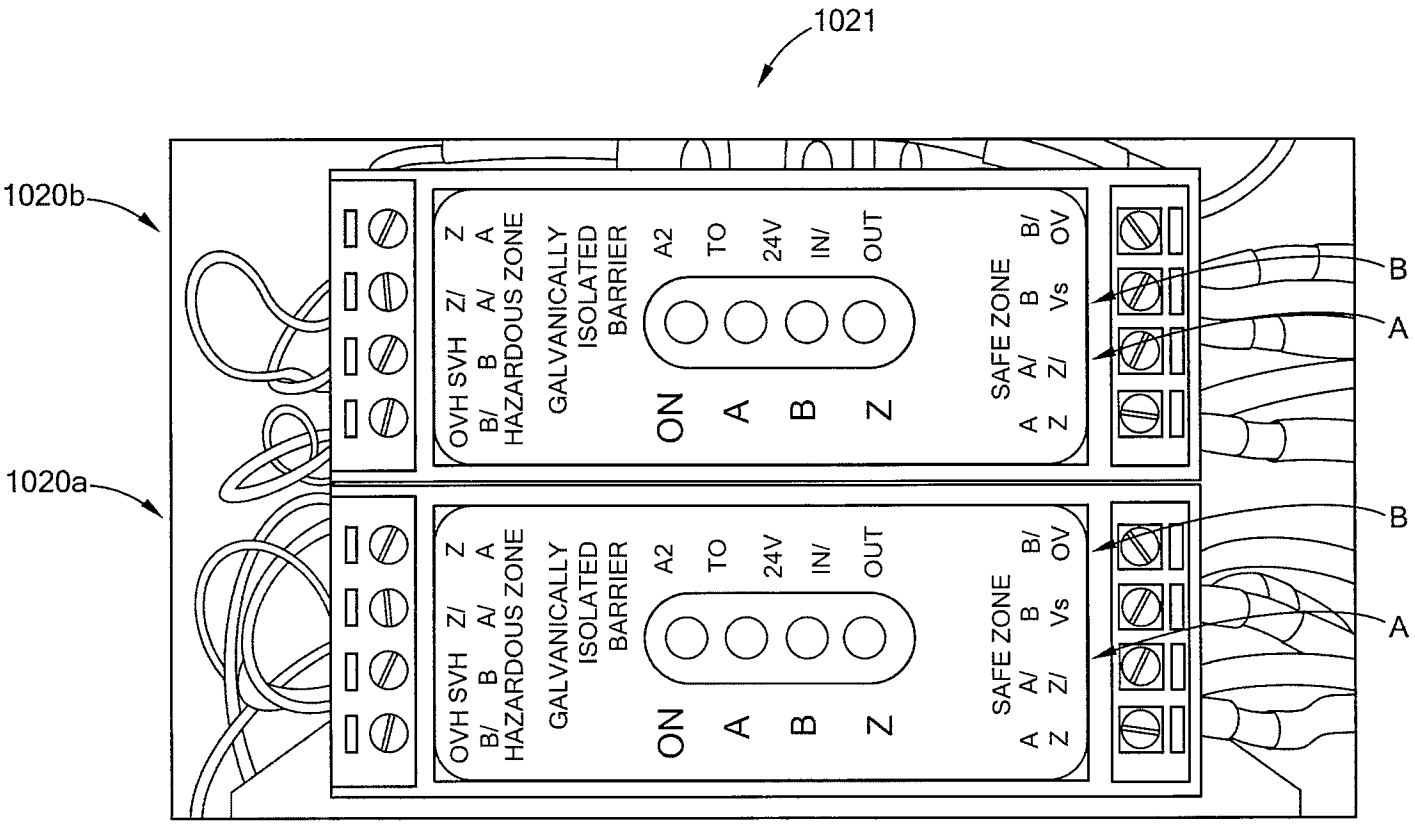
Figure 1J:
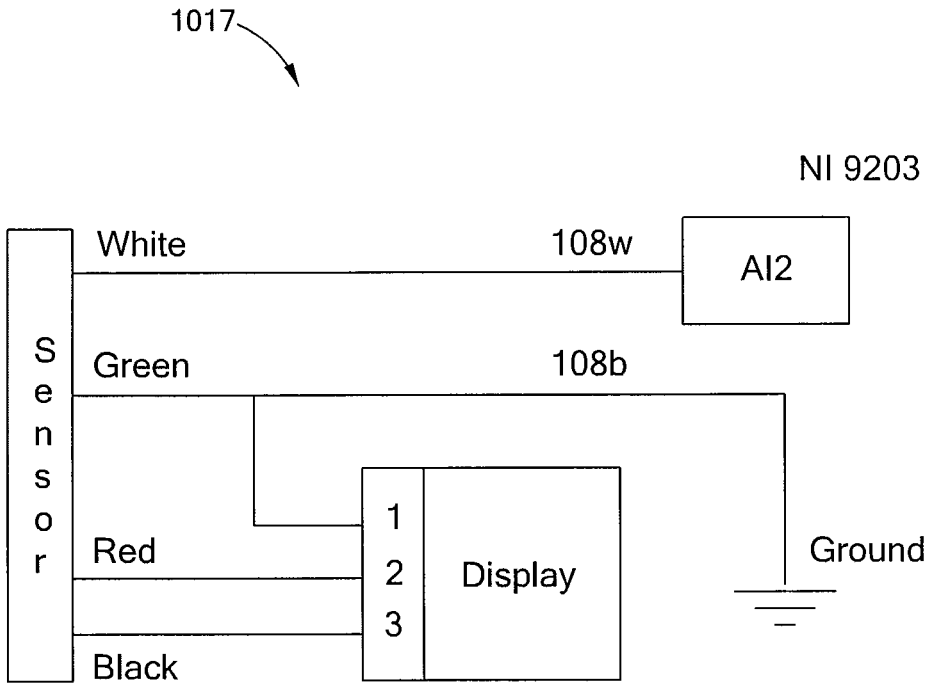
Figure 1K:
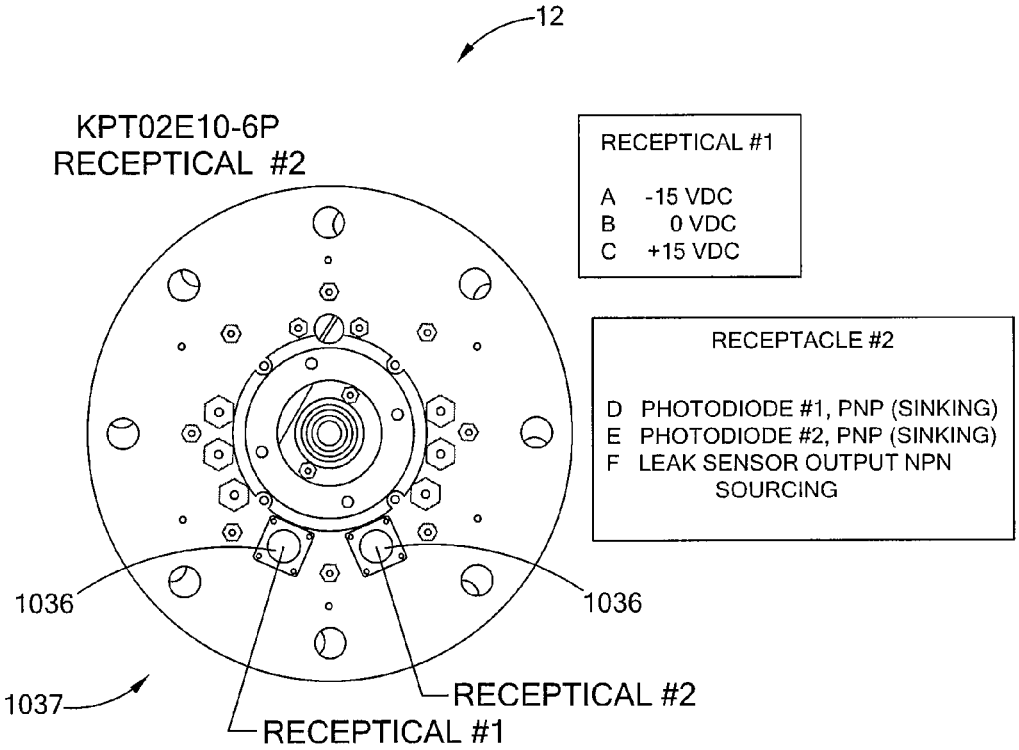
Figure 1L:
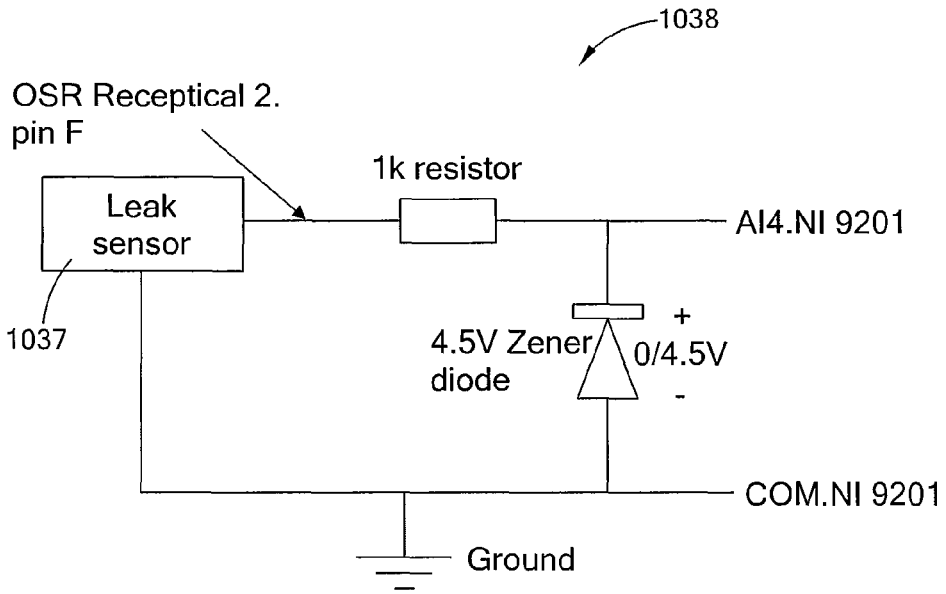
Figure 1M:
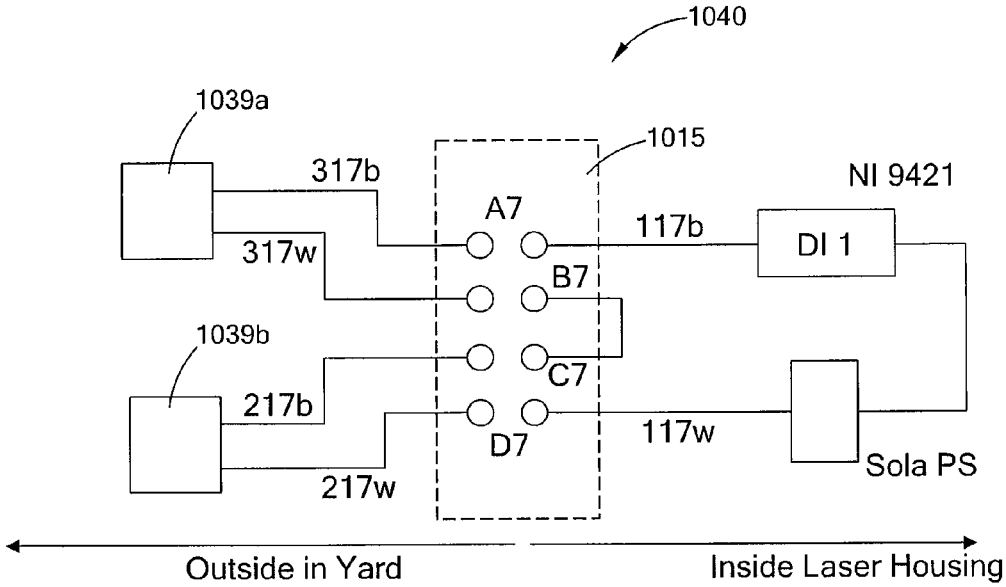
Figure 1N:
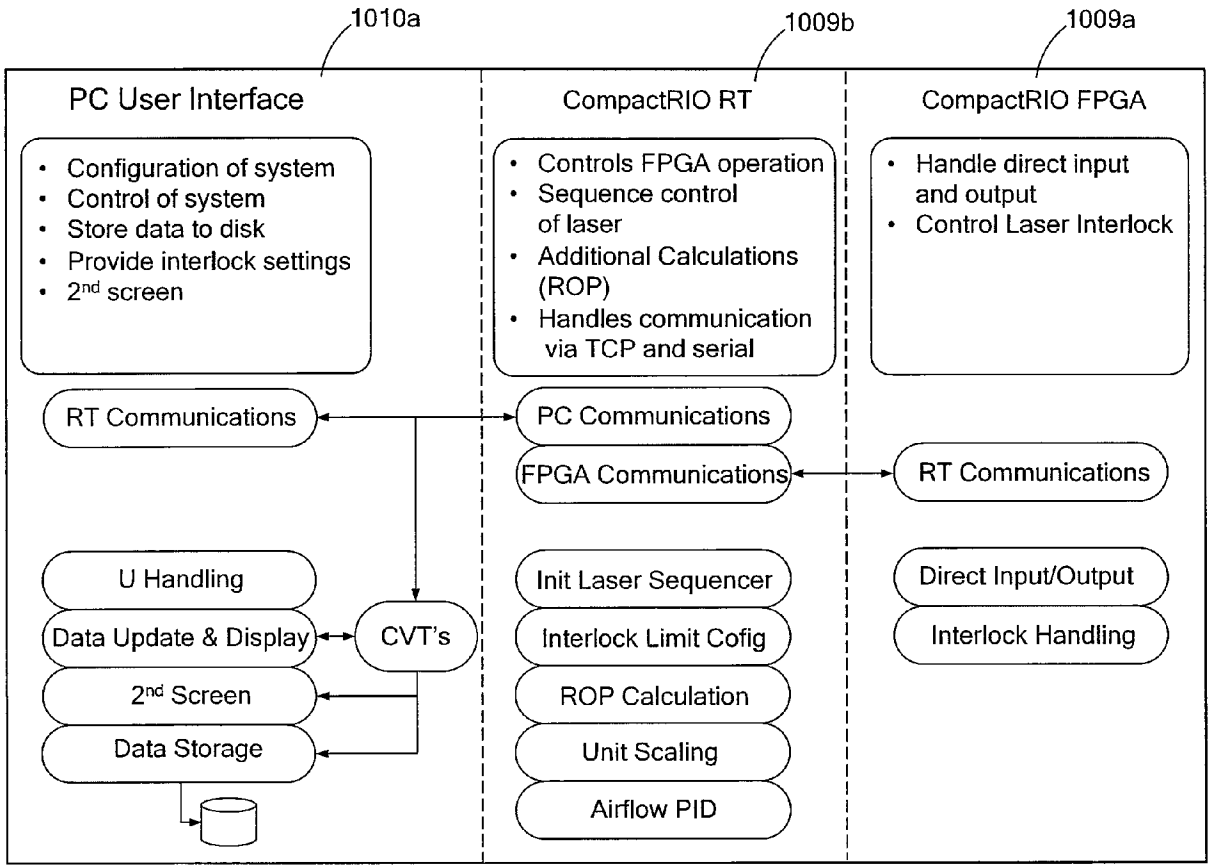
Figure 10:
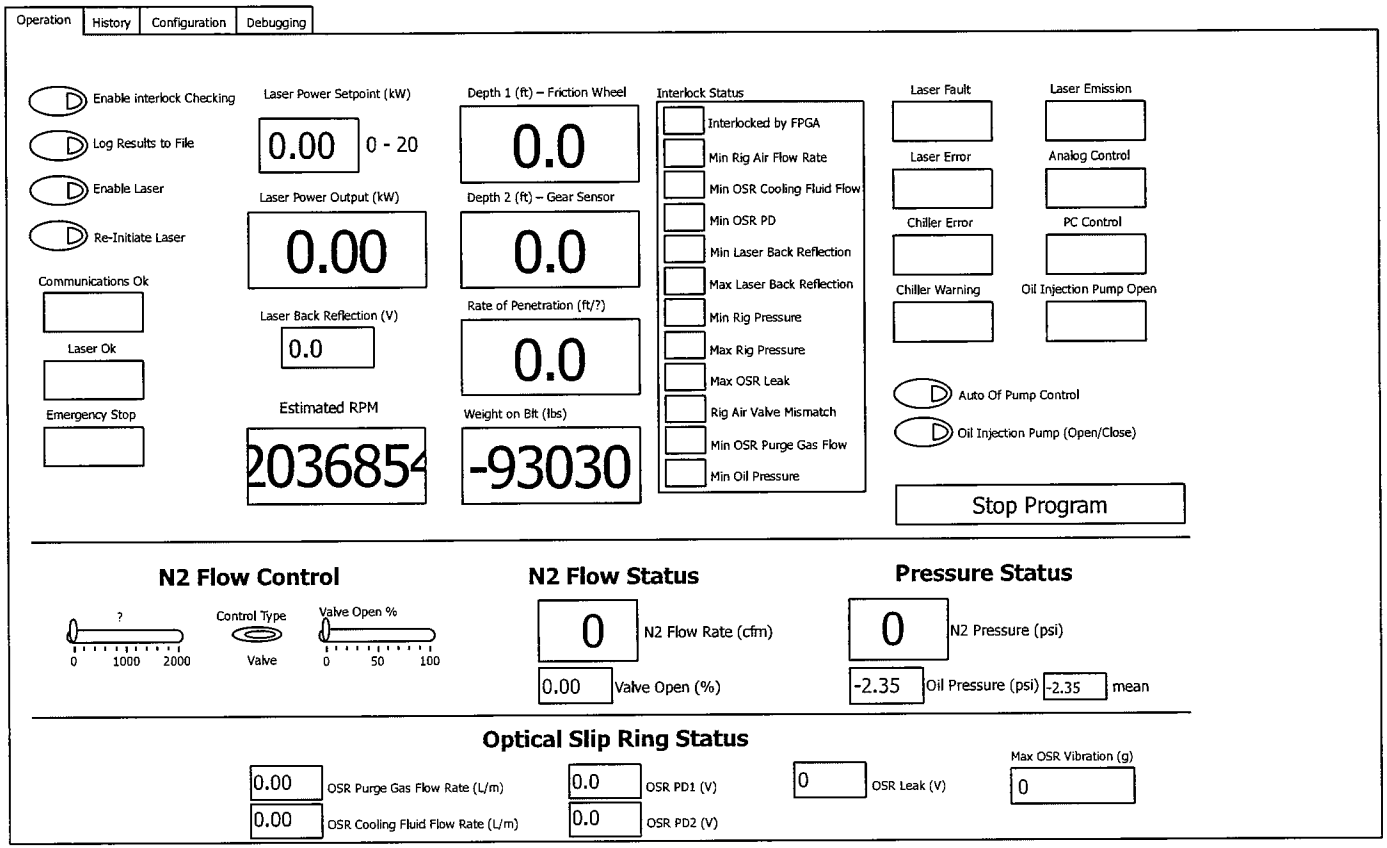
Figure 1P:
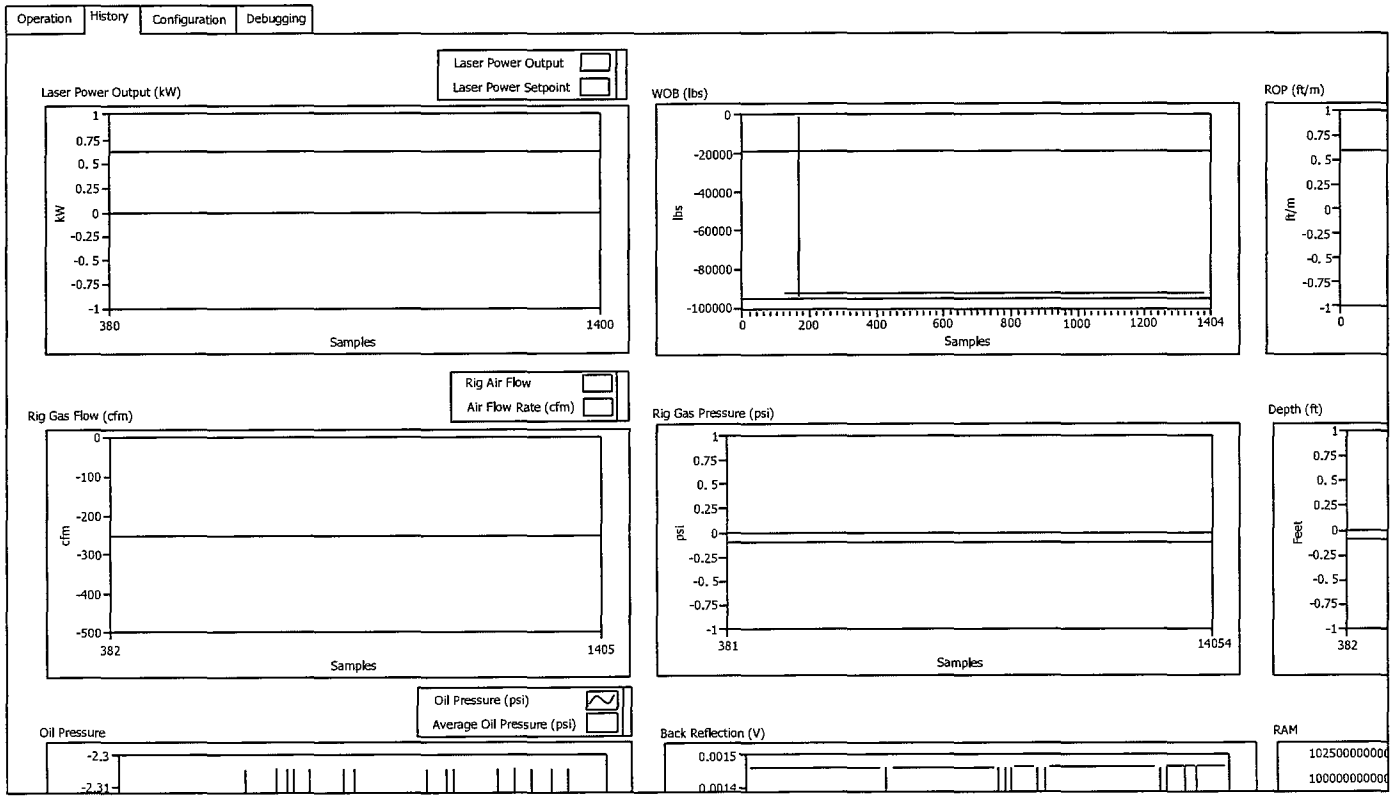
Figure 4:
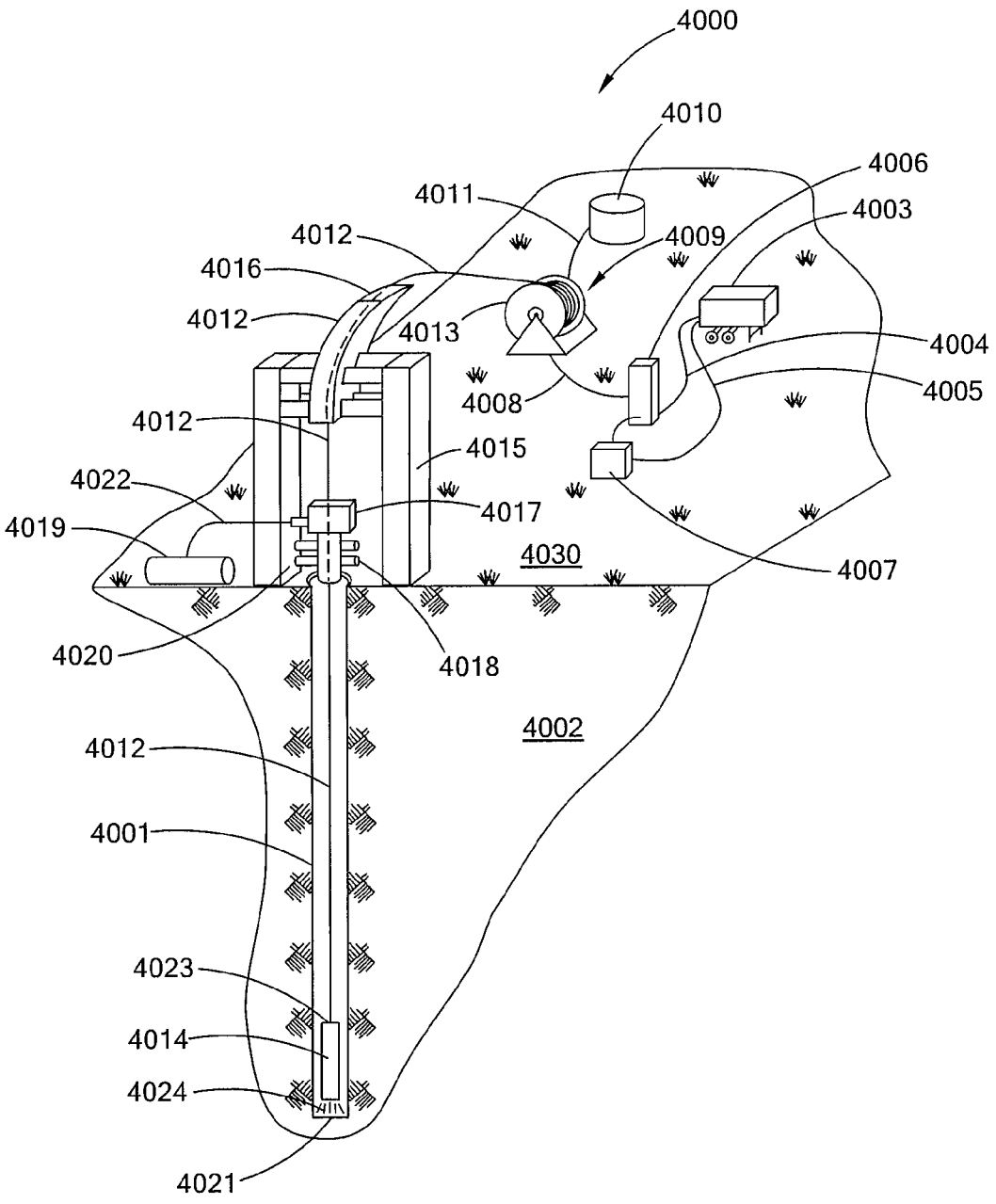
FIG. 4 is a schematic view of an embodiment of a high power laser system deployed in laser activities in the field in accordance with the present invention.

Thus, an example of an embodiment of a control and monitoring system for a high power laser unit is illustrated in FIGS. 1 and 1A to 1P, which system could be deployed with a drilling system such as illustrated in FIG. 4.

In general, FIG. 1 shows the top-level system configuration for this embodiment. FIG. 1A provides a table setting forth the interfaces in this system. FIG. 1N provides the overall software implementation and includes the principal systems and their functions for this embodiment.

In general, this embodiment of a control and monitoring system includes a LabVIEW CompactRIO ("cRIO") embedded system to perform all critical functions with a PC (personal computer, i.e., a small unit having a processor, memory and an operating system, such as are available from IBM, Dell, and Apple) to provide user interface and data logging capabilities. Although a labVIEW system is used, other systems of factory and equipment automation and control may also be employed, such as those available from Schneider Electric, Rockwell, Siemens and Opto 22. Preferably, as with the present embodiment, an emphasis should be placed on monitoring of various parameters. The system includes for example monitoring the laser back reflection and flow rates of cooling systems. In addition, the cRIO is interfaced with various instruments to provide monitoring, logging and in some cases control of the instrument to achieve proper operation for drilling or other high power laser activities.

The CompactRIO contains both an FPGA (Field-Programable Gate Array) and a real-time processor. The FPGA handles all input from the sensors and outputs to the laser. If any of the measured values is out of the allowable range, the FPGA drops the power set point to 0 W and engages the laser interlock mechanism. The CompactRIO real-time (RT) processor handles all communication between the FPGA and PC, as well as for example, features such as features that cannot be performed on the FPGA directly. The RT software initializes the FPGA on start-up and responds to all commands from the PC. For example, when the laser power set point is changed on the PC, this command is sent to the RT software, which communicates the command to the FPGA. In addition to handling commands from the PC, it also communicates the current status to the PC. Finally, the RT software handles the rate of penetration (ROP) calculations and the control loop to control the air flow rate.

The PC software serves primarily as a user interface to allow an operator to control the system. All relevant set points, limits and controls are accessible by the user via the PC software. Other than sending the set points to the CompactRIO when they are changed, the PC has no interaction with safety mechanisms. The PC software shows the current status of all monitored parameters, and stores this data to a user specified data file.

The LabVIEW interfaces with the following devices and in the following manner, as shown in the table of FIG. 1A, and as summarized below:

Laser— a. Control and monitor interlocks, and operation, including back reflection.

b. The laser will shut down if the amount back-reflection exceeds a factory-set value to protect the laser.

c. The system will also shut down the laser if the back reflection is reduced below a user-defined value at any output power set point.

Sensors on the Rig— a. Load cells—monitor and record weight on bit (WOB)

b. Pressure transducer—monitor and record pressure of compressed gas to the BHA.

c. Encoders—monitor and record drilling depth and rate of penetration (ROP).

$N_2$ Flow Valve and Meter Assembly— a. Control, monitor and record flow of compressed gas to the BHA. There are both manual and automatic modes. In Auto mode, the user chooses a certain flow value and the system adjusts the valve opening to provide desired flow. In the manual mode, the user can choose the valve opening from 0 to 100%.

Oil Injection Valve— a. Control, monitor and record status of the valve that controls oil injection into the laser bottom hole assembly ("LBHA"). There are both manual and automatic modes. In Auto mode, the valve automatically opens to allow oil injection based on a user-specified $N_2$ flow. In the manual mode, the user can open and close the valve at any time.

Pressure Sensor at the Oil Injection— a. Monitor and record the compressed gas ($N_2$) pressure at the oil injection point, to show the status of oil injection.

Accelerometers— a. There are interfaces to two accelerometers. One is a 3-axis accelerometer and the other a 1-axis. The 3-axis accelerometer is mounted on, or in physical contact with the coiled tubing and will measure vibration of the LBHA. The RPM of the motor is determined and recorded. The 1-axis accelerometer is mounted on the OSR and will measure the vibration and record maximum vibration during operation.

Optical Slip Ring— a. Monitor and record interlocks of photodiodes monitoring stray light in OSR.

b. Monitor and record interlocks status of leak photodiodes.

c. Monitor and record necessary fluid flows (e.g., purge gas and cooling fluid) for OSR operation.

External Emergency Stops ("E-Stops")— a. Activates any number of external e-stops (e.g, one, two, three, four or more) on demand to stop the laser in case of emergency.

Hazard Lights— a. There are two types of hazard lights to warn for impending laser emission (amber color flashing lights) and also when there is actual laser emission (red flashing lights).

Turning generally to FIGS. 1, 1A, 1D, and 1N the overall system schematics, architecture, and functionality is illustrated. Like numbers in FIGS. 1, and 1A to 1N refer to like items. As shown in FIG. 1 in this embodiment there are eight National Instruments (NI) modules: 9201 Voltage Analog inputs 1001, 9263 Voltage Analog Outputs 1002, 9203 Current Analog Inputs 1003, 9265 Current Analog Outputs 1004, 9421 10V Digital Inputs 1005, 9481 Relay Digital Outputs 1006, 9472 10V Digital Outputs 1007, 9423 30V Digital Inputs 1008, to interface, control, and monitor the signals from all the instruments. A LabVIEW CompactRIO (cRIO) 1009 embedded system performs all critical functions with a PC 1010 to provide user interface and data logging capabilities. In addition an NI PS-16 24-V (10A) power supply provides power to the modules. The accelerometers 1011 interface is not through the CompactRIO (due to lack of spare channels). The interface is established through an NI Hi-Speed USB carrier, which is interfaced with the PC 1010 via USB connection.

As shown in the flow diagram of FIG. 1N the CompactRIO FPGA 1009*a* handles all critical aspects of the rig laser control and interlocks, and is not dependent on the other components except to receive set points and send status. The CompactRIO RT 1009*b* handles all communication between the FPGA and the PC user interface 1010*a*. It also provides sequencing to certain laser operations, including initialization and provides scaling and other processing. The PC User Interface handles all display of information to the user and sends configuration information and commands to the CompactRIO system. It also stores the received data for later analysis.

Additionally, and referring to FIG. 1N the following more detailed explanations are provided.

CompactRIO FPGA—the FPGA handles all direct input and output with the system including laser monitoring and control, pressure monitoring, valve control, etc. In addition, it handles various mechanisms including laser shutdown in the case of any monitored values being out of range. Once initialized, the FPGA is not dependent on either the RT or PC to perform its safety functions. If the PC and RT are not operational, the FPGA will still shut down the laser and engage its interlocks if any monitored parameter is out of range.

RT Communications—The RT Communications process handles all communication between the FPGA and CompactRIO RT processor. This includes receiving any set points from the RT system, handling any commands from the RT system, and transmitting the collected information to the RT system. As there is no high-speed communication required between the FPGA and RT processor, simple LabVIEW FPGA front-panel communication is used for ease of maintenance.

Direct Input/Output—The FPGA handles all direct input and output via the plug-in C-Series modules.

CompactRIO RT—The RT system handles all communication between the CompactRIO FPGA and the User Interface. It provides the necessary startup information to the FPGA as well as any changing parameters over time. It handles the rate of penetration calculation, control of the air flow and all communications with the user interface. In addition, it provides simple timing and sequencing to initialize the laser.

FPGA Communications—The FPGA Communications process handles all communication of set points, configuration and commands to the FPGA. It also reads all status and control information from the FPGA.

PC Communications—The PC Communications process handles all communication between the RT system and the PC user interface. It receives and processes any commands from the PC, and sends all status information to the PC.

PC User Interface—The PC handles all user interaction and data storage. It provides no control features, but acts as a pathway to send commands to the RT system and provide information to the operator. The PC User Interface consists of two screens, the primary user interface and the secondary display. All control is done via the primary user interface while both screens show status and history information.

RT Communications—The RT Communications process handles all communication between the PC and the RT system. It sends operator commands, set points and configuration information. It also receives all status information from the CompactRIO system.

Data Storage—The Data Storage process stores the collected data to disk at the interval configured via the PC User Interface. This data can later be viewed and analyzed as needed.

In this embodiment, the advancement device, as illustrated in FIG. 1B, is a steel coiled tubing 1, installed on a mast style coiled tubing unit 2 with power pack 3, coiled tubing reel 4, injector head 5, injector head gooseneck 6, control console 7, drilling floor 8 and mast 9, all on a single carrier 10. The loaded reel may have anywhere form a few feet, hundreds of feet up to approximately 5000 feet of coiled tubing, depending upon the intended use and the diameter of the tubing, such as for example, 80K yield strength, 2.875" outside diameter coiled tubing with a 0.188" wall thickness.

The coiled tubing 1 is moved by a 100K lb. pull capability, hydraulically driven injector 5 fitted with a 120" gooseneck 6. The coiled tubing unit 2 has a single section mast 9 capable of 100K lb. capacity with an approximate height under elevated injector head of 40 feet to ground level. The unit stores the coiled tubing 1 spooled on the coiled tubing reel 5.

For operations, the coiled tubing 1 is run across the injector gooseneck 6 and into the injector head 5. The injector head has two hydraulically driven opposing chains with inserts that allow the coiled tubing pipe to pass through the center of the head.

The two chains within the injector head 5 utilized hydraulic cylinders to force the chains together, clamping down on the coiled tubing, then roll in unison to either inject the pipe downward into the well, or upward, removing pipe from the well. As the amount of force required moving the pipe in either direction is increased, so is the amount of tension of the chains/inserts on the coiled tubing pipe.

Control of the system is done from a control console 7 located to the forward side of the reel 4 on the unit trailer 10. The rig system consists of a programmable logic controller ("PLC") for data acquisition and control and may have sensor for example of two load cells on the injector, two depth encoders and one pressure transducer, located in the rig cabin. The information from these sensors and the PLC may be interfaced into the overall system, e.g., LabVIEW cRIO.

A power pack 3, providing the necessary hydraulic power to function the unit components is located at the front of the trailer. Additionally, the power pack 3 provides a 12 volt electrical source, as well as a limited amount of air pressure from an on board compressor. The unit 2 is effectively self-sufficient until the addition of blow out preventers is required. Although not addressed in the example of this embodiment, the control and monitoring of the BOP, which could be integrated into the control system.

To accommodate a fiber optics cable 11, the coiled tubing reel 4 has been fitted with two components, as illustrated in FIG. 1C, an optical slip ring 12 and a plural flow path pressure swivel 13. The optical slip ring allows the passage of the laser being transferred through the fiber from the laser source static line to the spinning component on the reel. The fiber cable enters and exits the slip ring assembly encased in a IPG photo-optics hose, and is then transferred from the hose encasement to a ⅛" stainless steel tubing protective sheath inside the reel assembly. The stainless steel tubing is wrapped inside a containment box 14 with excess tubing/fiber, then exits the box and enters the ⅜" stainless steel tubing to the interior of the reel assembly with a sealed junction.

The rotating pressure joint provides a stationary to rotating pressure seal for air 15*a*, 15*b* being used to transport solids and to power the downhole motor, as well as for oil 16 being pumped to lubricate the bearings on the downhole motor during drilling operations. From the pressure swivel, at the inside of the coiled tubing reel, the pressure path for the air is channeled through the inside diameter of the coiled tubing, while the oil is directed through a ⅜" outside diameter stainless steel tubing, installed inside of the coiled tubing.

A laser housing 1012 is used to protect and contain the laser 1013 and related equipment. For example, in this embodiment the laser housing is a 20-foot transportable container houses the laser 1013, beam switch 1014, "OSR cooling system", chiller 1020 and the cRIO 1009 hardware. The rest of the monitoring devices are outside in the field, as illustrated in FIG. 1D. The OSR cooling system has a small portable compressor 1023, a gas mass flow meter 1016 and a flow meter 1017 switch with display. The compressor provides compressed air as purge gas for the OSR and cool DI water and tap water are diverted from the chiller's main water lines. To accommodate the transportability of the laser container, the wiring connection from outside sensors to the cRIO is made through a 64-pin Harting Han connector 1015. The cooling hoses are fitted with quick-disconnect couplings and are easily detachable. The tables, provided in FIG. 1E shows the pin diagram for the 64-pin connector 1015 and corresponding wiring designations.

Further detail of the individual devices and components in this illustrative example are provided below. It being understood that other, and other similar types, of controllers, PLCs, soft PLCs, sensors, connectors, encoders, load cells, transducers, control valves, flow sensors, sensors, monitors, pressure sensors, accelerometers, photo diodes, etc., may be employed. These and additional devices may be utilized at other and additional locations within an overall high power laser unit or system.

Detailed Description of Illustrative System Components

Laser—Laser energy is provided by a 20-kW fiber laser 1013 through a multimode fiber incased in a tubing (FIMT), which passes through all other subsystems (BHA) to provide nominal 20 kW of laser energy at the rock surface. The laser is manufactured by IPG and is a Model YLS-20000. The interface to laser is through three interface connectors: (i) Analog Interface Connector, which is a 7-pin Harting Han, for all analog inputs and analog outputs; (ii) Interface Connector, which is 25-pin Harting Han 1018, associated relays 1048 and which handles such features as Emission enable, e-stops and internal interlocks; and (iii) Hardwiring Interface Connector, which is a 64-pin Harting Han 1015 and all laser request/control and programs are handled through this interface. There is also provided back reflection monitoring system 1042. The laser has an associated laserNET applications system 1043

Rig Control system—The rig 2 is controlled by a PLC 1019, in this example a Siemens 6E57314-6CG03-0AB0 programmable logic controller (PLC) system for data acquisition from two load cells 1020 on the injector 5, two depth encoders and one pressure transducer, located in the rig cabin. A drawing of a photograph of the PLC 1019 and related I/O interfaces 1024 is provided in FIG. 1F, which also showns the current duplicator 1025, the intrinsic barriers 1026 for the encoders and a 24V power supply 1027. It being recognized that with more advanced rigs and units, or with retrofitting older or less advanced rigs, more complex and networkable controls may be utilized and incorporated into or integrated with the control network and system. The rig further has compressors 1044 and a gas flow monitoring and control system 1045 associated with those compressors, as well as, pressure sensors 1046.

Rig—Load Cells—The rig 2 has load cells 1020 for monitoring WOB. It is contemplated that the signal from the load cell or similar type of sensor could be used, via a controller or control network or system, to control WOB. In this embodiment, each load cell is a 75,000-lb LP model from Honeywell. The average of the weights from the two load cells are calculated and displayed on the HMI (human machine interface) 1028 and also on the console 1029 in the control cabin 7 of the rig 2, as shown in FIG. 1G. The output signal from the PLC for interface to the control system is analog 4-20 mA (average of the 2 load cells) from pin 14 (the first analog output port). The output signal is duplicated by a DC multi-channel current duplicator (Action Industries, model Q404-4). One output signal is fed to the HMI ("Channel 1 Out") 1030 and the other ("Channel 2 Out") 1031 to the cRIO control system. (As seen in FIG. 1H.) The weight limits for each load cells should be set at −75,000 lbs to 75,000 lbs on the HMI screen. Moreover, because laser-mechanical drilling enables the use of substantially lower WOBs than are used in conventional mechanical drilling, preferably, the load cells or other WOB control equipment will be operable, and more accurate in these lower WOBs, typically, for laser-mechanical drilling these WOBs will be in ranges that are less than about 5,000 lbs, less than about 2,000 lbs, less than about 1,000 lbs and less than about 500 lbs.

Rig—Encoders—Encoder 1020 are used to monitory the depth (MD) of the laser bottom hole assembly and to calculate a rate of penetration ("ROP") of the laser-mechanical bit. It is contemplated that signals from the encoders, or similar monitoring devices could be used, via a controller, control network or system, to control MD and ROP. Two encoders 1020 are used in this embodiment. A "Gear Sensor" 1020*a* that is positioned on top of the injector is a 16-cycle per turn encoder BEI Sensors; model H25D-SS-16-AB-C-S-M16-EX-S. The second encoder 1020*b* in this embodiment is a "Friction Wheel" located at the bottom of the injector and has a higher resolution with 500 cycles per turn, which is also from BEI Sensors, model H20-EB-37-F28-SS-500-AB-S-M16. The 24V pulse trains (signals) are isolated from the hazardous area by BEI Intrinsic Barriers (model 924-60004-003) shown In FIG. 1I. The pulse trains A and B are 90 degrees out of phase and are routed to both the PLC and the control system for depth and ROP calculations. The HMI displays two depths and ROP readings from each encoder. The encoders are calibrated and for the current systems the K-factors are 465.067 and 39.73 for Friction Wheel and Gear Sensor, respectively. In this system the K-factors can be changed on the HMI touch-screen panel shown in FIG. 1G.

Rig—Pressure Transducer—In this embodiment nitrogen gas is used, compressed air or a transmissive, or substantially transmissive fluid may also be employed, as the motive fluid for the positive displacement motor ("PDM") used in the Laser Bottom Hole Assembly ("LBHA"), as well as, to keep the beam path clear and remove cuttings from the borehole. Nitrogen pressure to the coil tubing and thus the top of the LBHA, is monitored by a 5,000-psi pressure transducer 1032, which is manufactured by Stellar Technology Incorporated, Model GT2250-5000G-114. It is contemplated that single from the encoders or similar monitoring devices could be used, via a controller, control network or system (also integrated potentially into the nitrogen source control system), to control nitrogen pressure and also nitrogen flow rate 1033. Two encoders are used in this embodiment. This pressures transducer has a 24V DC excitation with 4-20 mA signal output for 0-5,000 psi. It measures the compressed gas pressure at input to the LBHA. Output signal from the PLC is an analog 4-20 mA (for 0 to 5,000 lbs).

Compressed gas valve/flow meter assembly—To monitor and control the flow of the motive fluid, in this embodiment nitrogen gas, a Nelles Rotaryglobe control valve (model ZXD02DATE060) with Quadra-power spring-diaphragm rotary actuator (model QPX2/K20) and Metso ND9000 Intelligent valve controller (model ND9103HNT-CE07) are used. This require a 4-20 mA analog signal from the controller to fully open the valve, which provides 4-20 mA signal indicating the vale position. There is also used a flow meter, which is a VorTek multiparameter Vortex shedding, model M22-VTP-16C600-L-DD-DCL-1AHL-ST-PS. This flow meter provides a 4-20 mA analog signal to indicate 0-2,000 cfm flow.

Oil Injection Valve—To lubricate the PDM in the LBHA a Model SV6001 from Omega with a DC coil Model SV12COIL-24DC pump is used. The oil from the pump is a metering type pump that injects the oil into a line that carries the oil into the LBHA, below the point where clean (for contact with optics) and oily (for providing motive force to the rotor-stator cavity) air paths are separated. The pump requires 24V DC to operate. The valve 1034 controls the flow of compressed air to the oil pump and thus provides only on-off control. Although, it is contemplated that, a metering pump that is monitored and controlled via a controller, control network or system, could be employed to monitor and control the oil flow.

Pressure transducer—To monitor that oil flow is taking place, at the oil injection section of the spool a sensor used. In this embodiment a 500-psi pressure transducer (model PX309-500G5V) 1035 is inserted in the line between the oil tank and the rotary union, on the spool. See FIG. 1C. (rotating pressure joints, and oil feed line) Thus, the flow of oil is observable, by way of pressure spikes upon pump cycles, at this point, as well as, any effect that the nitrogen pressure, or changes in nitrogen pressure, may have on oil pressure. This transducer requires a 24 V excitation voltage provided by the cRIO power supply and the output is 0-5 V for 0-500 psi pressure.

Accelerometers—Accelerometers 1011 are used as an indirect way to measure RPM of the motor, bit and LBHA. And, could also be used to measure other down hole and/or remote activities of a tools that have a predetermined vibration and/or movement pattern. This method eliminates the desirability, but not necessity of having a tachometer, or other device downhole to measure, and control based upon that measurement, motor RPM and thus bit RPM for the LBHA. It has been discovered that the RPMs of the motor can be determined based upon accelerometer data. Thus, an accelerometer(s) are placed on the coil tubing, a wire line, or other structure in mechanical-physical contact with the motor in the LBHA. The signal from the accelerometer is sampled at a particular rate, e.g., about 1,000 Hz, about 2,000 Hz, about 3,000 Hz and greater or lesser sample rates depending upon the particular configurations and anticipated RPMs. The accelerometer signal data is then processed to provide a power spectrum of a particular time interval. A power spectrum may be obtained by an FFT (Fast Fourier Transform). A four second interval, for a PDM rotating in the range of about 100-400 RPM is preferred, although longer or shorter intervals may be used this and other type motors and operating conditions. The power spectrum interval is associated with frequency windows, which windows are known to correspond to a particular RPM for a given motor, bit, or LBHA. Within the frequency window the frequency at the maximum value of the power spectrum for that window is then selected. This frequency is then provided in an HMI as the corresponding RPM. The correspondence of the power spectrum to RPM can be done by calculation based upon a known or determinable number of movements that measurable by a particular accelerometer, accelerations that will take place in a single revolution. For example knowing that a PDM has 8 nutations in a single revolution, this value could be used to calculate the correspondence of a frequency, to an RPM. Alternatively, the actual RPMs could be measured and the corresponding frequency observed, over various RPMs and thus a correspondence determined by observation.

In this embodiment there are two accelerometers that are located on the bottom of the injector 5, specifically on a device that is in direct contact with the coil tube as it exits the bottom of the injector. They are interfaced with the PC through an NI Hi-Speed USB carrier, due to lack of spare channels on the cRIO. This signal could be integrated into a controller, control system or network and which could then be used to control RPM. The signals from the accelerometers are plugged into the cabin PC via a high-speed USB connection. A 3-axis accelerometer by IMI-Sensors, part#629A31 are used in this embodiment. This will be mounted on or in physical-mechanical connection with the coil tubing to measure vibration on LBHA and the program calculates the power spectrum of the signals in 3 axes and determines the RPM of the LBHA. A 1-axis accelerometer by IMI-Sensors, part#622B01 will also be used in the embodiment. This unit will be mounted on the OSR to determine maximum g force experienced by the unit. The sample rates for the 3 axis accelerometer in this embodiment will be 3,200 Hz.

Optical Slip Ring—The optical slip ring (OSR) 12 allows the transmission of laser light from a stationary fiber optic cable to a rotating fiber optic cable. The OSR requires tap water and DI water from the laser chiller. It also requires purge gas flow 1016 for additional cooling. There are a water flow meter 1017 and an air flow meter which will monitor the flows to the OSR and are interlocked to provide warning in case of flow disruption.

OSR—Water Flow Meter—The OSR water flow meter consists of a sensor (part# PF2W504-NO3-2) and a display (part# PF2W301-A) manufactured by SMC corporation. The output is 4-20 mA for 0 to 4 L/min. A wiring configuration between this sensor, display and cRIO module NI9203 is shown in FIG. 1J.

OSR—Purge Gas Flow Meter—A loop-powered 0-15 sL/min gas mass flow meter (part# R-32468-19) from Cole-Parmer, is used to monitor the flow of purge gas to the OSR.

OSR Photodiodes and Leak Sensor—As integral parts of the OSR 12 design, there are two photodiodes 1036 and a "leak sensor" 1037 to monitor the stray light and any possible water leakage, respectively, inside the unit. The presence of stray light can signify that the components of the OSR have come out of alignment, or that other problems, or potential problems exist, or are beginning to develop with the optical system. FIG. 1K shows the side view of the OSR 12 where the detectors leads are located. A stand-alone power supply (located next to the cRIO) provides 15V and −15V to the sensors according the diagram. The location of the OSR photodiodes is shown in FIG. 1K. There are two photodiodes 1036 which monitor the intensity of the stray light inside the housing. The output range is 0-10V. A maximum intensity limit is established above which the control software warns the operator about any possible misalignment causing increase in stray light inside the unit. The wire connections to the cRIO are described in further in the wiring table (FIG. 1E) through the "feed thru" connector. The OSR water leak sensor acts as a binary switch, with a "high" state indicating water at the bottom of the unit. In normal operation, there is no output voltage (0V) but in presence of water the detector produces 15V. The input voltage range of the cRIO module (NI 9201), which monitors the detector, is 0-10 volts. Therefore a voltage clamping circuit 1038 is used (as shown in FIG. 1L) to reduce the input voltage to the module to below 10V in case of the detector's "high" state. The circuit consists of a simple 4.5V-Zener diode in series with a 1-k ohm resistor to determine the maximum voltage supplied to the cRIO module with reasonable current flow. The circuit is shown in FIG. 1L. Additionally, associated with the containment box 14, is splice monitor 1047, to detected and determine if a fiber splice in the box is failing or about to fail.

Emergency Stops—In this embodiment there are also two emergency stops, one in the cabin 1039*a* and one next to the injector outside 1039*b*. They are both interlocked in series for laser shut down in case of emergency. FIG. 1M shows the wiring diagram 1040 between the two and cRIO.

Flashing Hazard Lights—There are two kinds of flashing hazard lights 1041*a*, 1041*b* installed. Both kinds are model number 5808T94 from McMaster Carr. The first type are amber flashing hazard lights. There are two amber flashing lights in series located at different locations and are activated when the laser is ready to emit but there is no emission yet. "Program Start" signal from the laser (64-pin Hardwiring Interface Connector, pin A2) is used to control a DC relay, which would close the circuit and the lights are powered by the 24-V DC power supply. The second type of light are red flashing hazard lights. There are two red hazard lights of the same model in red color, as the yellow, the red lights are in series located at different locations in the yard. They are activated when there is laser emission. "Emission Status" signal from the laser (64-pin Hardwiring Interface Connector, pin B2) is used to control a DC relay, which would close the circuit and the lights are powered by the 24-V power supply.

The system further may have the capability through an HMI and/or a GUI, to display data, display stored data, display real-time data and operating parameter, adjust real-time operating parameters, show historic trends of information such as data and/or operating conditions and other display functions that may be useful, helpful or beneficial to the operation of the unit.

Figure 1Q:
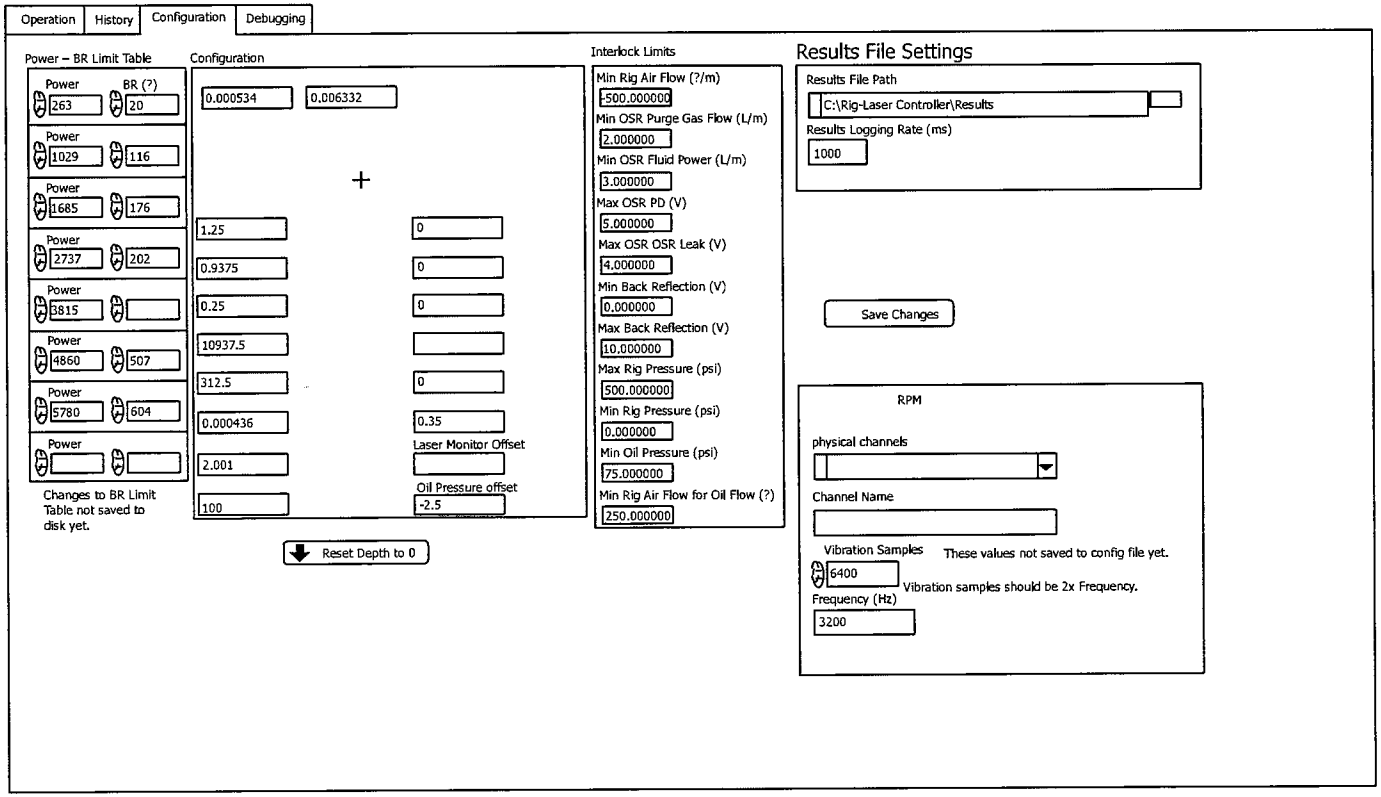

Thus, for example, FIG. 1O illustrates a display showing real-time operating data and conditions of the unit and provides the ability to adjust those parameters. FIG. 1P illustrates a display showing real-time and historic operating data and conditions, e.g., as graphs having the current data and also including earlier data for a preselected moving time period. FIG. 1Q illustrates a display showing limits for back reflects at various points in the system and provides the operator the ability to set such limits. FIG. 1R provides an illustration of a data log, or summary that may be stored and displayed by the system.

The control and monitoring systems for laser units may include and be based upon PLC based control system, soft PLC or computer based control system and would include distributed control networks, control networks, and other types of control systems general known to or used by those of skill in the factory automation and equipment automation arts. These monitoring and control system may include robotic systems, motion control and drive systems, (radio frequency Identification device) RFID systems, RF systems, and machine vision systems. They may be based upon or utilize the equipment and software of Allen-Bradley (Rockwell), Siemens, GE, Modicon (Schneider Electric) and Opto 22, by way of example. Further, these systems may be internet based, or accessible, and thus provide for the automatic and remote monitoring, upgrades, software maintenance of the overall system or components of that system.

These control and monitoring systems may be used for any high power laser unit, system or tool. These control and monitoring systems my be used with, for example, the laser units shown in FIG. 2, 3, 4, 5 or 6. By way of example control systems are illustrated for the units FIGS. 2 and 5, in FIGS. 2A and 5A respectively.

Figure 2:
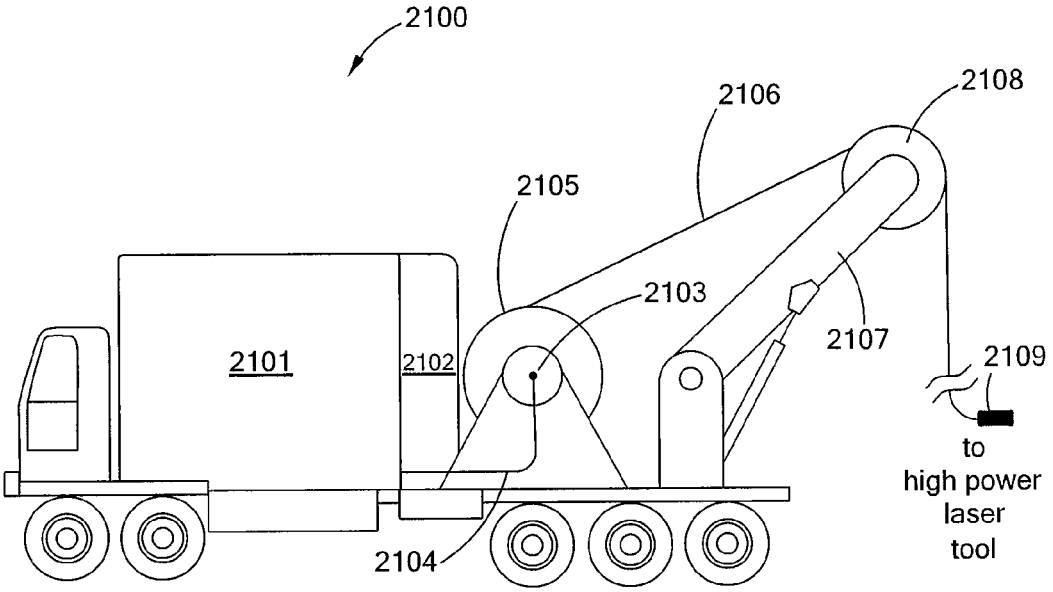
FIG. 2 is schematic view of an embodiment of a mobile laser truck unit in accordance with the present invention.

In FIG. 2 there is provided an embodiment of a mobile high power laser beam delivery unit or system 2100. In the embodiment there is shown a laser room 2100. The laser room 2100 houses a 40 kW fiber laser (other laser and laser configurations may be used, such as for example 2 20 kW fiber laser), a chiller 2102, and a laser system controller, which is preferably capable of being integrated with a control system for a high power laser tool. A high power fiber 2104 leaves the laser control room 2101 and enters an optical slip ring 2103, thus optically associating the high power laser with the optical slip ring. Within the optical slip ring the laser beam is transmitted from a non-rotating optical fiber to the rotating optical fiber that is contained within the optical cable 2106 that is wrapped around spool 2105. The optical cable 2106 is associated with cable handling device 2107 that has an optical cable block 2108. The optical cable block provides a radius of curvature when the optical cable is run over it such that bending losses are minimized. When determining the size of the spool, the block or other optical cable handling devices care should be taken to avoid unnecessary bending losses to the fiber. The optical cable 2106 has a connector/coupler device 2109 that attaches (optically associates with) to the high power laser device such as a high power laser tool. The device 2109 may also mechanically connect to the tool, a separate mechanical connection device may be used, or a combination mechanical-optical connection device may be used.

The optical cable 2106 has at least one high power optical fiber, and may have additional fibers, as well as, other conduits, cables etc. for providing and receiving material, data, instructions to and from the high power laser tool. Although this system is shown as truck mounted, it is recognized the system could be mounded on, or in, other mobile or moveable platforms, such as a skid, a shipping container, a boat, a barge, a rail car, a drilling rig, a work over rig, a work boat, a vessel, a work over truck, a drill ship, or it could be permanently installed at a location.

Figure 2A:
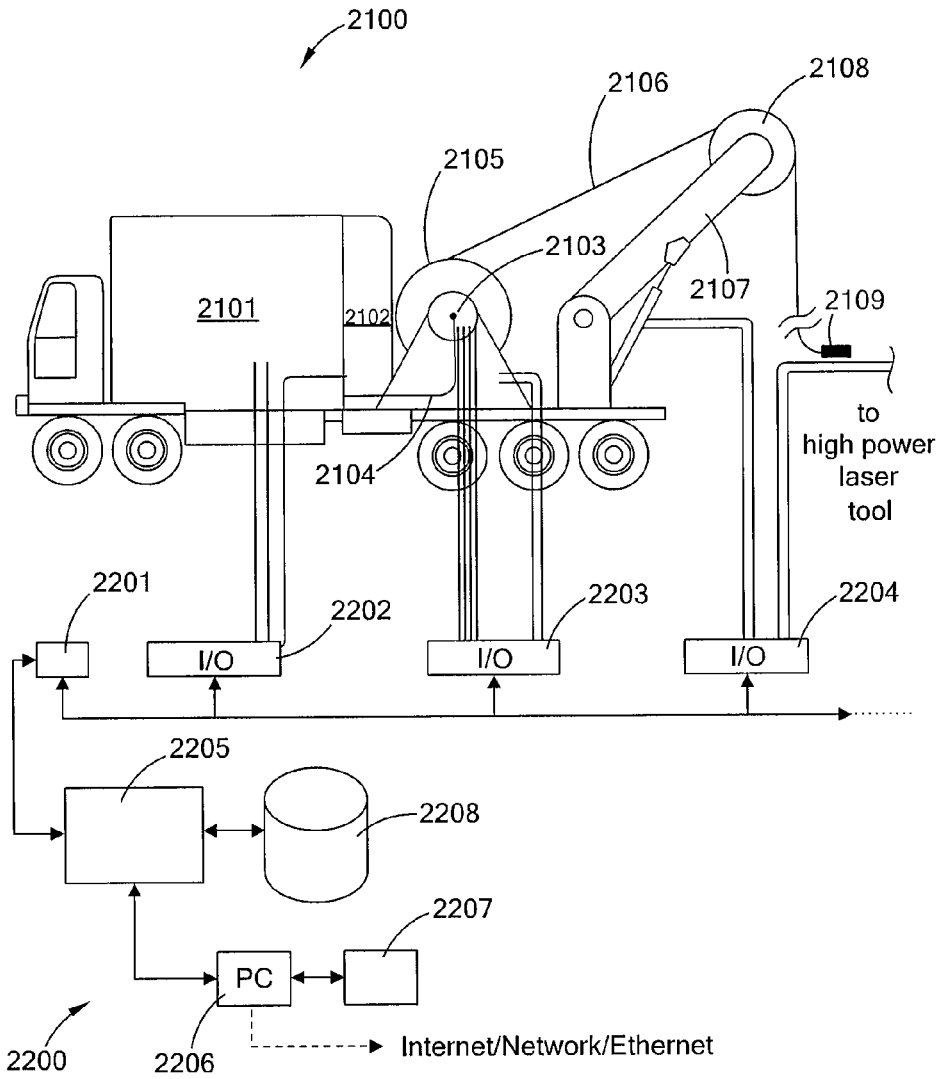
FIG. 2A is a schematic of an embodiment of a control and monitoring system for the unit of FIG. 2, in accordance with the present invention.

An example of a monitoring and control system 2200 for the unit 2100 is shown in FIG. 2A. In this figure there is provided a control network 2201, which for simplicity is illustrated as having three I/O units 2202, 2203, 2204 that are networked together and connected to a controller. The controller 2205 is connoted to a PC 2206 and HMI 2207. A storage device 2208 may also be associated with the controller, as shown, or generally with network, system, or PC.

Varies sensors and actuators, shown by the lines extending from the I/O are located in the unit 2100. These sensors provide signals regarding operating status and conditions of the unit, etc. and the actuators implement control functions based, in part, upon those signals and the programming of the controller. The controller may be programmed or configured by way of the PC-HMI, further real-time data, trends and stored data may be displayed on the HMI. Security codes, passwords, etc. may be implemented to restrict features, functions and access to various levels of personnel.

The flexibility of such a control network system provides the ability to control may complex functions of the unit, such as the operation of the laser tool, the operation of the laser, the operation of the OSR, as well as, having various interlocks and other procedures. The sensors may further monitor optical fiber continuity, (along various key points or the entirety of the system) back reflections (at key points or the entirety of the system), and power of laser beam being delivered from the tool, by way of example. Moreover, the system may have preset or predetermined shut down and operations sequences or parameter to address particular situations, and in particular situations that are unique to the utilization of high power laser energy. For example, if a flow a air is required at all times to maintain the optics in the down hole laser tool free from debris, than the system can be configured to always provide a minimum flow of such gas, even when an emergency shut off of the laser has occurred.

The control networks of the present inventions may be, for example, Ethernet based networks, wireless networks, dedicated or specified automation and control based networks, e.g., employing protocols, such as, MODBUS, PROFiBUS, optical fiber networks, which may include the high power optical fiber, networks of the type and configuration of the embodiment in FIGS. 1 and 1A to 1N, and combinations and variations of these and other types of automation and control networks now available or later developed.

Figure 2B:
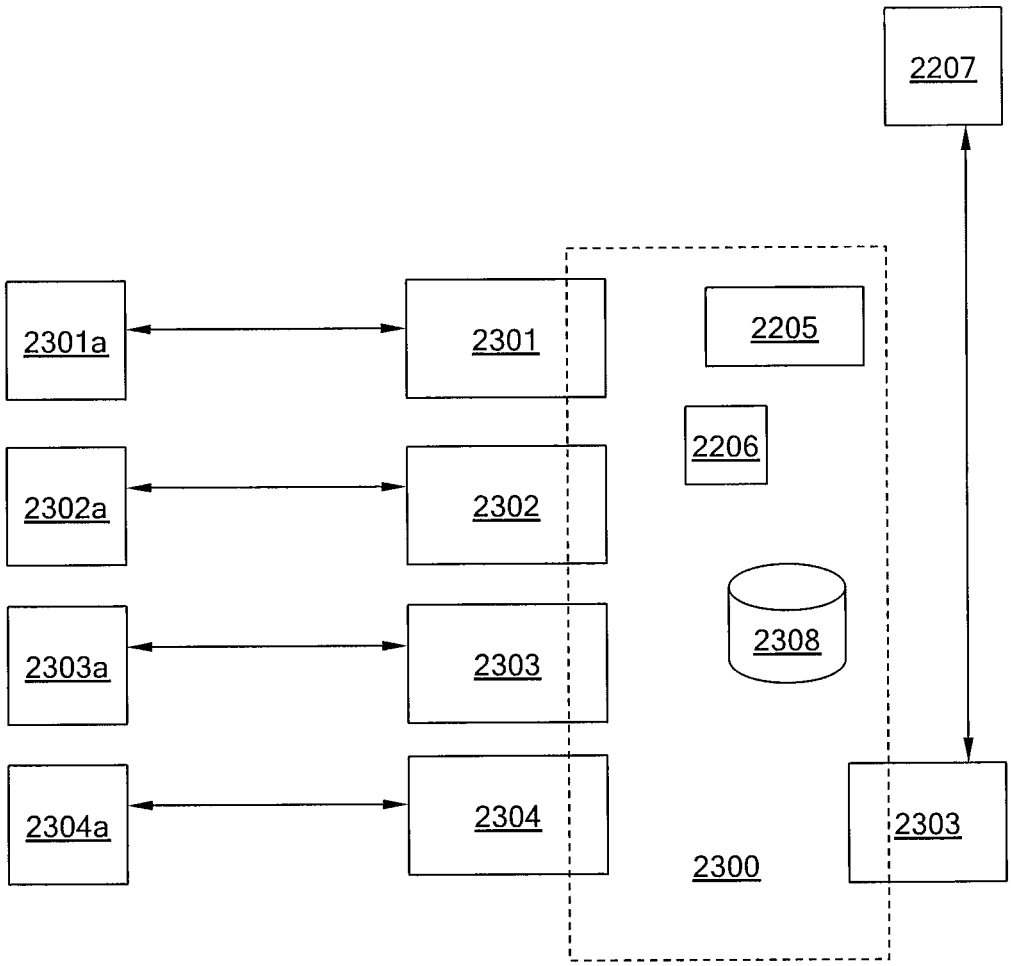
FIG. 2B is a schematic of the control and monitoring system of FIG. 2A.

The control system 2200 architecture is further illustrated in the schematic diagram of FIG. 2B. Module 2301 is in communication with device 2301*a*, such as sensors, actuators, interfaces and other devices associated with the source of high power laser energy, including for example the fiber lasers, a back reflection monitor, a cooling water flow sensor, photo diode, thermal couple, a cooling water flow actuator, interlock, interlocks, laser room temperature sensor, laser room humidity sensor, laser room door sensor, a temperature sensor, or a communication interface to the laser system controller. The communication provides for data and control information to be sent and received between the module 2301 and the devices 2301*a*.

Module 2302 is in communication with device 2302*a*, such as sensors, actuators, interfaces and other devices associated with the tubing assembly, including, for example an OSR leak detector, splice monitor, photo diode, thermal couple, sensor for spool position, optical fiber leak detector (located at the distal end, which is adjacent the tool, the proximal end which is adjacent the laser and/or along the length of the fiber), interlocks, humidity sensor, a communication interface to the handling device control system, regulator for working fluid flow, sensor for working fluid flow, back reflection detectors, spool rotation actuators, temperature sensors, or an interface to the spool control system. The communication provides for data and control information to be sent and received between the module 2302 and the devices 2302*a*.

Module 2303 is in communication with device 2303*a*, such as sensors, actuators, interfaces and other devices associated with the high power laser tool, including, for example a leak detector, a connector monitor, an interface to a MWD or LWD module or system, temperature sensor; RPM sensor, laser cutting head position indicator, cut completion monitor, spectrometer, interlocks, a communication interface to the tool control system, regulator for working fluid flow, sensor for working fluid flow, back reflection detectors, video camera, photo diode, thermal couple, or an interface to a directional drilling module or system. The communication provides for data and control information to be sent and received between the module 2303 and the devices 2303*a*.

Module 2304 is in communication with device 2304*a*, such as sensors, actuators, interfaces and other devices associated with the motive mean for the high power laser tool, for example a down hole tractor, an ROV, a laser PIG, an injector and would including, for example a load cell, a strain sensor, an interface to a tractor control system, an interface to an ROV control system, a reel actuator, a reel position sensor, an injector actuator, a means to determine depth and/or distance from the surface, interlocks, packer actuator. The communication provides for data and control information to be sent and received between the module 2304 and the devices 2304*a*. Further, as the tool and the motive means for the tool may be integral, as potentially in the case of a down hole tractor or laser PIG, the device 2304*a* may be interchangeable with, a part of, integral with, or included among with the device 2303*a*.

Module 2305 is in communication with a human machine interface 2207. The communication provides for data and control information to be sent and received between the module 2304 and the devices 2304*a*.

A control module 2300 is in communication with the modules 2301, 2302, 2303, 2304, 2305 and the controller 2203, the PC 2206, and the storage device 2208. The control module is configured to provide for data and control information to be sent and received between the control module 2300 and the modules 2301, 2302, 2303, 2304, 2305 to monitor, and control the operation of the unit 2100.

Further, the sensors, actuators, interfaces, systems and other devices and the modules of the embodiment of FIG. 2B, may also be, include and utilize the components modules and configurations of the systems in FIGS. 1, and 1A to 1R.

Figure 3:
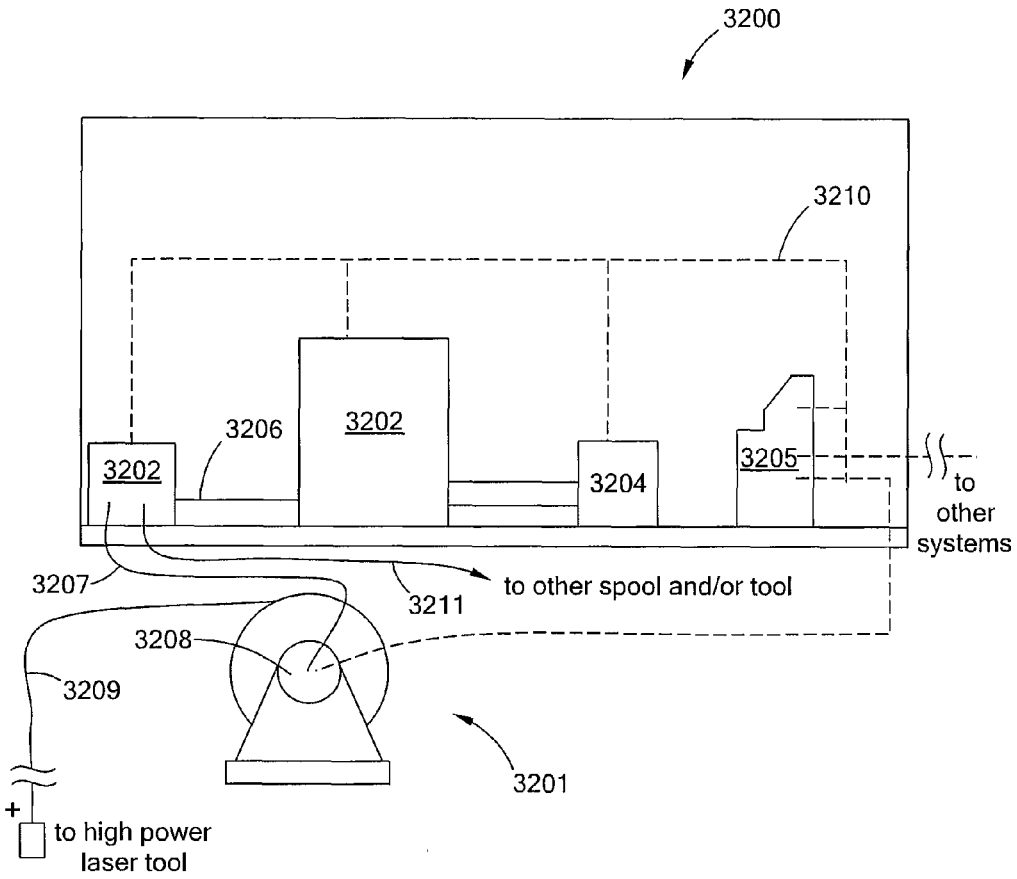
FIG. 3 is a schematic view of an embodiment of a control and monitoring system in accordance with the present invention.

In FIG. 3 there is provided a schematic drawing of an embodiment of a laser room 3200 and spool 3201. In this embodiment the laser room 3200 contains a high power beam switch 3202, a high power laser unit 3203 (which could be a number of lasers, a single laser, or laser modules, collectively having at least about 5 kW, 10 kW, 20 kW, 30 kW 40 kW, 70 kW or more power), a chiller or connection to a chiller assembly 3204 for the laser unit 3203 and a control counsel 3205 that preferably is in control communication with a control system and network 3210. Multiple lasers may be used with a high power beam combiner to launch a about a 40 kW or greater, about a 60 kW or greater and about a 100 kW or greater laser beam down a single fiber.

Preferably, the larger comments of the chiller 3204, such as the heat exchanger components, will be located outside of the laser room 3200, both for space, noise and heat management purposes. The high power laser unit 3203 is optically connected to the beam switch 3202 by high power optical fiber 3206. The beam switch 3202 optically connects to spool 3201 by means of an optical slip ring 3208, which in turn optically and rotationally connects to the optical cable 3209. In higher power systems, e.g., greater than 20 kW the use of multiple fibers, multiple beam switches, and other multiple component type systems may be employed. The optical cable is then capable of being attached to a high power laser tool. A second optical cable 3211, which could also be just an optical fiber, leaves the beam switch 3202. This cable 3211 could be used with a different spool for use with a different tool, or directly connect to a tool. Electrical power can be supplied from the location where the laser room is located, from the mobile unit that transported the laser room, from separate generators, separate mobile generators, or other sources of electricity at the work site or bought to the work site. Other optical configurations and transmitting components, instead of, in combination with, or in addition to the optical slip rings and beam switches may be utilized.

Preferably in a high power laser system a controller is in communication, via a network, cables fiber or other type of factory, marine or industrial data and control signal communication medium with the laser tool and potentially other systems at a work site. The controller may also be in communication with a first spool of high power laser cable, a second spool of high power laser cable and a third spool of high power laser cable, etc.

In FIG. 4 there is provided an embodiment of a high power laser drilling workover and completion system as deployed in the field for conducting drilling operations, using a LBHA, that is powered by a PDM. A control system as described in detail above, as generally shown in FIGS. 2A, 5A or as otherwise taught or disclosed herein may be used with this system. The control system may be expanded, or networked with other control systems, to provide an integrated control network for some, or all of the components disclosed in that deployment. Thus, the laser drilling system 4000 is shown as deployed in the field in relation to the surface of the earth 4030 and a borehole 4001 in the earth 4002. There is also an electric power source 4003, e.g. a generator, electric cables 4004, 4005, a laser 4006, a chiller 4007, a laser beam transmission means, e.g., an optical fiber, optical cable, or conveyance device 4008, a spool or real 4009 for the conveyance device, a source of working fluid 4010, a pipe 4011 to convey the working fluid, a down hole conveyance device 4012, a rotating optical transition device 4013, a high power laser tool 4014, a support structure 4015, e.g., a derrick, mast, crane, or tower, a handler 4016 for the tool and down hole conveyance device, e.g., an injector, a diverter 4017, a BOP 4018, a system to handle waste 4019, a well head 4020, a bottom 4021 of the borehole 4001, a connector 4022.

Further control systems and networks, for individual drill sites, fields, work locations, or units may be linked together to provide realtime data and information to a centralized location. Further the centralized location may have control over ride, co-control, and/or authorization control capabilities. Thus, such a remote location may have to be pooled and approval received prior to a particular command or operation being initiated. For example, remote approval could be required before stored data is deleted or transferred; or before the laser was fired for the first time, to insure a level of approval prior to the first operation of the laser.

In addition to the injector, gravity, pressure, fluids, differential pressure, buoyancy, a movable packer arrangement, and tractors, PIGs, ROVs, crawlers and other motive means may be used to advance the laser tool to its location of operation, such as for example to advance the laser tool to a predetermined location on an off shore platform to be decommissioned, a predetermined location in a borehole, for example, the bottom of the borehole so that it may be laser-mechanically drilled to drill and advance the borehole.

Figure 5:
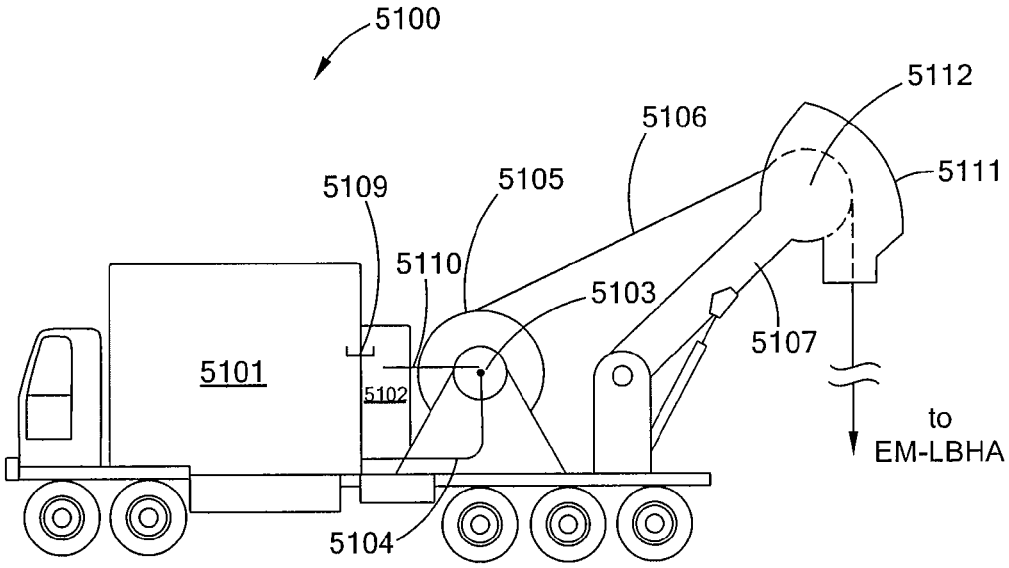
FIG. 5 is schematic view of an embodiment of a mobile truck laser unit for an electric motor laser bottom hole assembly ("EM-LBHA") in accordance with the present invention.
Figure 5A:
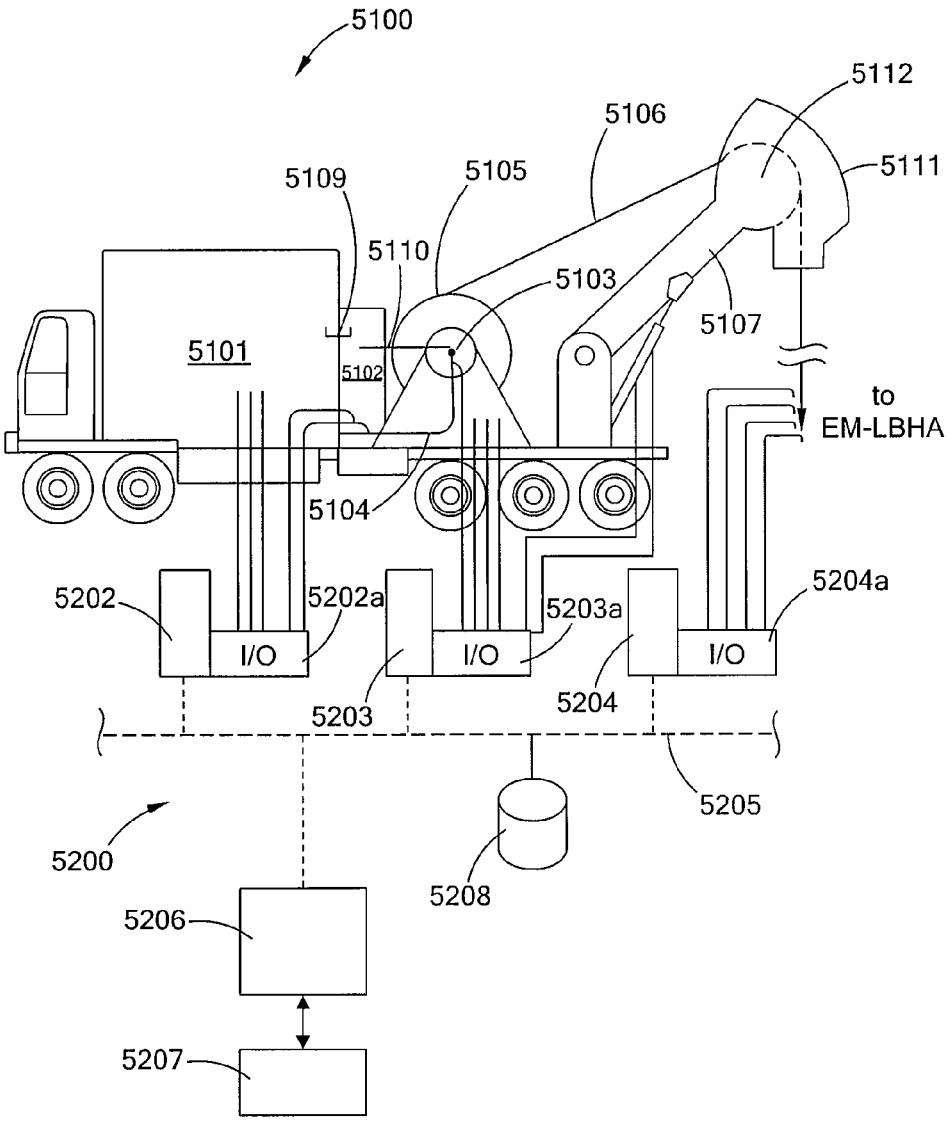
FIG. 5A is a schematic of a distributed control system for the laser unit of FIG. 5.

In FIG. 5 there is provided an embodiment of a mobile high power laser beam delivery system 5100 for use with an EM-LBHA (electric motor laser bottom hole assembly) for advancing boreholes. In the embodiment there is shown a laser room 5100. The laser room 5100 houses a 60 kW source of laser energy, which may be one, two, three or more fiber lasers, a chiller (or chiller interface, so that the larger heat exchanger and management section of the chiller unit can be located outside of the laser room either), a source of electrical power 5102, and a laser system controller, which is preferably capable of being integrated with a control system for the EM-LBHA. One, two or several, high power fiber(s) 5104 leaves the laser room 5101 and enters an electrical slip ring/optical slip ring assembly 5103, (for the purposes of illustration both the high power optical fiber(s) 5104 and the electrical power line 5110 are shown going into the same side of the spool; it is noted that the fiber and the electrical line could connect on different or opposites sides of the spool). There is also shown an electrical line to power the lasers 5109. (It being under stood that a separate generator, no on the truck may be employed, and in some configurations may be preferable to reduce or eliminate vibration, noise, and to reduce the overall foot print or area of the laser unit 5100.) The conveyance device 5106, e.g. a composite tube having electrical lines and optical fibers built into is wall is wound around spool 5105. Within the electrical/optical slip ring the laser beam is transmitted from a non-rotating optical fiber to the rotating optical fiber that is contained within the conveyance device 5106 that is wrapped around spool 5105. Similarly, the electrical from electric power line 5110 is transferred by the electrical slip ring to the electric power lines in conveyance device 5106.

The conveyance device 5106 is associated with injector 5111 for advancing and retrieving the conveyance device, which injector is associated with a handling device 5107. Within the injector 5111 there is a path of travel 5112 that has a minim radius of curvature when the conveyance device 5106 is run through the injector 5111. This minim radius should be such as to reduce or eliminate bending losses to the laser beam energy. When determining the size of the minim radius, the spool, or other conveyance device handling devices care should be taken to avoid unnecessary bending losses to the optical fiber associated with the conveyance device.

The conveyance device should have at least one high power optical fiber, may have an electric power source for the electric motor and may have additional fibers, as well as, other conduits, cables etc. for providing and receiving material, data, instructions to and from the electric motor bottom hole assembly, optics and/or bit. Although this system is shown as truck mounted, it is recognized the system could be mounded on or in other mobile or moveable platforms, such as a skid, a shipping container, a boat, a barge, a rail car, a drilling rig, a work boat, a work over rig, a work over truck, a drill ship, or it could be permanently installed at a location.

In general, and by way of example a laser room may contain a high power beam switch, a high power laser source (which could be a number of lasers, a single laser, or laser modules, collectively having at least about 5 kW, 10 kW, 20 kW, 30 kW 40 kW, 70 kW or more power), a chiller or a connection to a chiller assembly for the laser unit and a control counsel that preferably is in control communication with a control system and network. Preferably, the larger comments of the chiller, such as the heat exchanger components, will be located outside of the laser room, both for space, noise and heat management purposes. In higher power systems, e.g., greater than 20 kW the use of multiple fibers and other multiple component type systems may be employed. The optical fiber in the conveyance device is then capable of being attached to a high power EM-LBHA, optics and/or bit. Electrical power can be supplied from the location where the laser room is located, from the mobile unit that transported the laser room, from separate generators, separate mobile generators, or other sources of electricity at the work site or bought to the work site. Separate or the same sources of electric for the laser and the EM-LBHA may be employed, depending upon, such factors as cost, availability power requirements, type of power needed etc.

In FIG. 5A there is shown an illustration of a distributed control network or system 5200 for the laser unit or system of the embodiment of FIG. 5. In FIG. 5 there is shown a series of several controllers 5202, 5203, 5204, each having its own I/O 5202*a*, 5203*a*, 5204*a* and associated sensor and actuators. The controllers are then configured on a control network 5235. In this manner a separate controller can be focused on specific task or specific section of the laser unit, yet still be in control communication with the other controllers. Thus, for example a control may primarily focus on the laser, laser delivery system and fiber continuity, while another may focus on the operation, monitoring and control of the electric motor. The control network 5204 is connoted to a PC 5206 and HMI 5207 and a storage device 5208. Varies sensors and actuators, shown by the lines extending from the I/O are located in the unit 5100. These sensors provide signals regarding operating status and conditions of the unit, etc. and the actuators implement control functions based, in part, upon those signals and the programming of the controller. The controllers may be programmed or configured by way of the PC-HMI, further real-time data, trends and stored data may be displayed on the HMI. Security codes, passwords, etc. may be implemented to restrict features, functions and access to various levels of personnel.

Figure 6:
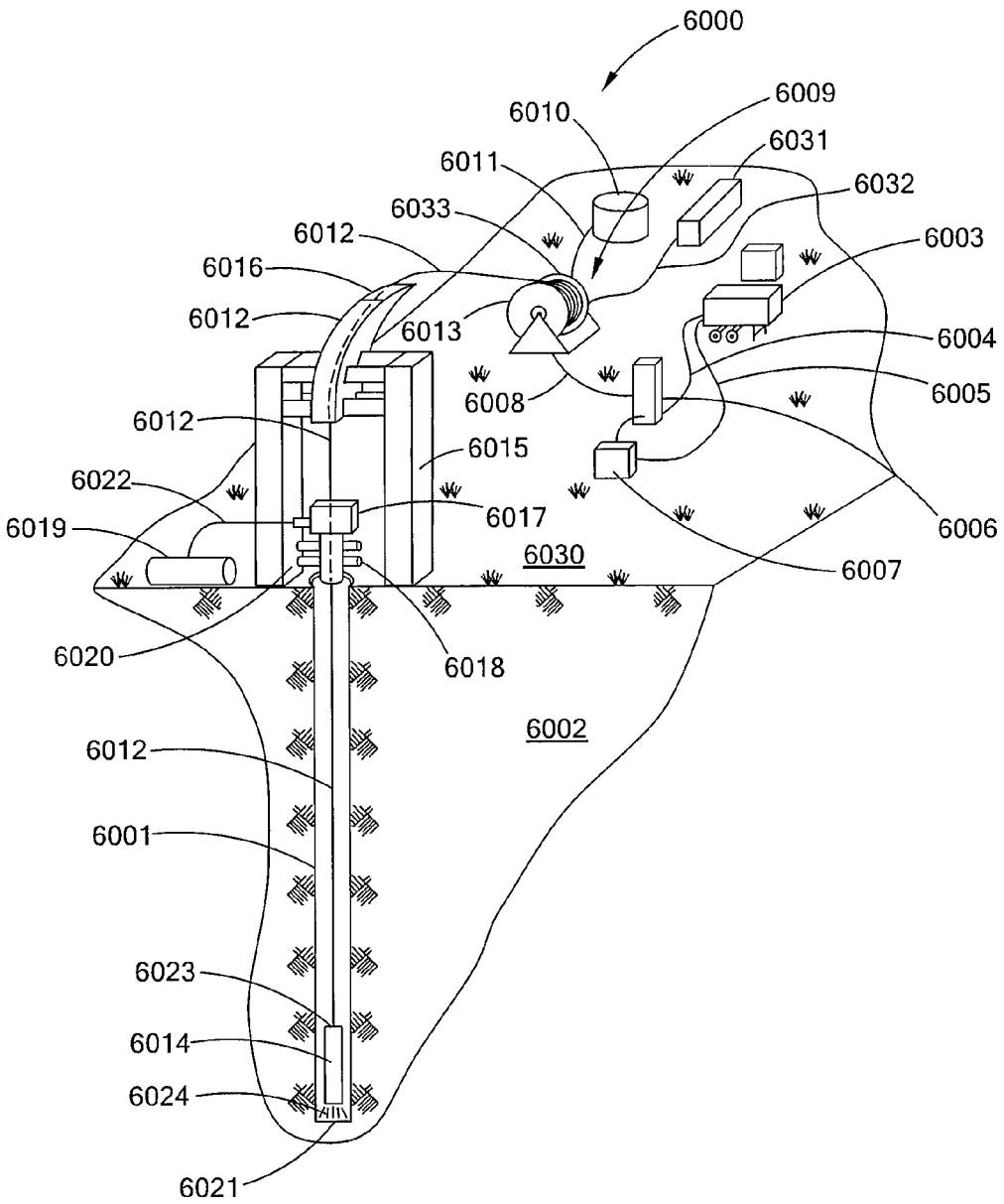
FIG. 6 is a schematic view of an embodiment of laser unit as deployed and utilizing an EM-LBHA in accordance with the present invention.

In FIG. 6 there is shown an illustrated drawing of a laser drilling, workover and completion system as deployed and utilizing an electric motor in a LBHA (EM-LBHA) for drilling activities. A control system as described in detail above, as generally shown in FIGS. 2A, 5A or as otherwise taught or disclosed herein may be used with this system. The control system may be expanded, or networked with other control system, to provide an integrated control network for some, or all of the components disclosed in that deployment. Thus, the laser drilling system 6000 is shown as deployed in the field in relation to the surface of the earth 6030 and a borehole 6001 in the earth 6002. There is also an electric power source 6003, e.g. a generator, electric cables 6004, 6005, a laser 6006, a chiller 6007, a laser beam transmission means, e.g., an optical fiber, optical cable, or conveyance device 6008, a spool or real 6009 for the conveyance device, a source of working fluid 6010, a pipe 6011 to convey the working fluid, a down hole conveyance device 6012, a rotating optical transition device 6013, an EM-LBHA 6014, a support structure 6015, e.g., a derrick, mast, crane, or tower, a handler 6016 for the tool and down hole conveyance device, e.g., an injector, a diverter 6017, a BOP 6018, a system to handle waste 6019, a well head 6020, a bottom 6021 of the borehole 6001, a connector 6022.

Further embodiments and teachings regarding high power optical fiber cable, fibers and the systems and components for delivering high power laser energy over great distances from the laser to a remote location for use by a tool are disclosed and set forth in detail in the following US Patent Applications and US Patent Application Publications: 2010/0044106, 2010/0215326, 2010/0044103, and 2012/0020631, the entire disclosures of each of which are incorporated herein by reference. These embodiments may be used in conjunction with, and thus monitored and controlled by, the control systems set forth in this specification.

One or more high power optical fibers, as well as, lower power optical fibers may be used or contained in a single cable that connects the tool to the laser system, this connecting cable could also be referred to herein as a tether, an umbilical, wire line, or a line structure. The optical fibers may be very thin on the order of hundreds of μm (microns), e.g., greater than about 100 μm. These high power optical fibers have the capability to transmit high power laser energy having many kW of power (e.g., 5 kW, 10 kW, 20 kW, 50 kW or more) over many thousands of feet. The high power optical fibers further provides the ability, in a single fiber, although multiple fibers may also be employed, to convey high power laser energy to the tool, convey control signals to the tool, and convey back from the tool control information and data (including video data). In this manner the high power optical fiber has the ability to perform, in a single very thin, less than for example 1000 μm diameter fiber, the functions of transmitting high power laser energy for activities to the tool, transmitting and receiving control information with the tool and transmitting from the tool data and other information (data could also be transmitted down the optical cable to the tool). As used herein the term "control information" is to be given its broadest meaning possible and would include all types of communication to and from the laser tool, system or equipment.

The laser systems of the present invention may utilize a single high power laser, or they may have two or three high power lasers, or more. High power solid-state lasers, specifically semiconductor lasers and fiber lasers are preferred, because of their short start up time and essentially instant-on capabilities. The high power laser beam may have 10 kW, 20 kW, 40 kW, 80 kW or more power; and have a wavelength in the 800 nm to 1600 nm range. The high power lasers for example may be fiber lasers or semiconductor lasers having 10 kW, 20 kW, 50 kW or more power and, which emit laser beams with wavelengths from about 1083 to about 2100 nm, for example about the 1550 nm (nanometer) ranges, or about 1070 nm ranges, or about the 1083 nm ranges or about the 1900 nm ranges (wavelengths in the range of 1900 nm may be provided by Thulium lasers). Examples of preferred lasers, and in particular solid-state lasers, such as fibers lasers, are disclosed and taught in the following US Patent Application Publications 2010/0044106, 2010/0044105, 2010/0044103, 2010/0215326 and 2012/0020631, the entire disclosure of each of which are incorporated herein by reference. By way of example, and based upon the forgoing patent applications, there is contemplated the use of a 10 kW laser, the use of a 20 kW, the use of a 40 kW laser, as a laser source to provide a laser beam having a power of from about 5 kW to about 40 kW, greater than about 8 kW, greater than about 18 kW, and greater than about 38 kW at the work location, or location where the laser processing or laser activities, are to take place. There is also contemplated, for example, the use of more than one, and for example, 4, 5, or 6, 20 kW lasers as a laser source to provide a laser beam having greater than about 40 kW, greater than about 60 kW, greater than about 70 kW, greater than about 80 kW, greater than about 90 kW and greater than about 100 kW. One laser may also be envisioned to provide these higher laser powers.

High powered optical cables, spools of cables, creels, and reels of cables of the type disclosed and taught in the following US Patent Applications and US Patent Application Publications: 2010/0044104, 2010/0044103, 2010/0215326, 2012/0020631, Ser. No. 13/366,882, and Ser. No. 13/210,581, the entire disclosures of each of which are incorporated herein by reference, may be preferably used as high power laser cables, structures and conveyance and deployment devices. Thus, the laser cable may be: a single high power optical fiber; it may be a single high power optical fiber that has shielding; it may be a single high power optical fiber that has multiple layers of shielding; it may have two, three or more high power optical fibers that are surrounded by a single protective layer, and each fiber may additionally have its own protective layer; it may contain other conduits such as a conduit to carry materials to assist a laser cutter, for example oxygen; it may have other optical or metal fiber for the transmission of data and control information and signals; it may be any of the combinations set forth in the forgoing patents and combinations thereof.

In general, the optical cable, e.g., structure for transmitting high power laser energy from the system to a location where high power laser activity is to be performed by a high power laser device or tool, may, and preferably in some applications does, also serve as a conveyance device for the high power laser device or tool. The optical cable, e.g., conveyance device can range from a single optical fiber to a complex arrangement of fibers, support cables, shielding on other structures, depending upon such factors as the environmental conditions of use, tool requirements, tool function(s), power requirements, information and data gathering and transmitting requirements, etc.

Generally, the optical capable may be any type of line structure that has a high power optical fiber associated with it. As used herein the term line structure should be given its broadest construction, unless specifically stated otherwise, and would include without limitation, wireline, coiled tubing, logging cable, cable structures used for completion, workover, drilling, seismic, sensing logging and subsea completion and other subsea activities, scale removal, wax removal, pipe cleaning, casing cleaning, cleaning of other tubulars, cables used for ROV control power and data transmission, lines structures made from steel, wire and composite materials such as carbon fiber, wire and mesh, line structures used for monitoring and evaluating pipeline and boreholes, and would include without limitation such structures as Power & Data Composite Coiled Tubing (PDT-COIL) and structures such as Smart Pipe®. The optical fiber configurations can be used in conjunction with, in association with, or as part of a line structure.

These optical cables may be very light. For example an optical fiber with a Teflon shield may weigh about ⅔ lb per 1000 ft, an optical fiber in a metal tube may weight about 2 lbs per 1000 ft, and other similar, yet more robust configurations may way as little as about 5 lbs or less, about 10 lbs or less, and about 100 lbs or less. Should weight not be a factor and for very harsh and/or demanding uses the optical cables could weight substantially more.

The tools that are useful with high power laser systems, and which can be controlled and monitored by the control systems described herein, many generally be laser cutters, laser cleaners, laser monitors, laser welders and laser delivery assemblies that may have been adapted for a special use or uses. Configurations of optical elements for culminating and focusing the laser beam can be employed with these tools to provide the desired beam properties for a particular application or tool configuration. A further consideration, however, is the management of the optical effects of fluids or debris that may be located within the beam path between laser tool and the work surface.

It is advantageous to minimize the detrimental effects of such fluids and materials and to substantially ensure, or ensure, that such fluids do not interfere with the transmission of the laser beam, or that sufficient laser power is used to overcome any losses that may occur from transmitting the laser beam through such fluids. To this end, mechanical, pressure and jet type systems may be utilized to reduce, minimize or substantially eliminate the effect of these fluids on the laser beam. The control systems can monitor and control some, primary, preferably significant, and most preferably all major operations, parameters or conditions of such high power laser equipment, processes and activities.

For example, mechanical devices may be used to isolate the area where the laser operation is to be performed and the fluid removed from this area of isolation, by way of example, through the insertion of an inert gas, or an optically transmissive fluid, such as an oil, kerosene, or diesel fuel. The use of a fluid in this configuration has the added advantage that it is essentially incompressible. Preferably, if an optically transmissive fluid is employed the fluid will be flowing. In this manner the overheating of the fluid, from the laser energy passing through it, may be avoided use of an optically fluid will be flowing. Moreover, a mechanical snorkel like device, or tube, which is filled with an optically transmissive fluid (gas or liquid) may be extended between or otherwise placed in the area between the laser tool and the work surface or area. A jet of high-pressure gas may be used with the laser beam. The high-pressure gas jet may be used to clear a path, or partial path for the laser beam. The gas may be inert, or it may be air, oxygen, or other type of gas that accelerates the laser cutting. The use of oxygen, air, or the use of very high power laser beams, e.g., greater than about 1 kW, could create and maintain a plasma bubble, a vapor bubble, or a gas bubble in the laser illumination area, which could partially or completely displace the fluid in the path of the laser beam. If such a bubble is utilized, preferably the size of the bubble should be maintained as small as possible, which will avoid, or minimize the loss of power density. The control systems can monitor and control some, primary, preferably significant, and most preferably all major operations, parameters or conditions of such high power laser equipment, processes and activities.

A high-pressure laser liquid jet, having a single liquid stream, may be used with the laser beam. The liquid used for the jet should be transmissive, or at least substantially transmissive, to the laser beam. In this type of jet laser beam combination the laser beam may be coaxial with the jet. This configuration, however, has the disadvantage and problem that the fluid jet does not act as a wave-guide. A further disadvantage and problem with this single jet configuration is that the jet must provide both the force to keep the drilling fluid away from the laser beam and be the medium for transmitting the beam. The control systems can monitor and control some, primary, preferably significant, and most preferably all major operations, parameters or conditions of such high power laser equipment, processes and activities.

A compound fluid laser jet may be used as a laser tool. The compound fluid jet has an inner core jet that is surrounded by annular outer jets. The laser beam is directed by optics into the core jet and transmitted by the core jet, which functions as a waveguide. A single annular jet can surround the core, or a plurality of nested annular jets can be employed. As such, the compound fluid jet has a core jet. This core jet is surrounded by a first annular jet. This first annular jet can also be surrounded by a second annular jet; and the second annular jet can be surrounded by a third annular jet, which can be surrounded by additional annular jets. The outer annular jets function to protect the inner core jet from the drill fluid present in the annulus between the laser cutter and the structure to be cut. The core jet and the first annular jet should be made from fluids that have different indices of refraction. Further details, descriptions, and examples of such compound fluid laser jets and laser cutting assemblies, systems and methods are disclosed and taught in U.S. patent application Ser. No. 13/222,931, the entire disclosure of which is incorporated herein by reference. The systems of the present inventions can monitor and control, for example, some, primary, preferably significant, and most preferably all major operations, parameters or conditions of such high power laser equipment, processes and activities.

The angle at which the laser beam contacts a surface of a work piece may be determined by the optics within the laser tool or it may be determined the positioning of the laser cutter or tool. The laser tools have a discharge end from which the laser beam is propagated. The laser tools also have a beam path. The beam path is defined by the path that the laser beam is intended to take, and extends from the discharge end of the laser tool to the material or area to be illuminated by the laser. The systems of the present inventions can, for example monitor and adjust beam properties, tool position and other operating criteria to adjust for, or that affect, the conditions of the beam path.

The conveyance device for the laser tools transmits or conveys the laser energy and other materials that are needed to perform the operations. Although shown as a single cable multiple cables could be used. Thus, for example, in the case of a laser tool employing a compound fluid laser jet the conveyance device could include a high power optical fiber, a first line for the core jet fluid and a second line for the annular jet fluid. These lines could be combined into a single cable or they may be kept separate. Additionally, for example, if a laser cutter employing an oxygen jet is utilized, the cutter would need a high power optical fiber and an oxygen line. These lines could be combined into a single tether or they may be kept separate as multiple tethers. The lines and optical fibers should be covered in flexible protective coverings or outer sheaths to protect them from fluids, the work environment, and the movement of the laser tool to a specific work location, for example through a pipeline or down an oil, gas or geothermal well, while at the same time remaining flexible enough to accommodate turns, bends, or other structures and configurations that may be encountered during such travel. The systems of the present inventions can monitor and control some, primary, preferably significant, and most preferably all major operations, parameters or conditions of such high power laser equipment, processes and activities.

The systems and methods of the present inventions are, in part, directed to the cleaning, resurfacing, removal, and clearing away of unwanted materials, e.g., build-ups, deposits, corrosion, or substances, in, on, or around structures, e.g. the work piece, or work surface area. Such unwanted materials would include by way of example rust, corrosion, corrosion by products, degraded or old paint, degraded or old coatings, paint, coatings, waxes, hydrates, microbes, residual materials, biofilms, tars, sludges, and slimes. The present inventions enable the ability to have laser energy of sufficient power and characteristics to be transported over great lengths and delivered to remote and difficult to access locations. Although an application for the present inventions would be in field of "flow assurance," (a broad term that has been recently used in the oil and natural gas industries to cover the assurance that hydrocarbons can be brought out of the earth and delivered to a customer, or end user) they would also find many applications and uses in other fields as illustrated by the following examples and embodiments. Moreover, the present inventions would have uses and applications beyond oil, gas, geothermal and flow assurance, and would be applicable to the, cleaning, resurfacing, removal and clearing away of unwanted materials in any location that is far removed from a laser source, or difficult to access by conventional technology as well as assembling and monitoring structures in such locations. The control systems can monitor and control some, primary, preferably significant, and most preferably all major operations, parameters or conditions of such high power laser equipment, processes and activities.

In addition to directly affecting, e.g., cutting, cleaning, welding, etc., a work piece or sight, e.g., a tubular, borehole, etc., the high power laser systems can be used to transmit high power laser energy to a remote tool or location for conversion of this energy into electrical energy, for use in operating motors, sensors, cameras, or other devices associated with the tool. In this manner, for example and by way of illustration, a single optical fiber, or one or more fibers, preferably shielded, have the ability to provide all of the energy needed to operate the remote tool, both for activities to affect the work surface, e.g., cutting drilling etc. and for other activities, e.g., cameras, motors, etc. The optical fibers of the present invention are substantially lighter and smaller diameter than convention electrical power transmission cables; which provides a potential weight and size advantage to such high power laser tools and assemblies over conventional non-laser technologies. The systems can monitor and control some, primary, preferably significant, and most preferably all major operations, parameters or conditions of such high power laser equipment, processes and activities.

Photo voltaic (PV) devices or mechanical devices may be used to convert the laser energy into electrical energy. Thus, as energy is transmitted down the high power optical fiber in the form high power laser energy, i.e., high power light having a very narrow wavelength distribution it can be converted to electrical, and/or mechanical energy. A photo-electric conversion device is used for this purpose and is located within, or associated with a tool or assembly. These photo-electric conversion devices can be any such device(s) that are known to the art, or may be later developed by the art, for the conversion of light energy, and in particular laser light energy, into electrical, mechanical and/or electro-mechanical energy. Thus, for example laser-driven magnetohydrodynamic (laser MHD) devices may be used, theromphotovolatic devices may be used, thermoelectic devices may be used, photovoltaic devices may be used, a micro array antenna assembly that employs the direct coupling of photos to a micro array antenna (the term micro array antenna is used in the broadest sense possible and would include for example nano-wires, semi conducting nano-wires, micro-antennas, photonic crystals, and dendritic patterned arrays) to create oscillatory motion to then drive a current may be used, a sterling engine with the laser energy providing the heat source could be used, a steam engine or a turbine engine with the laser energy providing the heat source could be used. Such systems, apparatus and methods are disclosed and taught in U.S. patent application Ser. No. 13/374,445, the entire disclosure of which is incorporated herein by reference. The control can monitor and control some, primary, preferably significant, and most preferably all major operations, parameters or conditions of such high power laser equipment, processes and activities. High power laser systems, units, tools, conveyance structures and various applications and methods are disclosed and taught in the following US Patent Applications and US Patent Application Publications: Publication No. US 2010/0044106, Publication No. US 2010/0044105, Publication No. US 2010/0044104, Publication No. US 2010/0044103, Publication No. 2010/0044102, Publication No. US 2010/0215326, Publication No. 2012/0020631, Ser. No. 13/347,445, Ser. No. 13/210,581, Ser. No. 13/211,729, Ser. No. 13/366,882 Ser. No. 13/222,931, Ser. No. 12/896,021, Ser. No. 61/514,391, Ser. No. 61/446,407, Ser. No. 61/446,042 and Ser. No. 61/493,174, the entire disclosures of each of which are incorporated herein by reference. The systems of the present inventions may be utilized with, for, on, or in conjunction with the high power laser systems, units, tools, structures, applications and methods disclosed and taught in these forgoing patent applications. Thus, the embodiments in disclosed and taught in these foregoing patent applications may be monitored, controlled or both monitored and controlled by the systems of the present inventions. Further the various configurations, components, operations, examples and associated teachings for control systems, monitoring systems and control and monitoring systems are applicable to each other and as such configurations, components, operations and components of one embodiment may be employed with another embodiment, and combinations and variations of these, as well as, future structures and systems, and modifications to existing structures and systems based in-part upon the teachings of this specification. Thus, for example, the components, systems and operations provided in the various figures of this specification may be used with each other and the scope of protection afforded the present inventions should not be limited to a particular embodiment, configuration or arrangement that is set forth in a particular example or a particular embodiment in a particular Figure.

Many other uses for the present inventions may be developed or released and thus the scope of the present inventions is not limited to the foregoing examples of uses and applications. Thus, for example, in addition to the forgoing examples and embodiments, the implementation of the present inventions may also be utilized in laser systems for hole openers, reamers, whipstocks, and other types of boring tools.

The present inventions may be embodied in other forms than those specifically disclosed herein without departing from its spirit or essential characteristics. The described embodiments are to be considered in all respects only as illustrative and not restrictive.

What is claimed:

1. A system for controlling, operating, or monitoring, a high power laser unit having a high power laser energy source, a high power optical conveyance device, and a high power laser tool, wherein the high power optical conveyance device optically conveys a laser beam from the high power laser energy source to the high power laser tool, the system comprising:

a. a controller; and b. a control network comprising:

i. a first monitoring device;

ii. a second monitoring device;

wherein the first monitoring device is positioned with respect to a location on the high power laser unit to detect laser energy;

wherein the second monitoring device is positioned with respect to a location on the high power laser unit to detect a status of a component of the high power laser unit;

wherein the first and second monitoring devices, in communication with the controller, wherein at least one of the first and second monitoring devices is configured to send a monitoring signal on the control network to the controller;

wherein the controller is configured to perform a control operation based upon the monitoring signal received from the at least one of the first and second monitoring devices; and wherein the component is a laser bottom hole assembly having a bit and the monitoring signal is an RPM of the bit.

2. The system of claim 1, wherein the component is a laser tool and the monitoring signal indicates a failure of the laser tool and the control operation is sending a control signal to shut down the high power laser energy source.

3. The system of claim 1, wherein the monitoring signal is sent from the first or second monitoring device and the control operation is to wait for a signal from the other monitoring device.

4. The system of claim 1, wherein the first monitoring device comprises a photo diode and the second monitoring device comprises a load cell.

5. The system of claim 1, wherein the component is a laser tool and the monitoring signal indicates a position of the laser tool.

6. A control system for a high power laser unit for performing a laser operation at a remote location, the control system comprising:

a. a first module in communication with a laser source of high power laser energy, the laser source capable of providing a laser beam baying at least 5 kW of power;

b. a second module in communication with an umbilical, the umbilical comprising: an umbilical distal end and an umbilical proximal end, and a high power optical fiber having a high power optical fiber distal end and a high power optical fiber proximal end, wherein the high power optical fiber is associated, with the umbilical and the high power optical fiber distal end is associated with the umbilical distal end;

c. a third module in communication with a high power laser tool, the high power laser tool in optical association with the high power optical fiber distal end and in mechanical association with the umbilical distal end;

d. a fourth module in communication with a motive means, the motive means to advancing the umbilical distal end to a predetermined worksite location;

e. wherein the high power optical fiber proximal end is in optical association with the laser source, wherein the laser beam is configured to be transmitted from the laser source to the high power laser tool;

f. a fifth module in communication with a human-machine interface; and, g. a control module in communication with the first, second, third, fourth and fifth modules;

h. wherein the control module is configured to send a control signal to at least one of the first, second, third, and fourth modules based upon a signal received from at least one of the first, second, third, fourth or fifth modules, to control an operation of the high power laser unit.

7. The system and unit of claim 6, wherein the control module is associated with a programmable logic controller.

8. The system and unit of claim 7, wherein the control module is associated with a personal computer.

9. The system and unit of claim 6, wherein the umbilical is selected from a group consisting of a composite tubing, a coiled tubing, and a wireline; wherein the high power optical fiber has a length selected from a group consisting of about 0.5 km, about 1 km, about 2 km, about 3 km and from about 0.5 km to about 5 km; and wherein the high power laser tool is selected from a group consisting of a laser cutting tool, a laser bottom hole assembly and an electric motor laser bottom hole assembly.

10. The system and unit of claim 6, wherein the first, third and control modules reside on a control network, and wherein the control network and the first, third and control modules are configured to send and receive data signals and control signals between the first, third and control modules.

11. The system and unit of claim 7, wherein the second, fourth and fifth modules reside on a control network, and wherein the control network and the second, fourth, fifth and control modules are configured to send and receive data signals and control signal between the second, fourth, fifth and control modules.

12. The system and unit of claim 6, wherein a signal is received from the fifth module causing the control module to send a control signal to the third and fourth modules to stop an operation of the high power laser tool, and retrieve the high power laser tool.

13. A control system for a high power laser unit for performing, a laser operation at a remote location, the control system comprising:

a. a first module in communication with a laser source of high power laser energy, the laser source capable of providing a laser beam having at least 5 kW of power;

b. a second module in communication with an umbilical, the umbilical comprising; an umbilical distal end and an umbilical proximal end, and a high power optical fiber having a high power optical fiber distal end and a high power optical fiber proximal end, wherein the high power optical fiber is associated with the umbilical and the high power optical fiber distal end is associated with the umbilical distal end;

c. a third module in communication with a high power laser tool, the high power laser tool in optical association with the high power optical fiber distal end and in mechanical association with the umbilical distal end;

d. a fourth module in communication with an advancement and removal apparatus for advancing the umbilical distal end to a predetermined worksite location and for retracting the umbilical distal end from the predetermined worksite location;

e. wherein the high power optical fiber proximal end is in optical association with the laser source, wherein the laser beam is configured to be transmitted from the laser source to the high power laser tool;

f. a fifth module in communication with a human-machine interface; and, g. a control module in communication with the first, second, third, fourth and fifth modules;

h. wherein the control module is configured to send a control signal to at least one of the first, second, third, and fourth modules based upon a signal received from at least one of the first, second, third, fourth or fifth modules, to control an operation of the high power laser unit.

14. A control system for a high power laser unit for performing a laser operation at a remote location, the control system comprising:

a. a first module in communication with a laser source of high power laser energy, the laser source capable of providing a laser beam having at least 5 kW of power;

b. a second module in communication with an umbilical, the umbilical comprising: an umbilical distal end and an umbilical proximal end, and the high power laser source associated with the umbilical distal end;

c. third module in communication with a high power laser tool, the high power laser tool in optical association with the high power laser source and in mechanical association with the umbilical distal end;

d. a fourth module in communication with an advancement and removal apparatus for advancing the umbilical distal end to a predetermined worksite location and for retracting the umbilical distal end from the predetermined worksite location;

e. wherein the laser beam is configured to be transmitted from the laser source to the high power laser tool;

f. a fifth module in communication with a human-machine interface; and, g. a control module in communication with the first, second, third, fourth and fifth modules;

h. wherein the control module is configured to send a control signal to at least one of the first, second, third, and fourth modules based upon a signal received from at least one of the first, second, third, fourth or fifth modules, to control an operation of the high power laser unit.

* * * * *